US009399345B2

(12) United States Patent
Hirasawa

(10) Patent No.: US 9,399,345 B2
(45) Date of Patent: Jul. 26, 2016

(54) WASTE LIQUID CONTAINER, ATTACHMENT, WASTE LIQUID COLLECTION UNIT, AND LIQUID EJECTING APPARATUS

(71) Applicant: SEIKO EPSON CORPORATION, Tokyo (JP)

(72) Inventor: Yusuke Hirasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/957,195

(22) Filed: Dec. 2, 2015

(65) Prior Publication Data

US 2016/0082736 A1 Mar. 24, 2016

Related U.S. Application Data

(63) Continuation of application No. 14/699,914, filed on Apr. 29, 2015, now Pat. No. 9,233,543.

(30) Foreign Application Priority Data

Apr. 30, 2014 (JP) ..... 2014-094230
Oct. 27, 2014 (JP) ..... 2014-218054

(51) Int. Cl.
*B41J 2/165* (2006.01)

(52) U.S. Cl.
CPC ..... *B41J 2/16517* (2013.01); *B41J 2/16523* (2013.01)

(58) Field of Classification Search
CPC ..... B41J 2/16523; B41J 2/16517; B41J 2002/1728; B41J 2002/1721; B41J 2002/1735; B41J 2002/1742
See application file for complete search history.

(56) References Cited

U.S. PATENT DOCUMENTS

| | | | | |
|---|---|---|---|---|
| 7,452,062 | B2 | 11/2008 | Kimura et al. | |
| 7,677,710 | B2 | 3/2010 | Kobayashi et al. | |
| 7,976,121 | B2 | 7/2011 | Harada | |
| 8,353,585 | B2 * | 1/2013 | Harada | B41J 2/1721 347/36 |

FOREIGN PATENT DOCUMENTS

| | | |
|---|---|---|
| JP | 2005-047089 | 2/2005 |
| JP | 2007-253418 | 10/2007 |
| JP | 2010-195054 | 9/2010 |
| JP | 2013-147039 | 8/2013 |
| JP | 2013-216010 | 10/2013 |

* cited by examiner

*Primary Examiner* — Juanita D Jackson
(74) *Attorney, Agent, or Firm* — Workman Nydegger

(57) ABSTRACT

A waste liquid container is detachably mounted on a mounting unit which includes a discharge portion discharging a waste liquid and a projection to which a substrate connection portion is joined. The waste liquid container includes: a containing portion that is able to contain the waste liquid; a connection concave portion that is opened in a mounting direction; a circuit substrate that includes connection terminals electrically connected to the substrate connection portion and is joined to the connection concave portion; and a waste liquid introduction portion that is connected to the discharge portion. In the connection concave portion, one pair of guide portions guiding the projection is formed so that the connection terminals are interposed therebetween in a width direction intersecting the mounting direction. Of the pair of guide portions, one guide portion is disposed between the connection terminals and the waste liquid introduction portion in the width direction.

9 Claims, 36 Drawing Sheets

WASTE LIQUID CONTAINER, ATTACHMENT, WASTE LIQUID COLLECTION UNIT, AND LIQUID EJECTING APPARATUS

This application is a Continuation of U.S. application Ser. No. 14/699,914 filed Apr. 29, 2015, which is expressly incorporated herein by reference. The entire disclosure of Japanese Patent Application No. 2014-094230, filed Apr. 30, 2014 and Japanese Patent Application No. 2014-218054, filed Oct. 27, 2014 are expressly incorporated by reference herein.

BACKGROUND

1. Technical Field

The present invention relates to a liquid ejecting apparatus such as an ink jet printer and a waste liquid container, an attachment, and a waste liquid collection unit applied to the liquid ejecting apparatus.

2. Related Art

As an example of a liquid ejecting apparatus, there is an ink jet printer that performs printing by ejecting ink from nozzles formed in a liquid ejecting head. In order to prevent or resolve clogging of the nozzles in such a printer, the ink is discharged as a waste liquid from the nozzles and the discharged waste liquid is contained in a waste liquid container detachably mounted on a mounting mechanism in some cases. A waste liquid container includes a container member that can contain the waste liquid, a circuit substrate that stores various kinds of information regarding a capacity or the like of the waste liquid, a connection terminal of the circuit substrate, and a guide portion that positions an apparatus-side connection terminal at the time of the mounting on the mounting mechanism (for example, see JP-A-2013-216010).

The waste liquid container includes a waste liquid introduction portion which is opened upward. When the waste liquid container is mounted on the mounting mechanism, the waste liquid flowing down from the vertically upper side of the waste liquid container is introduced into the container member via the waste liquid introduction portion. When the waste liquid is introduced via the waste liquid introduction portion opened toward a lateral side, it is possible to obtain the advantage that the height of the waste liquid container can be reduced, compared to the case in which the waste liquid is introduce from the waste liquid introduction portion opened upward.

When a discharge portion of the mounting mechanism is connected to the waste liquid introduction portion with the mounting of the waste liquid container on the mounting mechanism, it is possible to simplify an operation of mounting the waste liquid container on the mounting mechanism. However, in order to connect the discharge portion to the waste liquid introduction portion with the mounting of the waste liquid container, there is a problem that the waste liquid container has to be mounted while the connection terminal of the circuit substrate is positioned to the connection terminal of the apparatus side and the waste liquid introduction portion is also matched with the discharge portion.

This problem is not limited to only the waste liquid container detachably mounted on the printer, but is nearly common to waste liquid containers detachably mounted on mounting units.

SUMMARY

An advantage of some aspects of the invention is that it provides a waste liquid container which can be mounted on a mounting unit while the positions of a waste liquid discharge portion formed in the mounting unit and a substrate connection portion are aligned and a liquid ejecting apparatus on which the waste liquid container is mounted.

Hereinafter, means of the invention and operation effects thereof will be described.

According to an aspect of the invention, there is provided a waste liquid container detachably mounted on a mounting unit which includes a discharge portion discharging a waste liquid and a projection to which a substrate connection portion is joined. The waste liquid container includes: a containing portion that is able to contain the waste liquid; a connection concave portion that is opened in a mounting direction in regard to the mounting unit so that the projection is insertable at a time of mounting on the mounting unit; a circuit substrate that includes connection terminals electrically connected to the substrate connection portion at the time of the mounting on the mounting unit and is joined to the connection concave portion; and a waste liquid introduction portion that is connected to the discharge portion at the time of the mounting on the mounting unit. In the connection concave portion, one pair of guide portions guiding the projection at the time of the mounting on the mounting unit is formed so that the connection terminals are interposed therebetween in a width direction intersecting the mounting direction. Of the pair of guide portions, one guide portion is disposed between the connection terminals and the waste liquid introduction portion in the width direction.

In the configuration, when the waste liquid container is moved in the mounting direction to be mounted on the mounting unit, the projection is inserted into the connection concave portion of the waste liquid container so that the positions of the connection terminals recessed in the connection concave portion can be substantially aligned with the position of the substrate connection portion recessed in the projection. Subsequently, the projection is guided by the pair of guide portions in the connection concave portion, so that the positions of the connection terminals are accurately aligned with the substrate connection portion. One of the pair of guide portions is disposed between the connection terminals and the waste liquid introduction portion in the width direction. Therefore, when the positions of the connection terminals are aligned, the position of the waste liquid introduction portion can be aligned. Accordingly, the waste liquid container can be mounted on the mounting unit while the position of the waste liquid container is aligned with the substrate connection portion and the discharge portion of the waste liquid formed in the mounting unit.

In the waste liquid container, the one guide portion may protrude in a wall portion forming the waste liquid introduction portion and the connection concave portion to project toward an inside of the connection concave portion.

In the configuration, by protruding the one guide portion from the wall portion forming the waste liquid introduction portion and the connection concave portion, the distance between the waste liquid introduction portion and the guide portion is shortened. Thus, the position of the waste liquid introduction portion can be aligned accurately by the guide portions.

In the waste liquid container, the one pair of guide portions may include a guide surface extending in the mounting direction and the width direction. The waste liquid introduction portion may be opened in the mounting direction and an opening center of the waste liquid introduction portion may be located on a plane including the guide surface.

In the configuration, the opening center of the waste liquid introduction portion is located on the plane including the guide surface of the one pair of guide portions. Therefore, the guide surface guides the projection formed in the mounting unit, and thus the position of the waste liquid introduction portion can be aligned in the direction intersecting both of the mounting direction and the width direction.

In the waste liquid container, at least some of the connection terminals may be disposed to face a region between the one guide portion and the other guide portion of the one pair of guide portions.

In the configuration, at least some of the connection terminals are disposed to face the region between the one guide portion and the other guide portion of the one pair of guide portions. Therefore, the positions of the connection terminals can be accurately aligned with the substrate connection portion more than when the region and the connection terminals are distant from each other in the mounting direction.

In the waste liquid container, the substrate connection portion may include a movable contact portion elastically deformable according to a contact pressure. At the time of the mounting on the mounting unit, the one pair of guide portions may engage with the projection by an elastic restoration force of the movable contact portion which is pressed against the connection terminals and is elastically deformed.

In the configuration, when the waste liquid container is mounted on the mounting unit, the guide portions and the projection engage with each other by the elastic restoration force of the movable contact portion pressed by the connection terminals, so that the state in which the movable contact portion comes into contact with the connection terminals by the predetermined contact pressure can be maintained. Thus, for example, even when the waste liquid container is slightly moved due to vibration or the like, the state in which the connection terminals are electrically connected to the substrate connection portion can be maintained.

In the waste liquid container, the connection concave portion and the waste liquid introduction portion may be formed to be arranged in the width direction in a convex portion protruding from the containing portion in the mounting direction. Both ends of the convex portion in the width direction may be disposed in the width direction more inside than both ends of the containing portion in the width direction.

In the configuration, since both ends of the convex portion in the width direction are disposed inside both ends of the containing portion in the width direction, it is possible to suppress unnecessary collision of the connection concave portion and the waste liquid introduction portion to other members or the like more than when the connection concave portion and the waste liquid introduction portion are disposed at the end in the width direction.

The waste liquid container may further include an absorber that is able to absorb the waste liquid; an accommodation member in which an accommodation concave portion capable of accommodating the absorber is formed; a film member that covers an opening of the accommodation concave portion; and a reinforcement member that is disposed between the absorber and the film member. The containing portion may be surrounded by the accommodation concave portion and the film member.

In the configuration, by covering the opening of the accommodation concave portion formed in the accommodation member with the film member, the size of the accommodation concave portion can be reduced in the depth direction more easily than when the opening of the accommodation concave portion is covered with a plate-shaped member. By disposing the reinforcement member between the absorber and the film member, deformation of the absorber is suppressed when the absorber accommodated in the accommodation concave portion is pressed via the film member. Thus, the leakage of the liquid absorbed in the absorber can be suppressed.

In the waste liquid container, the accommodation member may include a protrusion projecting inside the accommodation concave portion. The absorber may include an insertion portion into which the protrusion is insertable.

In the configuration, by inserting the protrusions formed in the accommodation member into the insertion portions formed in the absorber, it is possible to suppress movement of the absorber inside the accommodation concave portion.

In the waste liquid container, the reinforcement member may be disposed between the protrusion and the film member.

In the configuration, by disposing the reinforcement member between the protrusions and the film member, movement of the reinforcement member pressed via the film member can be suppressed by the protrusions. Accordingly, it is possible to suppress occurrence of leakage of the waste liquid absorbed by the absorber when the reinforcement member is moved to press the absorber.

In the waste liquid container, the reinforcement member may be formed of a sheet-shaped resin material.

In the configuration, by forming the reinforcement member in the sheet shape, it is possible to ensure a large space for accommodating the absorber inside the accommodation concave portion. Further, a resin material is easily molded, and thus is suitable to form the reinforcement member in the sheet shape.

According to another aspect of the invention, there is provided a liquid ejecting apparatus including: a liquid ejecting unit that is able to eject a liquid; and a mounting unit on which the foregoing waste liquid container is detachably mounted. The mounting unit includes a discharge portion discharging a waste liquid and a projection to which a substrate connection portion is joined.

In the configuration, the same operational advantages as those of the waste liquid container can be obtained.

According to still another aspect of the invention, there is provided an attachment which is a separate body from a waste liquid containing unit accommodated in an accommodation chamber, in which a mounting unit including a discharge portion discharging a waste liquid to a waste liquid containing unit and a projection to which a substrate connection portion is joined, in a state in which the liquid containing unit is mounted on the mounting unit. The attachment includes: a connection concave portion that is opened in a mounting direction in regard to the mounting unit so that the projection is insertable at a time of mounting on the mounting unit; and a circuit substrate that includes connection terminals electrically connected to the substrate connection portion at the time of the mounting on the mounting unit and is joined to the connection concave portion. In the connection concave portion, one pair of guide portions guiding the projection at the time of the mounting on the mounting unit is formed so that the connection terminals are interposed therebetween in a width direction intersecting the mounting direction.

In the configuration, when the attachment is moved in the mounting direction to be mounted on the mounting unit, the projection is inserted into the connection concave portion of the attachment so that the positions of the connection terminals recessed in the connection concave portion can be substantially aligned with the position of the substrate connection portion provided to the projection. Subsequently, the projection is guided by the pair of guide portions in the connection concave portion, so that the positions of the connection terminals are accurately aligned with the substrate connection portion. Accordingly, the attachment can be mounted on the mounting unit while the position of the attachment is aligned with the substrate connection portion formed in the mounting unit.

On the other hand, since the waste liquid containing unit containing the waste liquid discharged from the discharge portion is considered as the separate body from the attachment, the volume of the waste liquid containing unit can be increased without an influence on the volume (size) of the accommodation chamber in which the attachment is accommodated. Accordingly, by increasing the size of the waste liquid containing unit and increasing the amount of waste liquid which can be contained in the waste liquid containing unit, it is possible to discharge the more waste liquid from the discharge portion.

The attachment may further include a waste liquid introduction portion that is connected to the discharge portion at the time of the mounting on the mounting unit. Of the pair of guide portions, one guide portion is disposed between the connection terminals and the waste liquid introduction portion in the width direction.

In the configuration, when the attachment is mounted on the mounting unit, the discharge portion of the mounting unit is connected to the waste liquid introduction portion of the attachment. Therefore, the waste liquid can be discharged from the discharge portion to the waste liquid containing unit via the attachment. Here, one of the pair of guide portions is disposed between the connection terminals and the waste liquid introduction portion in the width direction. Therefore, when the positions of the connection terminals are aligned, the position of the waste liquid introduction portion can be aligned.

In the attachment, the one guide portion may protrude in a wall portion forming the waste liquid introduction portion and the connection concave portion to project toward an inside of the connection concave portion.

In the configuration, by protruding the one guide portion on the wall portion forming the waste liquid introduction portion and the connection concave portion, the distances between the waste liquid introduction portion and the guide portions are shortened. Thus, the position of the waste liquid introduction portion can be accurately aligned by the guide portions.

In the attachment, the one pair of guide portions may include a guide surface extending in the mounting direction and the width direction. The waste liquid introduction portion may be opened in the mounting direction and an opening center of the waste liquid introduction portion may be located on a plane including the guide surface.

In the configuration, the opening center of the waste liquid introduction portion is located on the plane including the guide surface of the one pair of guide portions. Therefore, the guide surface guides the projection formed in the mounting unit, and thus the position of the waste liquid introduction portion can be aligned in the direction intersecting both of the mounting direction and the width direction.

In the attachment, at least some of the connection terminals may be disposed to face a region between the one guide portion and the other guide portion of the one pair of guide portions.

In the configuration, at least some of the connection terminals are disposed to face the region between the one guide portion and the other guide portion of the one pair of guide portions. Therefore, the positions of the connection terminals can be accurately aligned with the substrate connection portion more than when the region and the connection terminals are distant from each other in the mounting direction.

According to still another aspect of the invention, there is provided a waste recovery unit including the foregoing attachment; a waste liquid containing unit that is able to contain a waste liquid; and a connection passage that connects the attachment to the waste liquid containing unit.

In the configuration, since the connection passage connects the attachment to the waste liquid containing unit, the degree of freedom of the disposition of the waste liquid containing unit can be improved by dragging the connection passage freely.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an embodiment of a liquid ejecting apparatus and a waste liquid container mounted on the liquid ejecting apparatus will be described with reference to the drawings. The liquid ejecting apparatus is, for example, an ink jet printer that performs recording (printing) by ejecting ink which is an example of a liquid to a medium such as a sheet.

Figure 1:
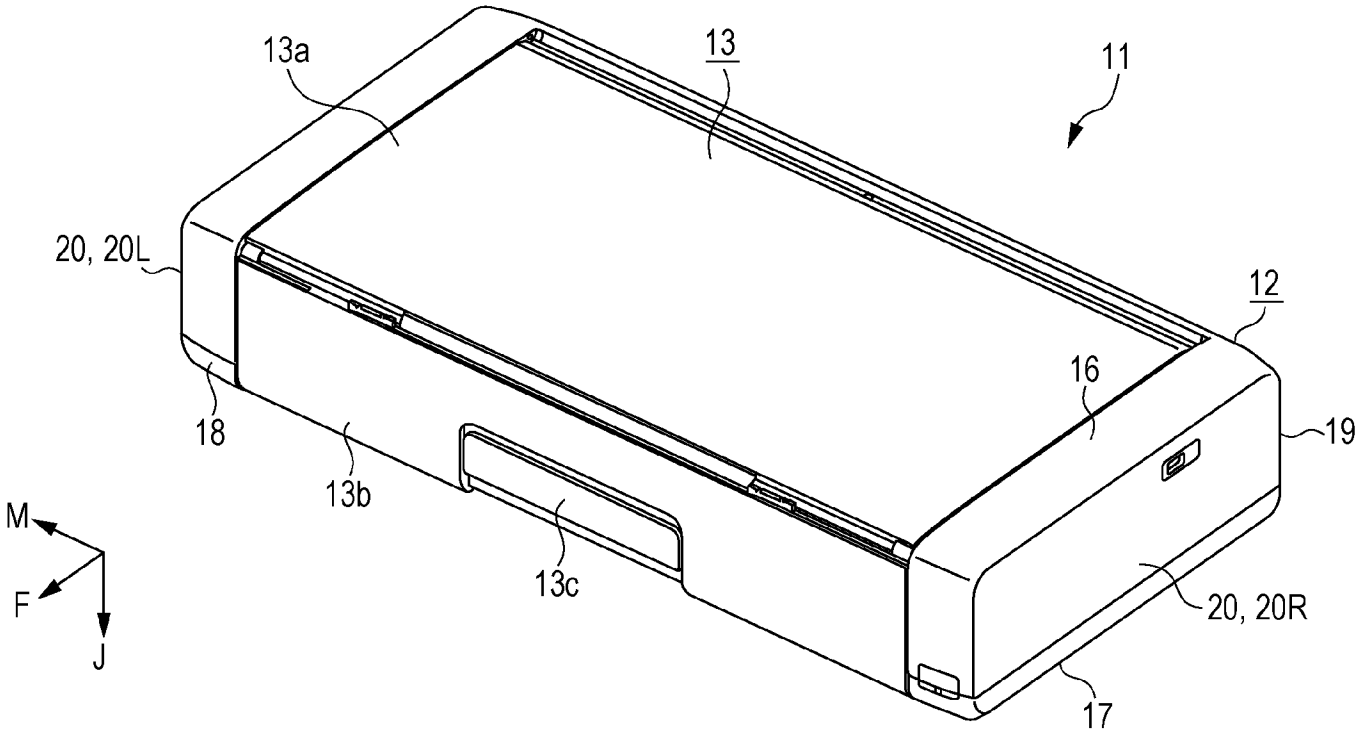
FIG. 1 is a perspective view illustrating a liquid ejecting apparatus according to an embodiment.

As illustrated in FIG. 1, a liquid ejecting apparatus 11 includes a rectangular box-like casing unit 12 and an opening/closing body 13 mounted on the casing unit 12. The opening/closing body 13 includes a rectangular plate-shaped body portion 13*a* that is joined to be pivotable with respect to the casing unit 12 and a rectangular plate-shape extension portion 13*b* that is joined such that a base end portion is pivotable with respect to the body portion 13*a*.

The extension portion 13*b* is smaller than the body portion 13*a*. A hand-catch portion 13*c* is recessed on the front end side of the extension portion 13*b*. The opening/closing body 13 is disposed at a close position illustrated in FIG. 1 and an open position illustrated in FIG. 2 by catching the hand-catch portion 13*c* with a hand and pivoting the extension portion 13*b* and the body portion 13*a* at up to predetermined angles, respectively.

Figure 2:
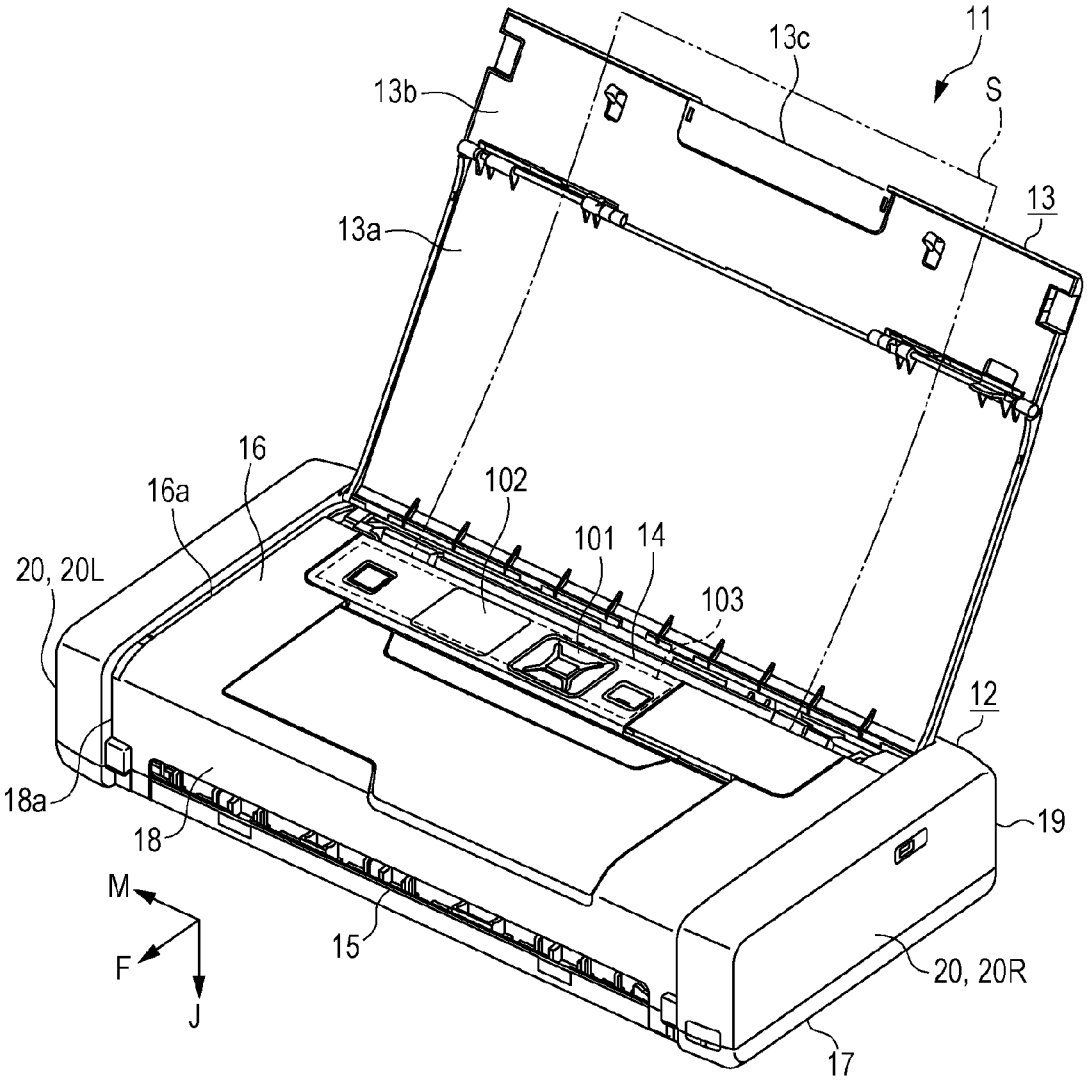
FIG. 2 is a perspective view illustrating a state at the time of use of the liquid ejecting apparatus.

When the opening/closing body 13 is disposed at the open position, as illustrated in FIG. 2, an insertion opening 14 through which a medium S is inserted into the casing unit 12 and a discharge opening 15 through which the medium S is discharged from the casing unit 12 are exposed. The opening/closing body 13 disposed at the open position functions as a support base (sheet feeding tray) supporting the medium S inserted into the insertion opening 14.

In the casing unit 12, the outer wall to which the insertion opening 14 is opened is referred to as a top wall 16, the outer wall opposite to the top wall 16 is referred to as a bottom wall 17, the outer wall to which the discharge opening 15 is opened is referred to as a front wall 18, and the outer wall opposite to the front wall 18 is referred to as a rear wall 19. In the casing unit 12, pairs of outer walls in which the top wall 16, the bottom wall 17, the front wall 18, and the rear wall 19 intersect each other outside walls 20 (20R and 20L). In the casing unit 12, the side of the top wall 16 is referred to as a top surface side and the side of the bottom wall 17 is referred to as a bottom surface side in some cases.

A manipulation unit 101 manipulating the liquid ejecting apparatus 11 and a display unit 102 displaying a manipulation result of the manipulation unit 101, an operation status of the liquid ejecting apparatus 11, and the like are disposed on the external surface (top wall) side of the top wall 16. A control unit 103 controlling an operation of the liquid ejecting apparatus 11 is disposed on the internal surface (bottom surface) side of the top wall 16. The manipulation unit 101 and the display unit 102 are electrically connected to the control unit 103.

In the opening/closing body 13 disposed at the close position, the body portion 13*a* partially overlaps with a part of the top wall 16 so that the insertion opening 14, the manipulation unit 101, and the display unit 102 are covered and the extension portion 13*b* partially overlaps with the front wall 18 so that the discharge opening 15 is covered. Concave portions 16*a* and 18*a* accommodating the body portion 13*a* and the extension portion 13*b* disposed at the close position are recessed in the top wall 16 and the front wall 18. When the opening/closing body 13 is disposed at the close position, the opening/closing body 13 is accommodated in the concave portions 16*a* and 18*a* so that the outside surface thereof are substantially flush with the outside surface of the casing unit 12 to be integrated with the casing unit 12.

A posture (a posture illustrated in FIGS. 1 and 2) at which the bottom wall 17 of the liquid ejecting apparatus 11 is mounted to face a mounted surface is referred to as horizontal placing and a posture (a posture illustrated in FIG. 10) at which the rear wall 19 is mounted to face the mounted surface is referred to as vertical placing. The area of the outer surface of the rear wall 19 is smaller than the area of the outer surface of the bottom wall 17 in the casing unit 12. Therefore, when the liquid ejecting apparatus 11 is mounted at the posture of the vertical placing, the area of the mounted surface becomes small. Therefore, the liquid ejecting apparatus 11 can be used such that the liquid ejecting apparatus 11 is horizontally placed at the time of use and is vertically placed at the time of non-use.

When support legs 12*a* (see FIGS. 3, 5, and 10) protrude from the bottom wall 17 and the rear wall 19 which may be contact surfaces to the mounted surface, the posture of the liquid ejecting apparatus 11 can be stabilized at the time of mounting. The liquid ejecting apparatus 11 includes the casing unit 12 of which the posture can be changed at the time of the mounting in this way and the opening/closing body 13 which can be integrated with the casing unit 12, and thus can be appropriately used as a portable mobile type liquid ejecting apparatus.

Figure 3:
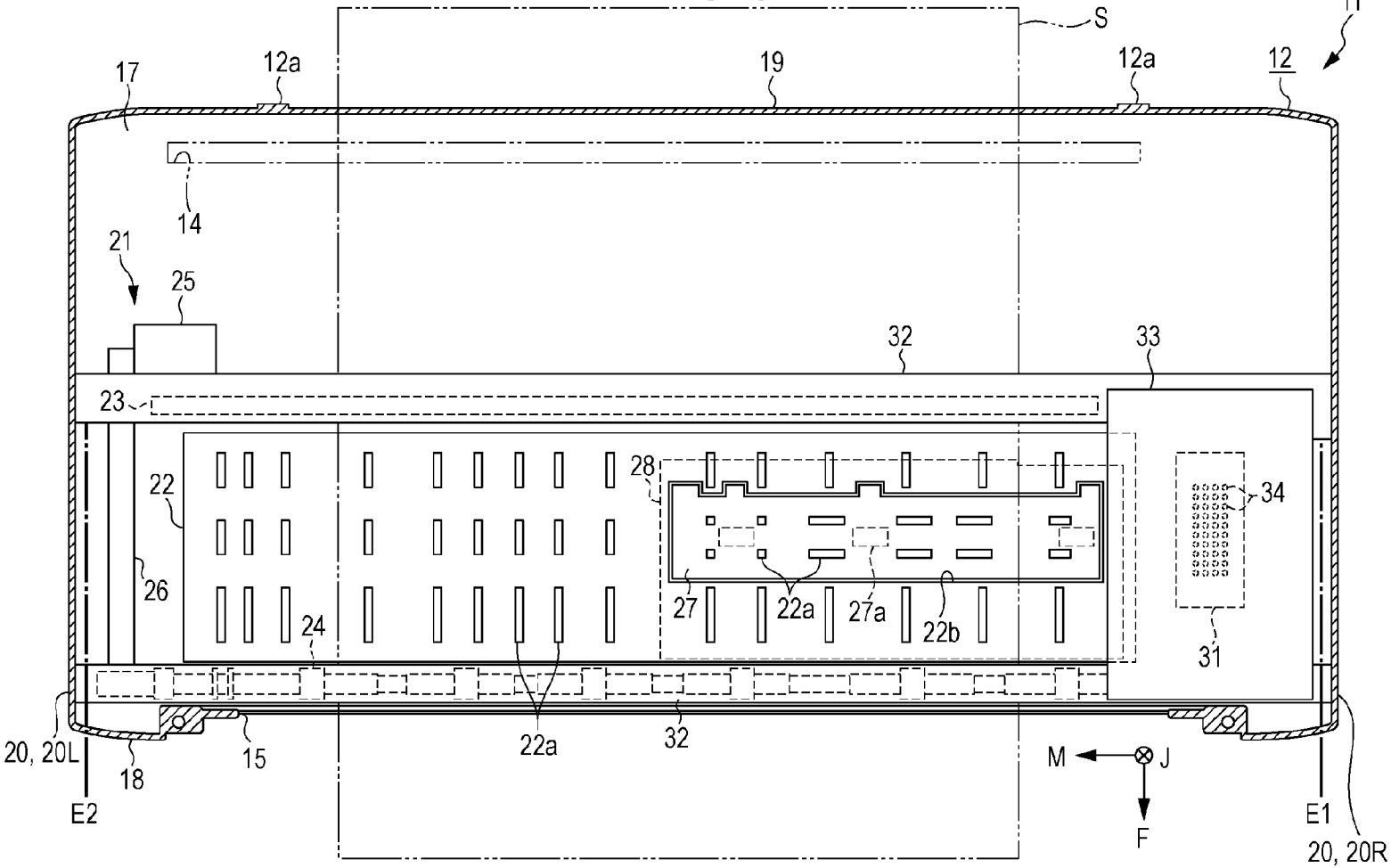
FIG. 3 is a sectional view illustrating the inner configuration of the liquid ejecting apparatus.

As illustrated in FIG. 3, a transport mechanism 21 that transports the medium S inserted from the insertion opening 14 to the discharge opening 15 and a medium support portion 22 that supports the medium S which is being transported are accommodated in the casing unit 12.

The transport mechanism 21 includes a transport roller 23 that transports the medium S from the insertion opening 14 to the medium support portion 22 and a discharge roller 24 that transports the medium S from the medium support portion 22 to the discharge opening 15. The transport mechanism 21 includes a transport motor 25 which is a driving source and a power transmission mechanism 26 which is formed by a gear train or the like transmitting a driving force of the transport motor 25 to the transport roller 23 and the discharge roller 24.

The liquid ejecting apparatus 11 includes a liquid ejecting unit 31 that ejects a liquid to the medium S supported by the medium support portion 22 and a carriage 33 that holds the liquid ejecting unit 31 and reciprocates along a guide rail 32 installed in the casing unit 12. The liquid ejecting unit 31 includes a plurality of nozzles 34 ejecting the liquid as liquid droplets.

The liquid ejecting unit 31 ejects the liquid droplets from the nozzles 34 while reciprocating in a movement direction M intersecting a transport direction F of the medium S along with the carriage 33. For example, the liquid ejected by the liquid ejecting unit 31 is supplied from a liquid container 104 (see FIG. 10) detachably mounted on the carriage 33. In the embodiment, an ejection direction J in which the liquid droplets are ejected from the nozzles 34 is a direction intersecting both of the transport direction F and the movement direction M. When the liquid ejecting apparatus 11 is horizontally placed, the ejection direction J is preferably a vertical downside (gravity direction).

In a movement region of the liquid ejecting unit 31, the side of a first end E1 (the right end in FIG. 3) in the movement direction M is set as a home position of the liquid ejecting unit 31. In the movement region, the liquid ejecting unit 31 alternately performs forward movement oriented from the first end E1 to a second end E2 (the left end in FIG. 3) in the movement direction M and backward movement oriented from the second end E2 to the first end E1. In the embodiment, the transport motor 25 is disposed at a position closer to the insertion opening 14 than the medium support portion 22 in the transport direction F and at a position closer to the second end E2 than the first end E1 in the movement direction M.

In the medium support portion 22, a plurality of support protrusions 22*a* supporting the medium S are installed to be arranged in the movement direction M and the transport direction F. In the medium support portion 22, a sheet accommodation concave portion 22*b* is installed on the side of the first end E1 in the movement direction M. A liquid droplet acceptance sheet 27 capable of absorbing the liquid is accommodated in the sheet accommodation concave portion 22*b*.

An absorber 28 capable of absorbing the liquid is disposed between the bottom wall 17 and the sheet accommodation concave portion 22*b* of the medium support portion 22. The absorber 28 is preferably greater than the liquid droplet acceptance sheet 27 in an absorption capacity of the liquid. In the medium support portion 22, a plurality of openings are installed at positions corresponding to the inner bottom of the sheet accommodation concave portion 22*b*. In the liquid droplet acceptance sheet 27, a plurality of extension portions 27*a* of which front ends droop via the openings to come into contact with the absorber 28 are installed.

For example, when non-margin printing is performed up to the margin of the medium S with a small size, such as an L photo sheet or a postcard so that printing is performed without margin, the liquid droplet acceptance sheet 27 accepts the liquid droplets beyond the margin of the medium S. The liquid accepted by the liquid droplet acceptance sheet 27 transitions to the absorber 28 along the extension portions 27*a* to be absorbed by the absorber 28.

Figure 4:
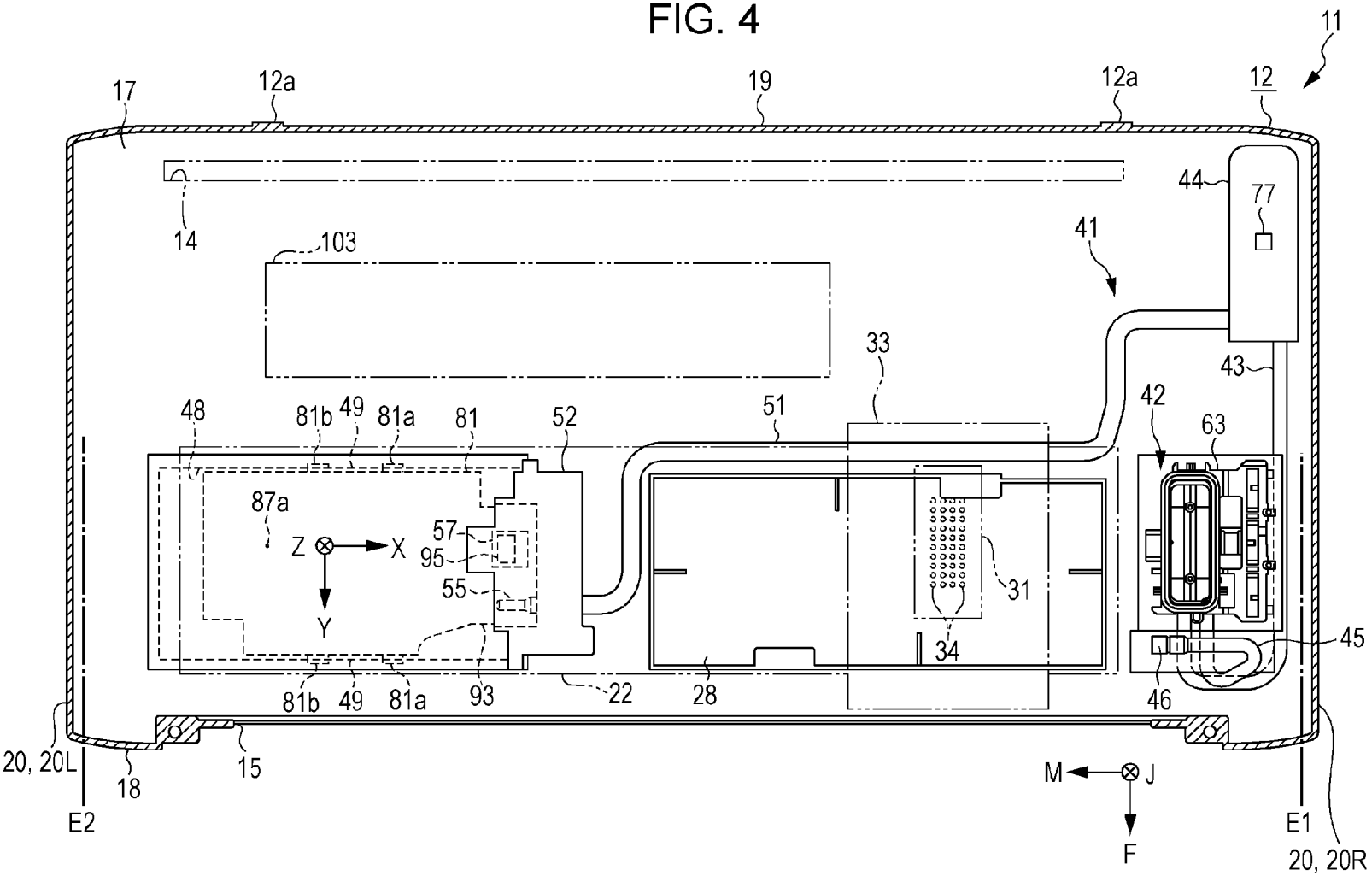
FIG. 4 is a sectional view illustrating the configuration of a maintenance mechanism included in the liquid ejecting apparatus.

As illustrated in FIG. 4, the liquid ejecting apparatus 11 includes a maintenance mechanism 41 that performs maintenance of the liquid ejecting unit 31. In FIG. 4, to clearly show the configuration of the maintenance mechanism 41, the transport mechanism 21 and the guide rail 32 are not illustrated and the medium support portion 22, the carriage 33, and the liquid ejecting unit 31 are indicated by two-dot chain lines. In FIG. 3, to clearly show the configuration of the transport mechanism 21, the maintenance mechanism 41 is not illustrated.

The maintenance mechanism 41 includes a cap 42 that is disposed at a position corresponding to the home position in the movement direction M, a suction mechanism 44 that is connected to the cap 42 via a suction tube 43, a ventilation tube 45 of which a base end side is connected to the cap 42, and an atmosphere opening valve 46 that is installed on the front end side of the ventilation tube 45.

The cap 42 can be moved in the ejection direction J and is moved between a capping position (a position illustrated in FIG. 7) at which the cap 42 comes into contact with the liquid ejecting unit 31 located at the home position and an evacuation position closer to the bottom wall 17 than the capping position.

When the cap 42 is moved to the capping position at which the cap 42 comes into contact with the liquid ejecting unit 31, the cap 42 forms an enclosed space to which the nozzles 34 are opened. Thus, forming the enclosed space to which the nozzles 34 are opened by the cap 42 is referred to as "capping." When the cap 42 is moved from the capping position to the evacuation position, the capping is released. Then, the liquid ejecting unit 31 is moved to the home position to wait in the capped state at the time of power-off or the like at which the liquid is not ejected.

When the atmosphere opening valve 46 is displaced to a valve opening position at which the front end of the ventilation tube 45 is opened, the enclosed space formed by the cap 42 enters a state communicating with the atmosphere. When the atmosphere opening valve 46 is displaced to a valve closing position at which the front end of the ventilation tube 45 is closed, a state in which the enclosed space is enclosed is formed so that the nozzles 34 are prevented from drying.

The suction mechanism 44 is, for example, a suction pump that is formed by a tube pump or the like generating a suction force by crushing an elastically deformable tube by a pressing member in an eccentric state while being moved rotatably. When the atmosphere opening valve 46 is located at the valve closing position and the suction mechanism 44 is driven, the enclosed space is depressurized so that a negative pressure is formed. Thus, suction cleaning of discharging the liquid from the liquid ejecting unit 31 via the nozzles 34 is performed. When the suction mechanism 44 is formed by the tube pump, the enclosed space can be allowed to communicate with the atmosphere by releasing the crushing of the rube by the pressing member. Therefore, in this case, the atmosphere opening valve 46 and the ventilation tube 45 may not be included.

The suction cleaning is performed as a maintenance operation to resolve an ejection failure, for example, when the ejection failure of the liquid occurs due to clogging or the like of the nozzles 34. Therefore, the liquid discharged from the nozzles 34 through the suction cleaning is treated as a waste liquid containing solute components or the like of bubbles mixed inside the liquid ejecting unit 31 or the thickened liquid.

After the suction cleaning is performed, the negative pressure of the enclosed space is released by displacing the atmosphere opening valve 46 to the valve opening position, and then the capping is released by relatively moving the cap 42 in a direction distant from the liquid ejecting unit 31. Thereafter, idle suction is performed to discharge the liquid remaining in the cap 42 by driving the suction mechanism 44.

As a maintenance operation performed to resolve an ejection failure, the liquid ejecting unit 31 performs flushing in some cases by ejecting liquid droplets toward the cap 42 located at the evacuation position. After the flushing is performed, idle suction is performed to discharge the liquid accepted by the cap 42 by driving the suction mechanism 44.

The liquid ejecting apparatus 11 includes a mounting unit 52 connected to the suction mechanism 44 via a discharge tube 51. The mounting unit 52 is disposed at a position interposed between the medium support portion 22 and the bottom wall 17 in the ejection direction J and a position closer to the second end E2 (the left end in FIG. 4) than the absorber 28 in the movement direction M.

A waste liquid container 81 capable of containing a waste liquid is detachably mounted on the mounting unit 52. The liquid (waste liquid) discharged from the liquid ejecting unit 31 to the cap 42 through the suction cleaning or the flushing is contained in the waste liquid container 81 mounted on the mounting unit 52 via the discharge tube 51 with the driving of the suction mechanism 44. In the embodiment, the cap 42, the absorber 28, the mounting unit 52, and the waste liquid container 81 mounted on the mounting unit 52 are disposed to be arranged sequentially from the first end E1 to the second end E2 in the movement direction M.

The waste liquid container 81 according to the embodiment is moved from the side of the second end E2 to the side of the first end E1 to be mounted on the mounting unit 52 in the liquid ejecting apparatus 11. The waste liquid container 81 mounted on the liquid ejecting apparatus 11 is moved from the side of the first end E1 to the side of the second end E2 to be detached (removed) from the mounting unit 52. Therefore, a direction (an opposite direction to the movement direction M) oriented from the second end E2 to the first end E1 is referred to as a mounting direction X of the waste liquid container 81 and a direction (the movement direction M) oriented from the first end E1 to the second end E2 is referred to as a detaching direction of the waste liquid container 81 in some cases. In the waste liquid container 81, one end (the right end in FIG. 4) which is the front side (the side on which the waste liquid container 81 is mounted on the mounting unit 52) of the mounting direction X is referred to as a front end and the other end (the left end in FIG. 4) which is an opposite side to the one end is referred to as a rear end in some case.

A direction intersecting the mounting direction X of the waste liquid container 81 is referred to as a width direction Y and a direction intersecting both of the mounting direction X and the width direction Y is referred to as a thickness direction Z. In the embodiment, the width direction Y is a direction orthogonal to the mounting direction X and is a direction identical to the transport direction F when the waste liquid container 81 is mounted on the mounting unit 52. In the embodiment, the thickness direction Z is a direction orthogonal to both of the mounting direction X and the width direction Y and is a direction identical to the ejection direction J when the waste liquid container 81 is mounted on the mounting unit 52.

On the bottom wall 17 of the casing unit 12, a waste liquid container accommodation portion 48 that can contain the waste liquid container 81 is recessed to be opened in the ejection direction J (the bottom surface side). The length of the waste liquid container accommodation portion 48 in the mounting direction X is longer than the length of the waste liquid container 81 in the mounting direction X.

In the waste liquid container accommodation portion 48, a movement guide portion 49 guiding the waste liquid container 81 mounted on or detached from the mounting unit 52 is installed to extend in the mounting direction X. Guide protrusions 81*a* and 81*b* engaging with the movement guide portion 49 at the time of the mounting on the mounting unit 52 protrude on both of the end sides of the waste liquid container 81 in the width direction Y.

Figure 11A:
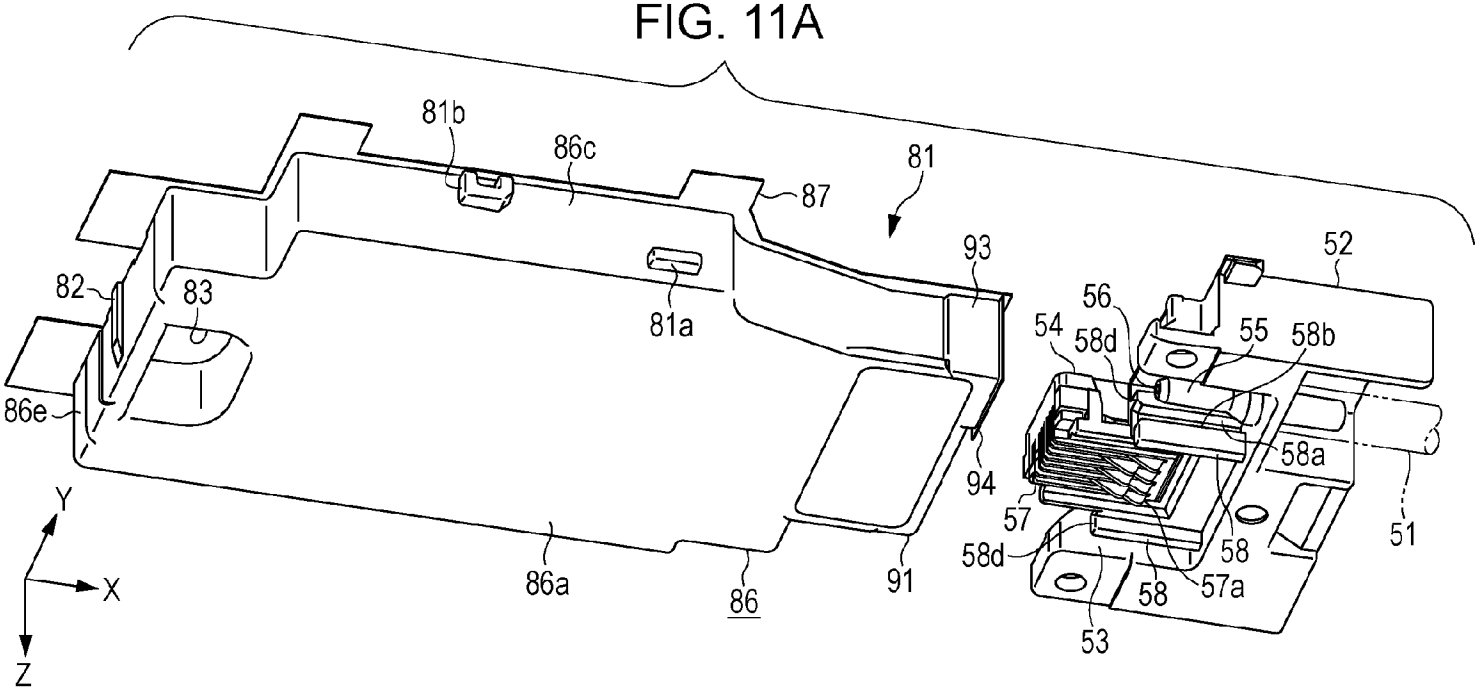
FIG. 11A is a perspective view illustrating a mounting unit and the waste liquid container and FIG. 11B is a front view illustrating the mounting unit.
Figure 11B:
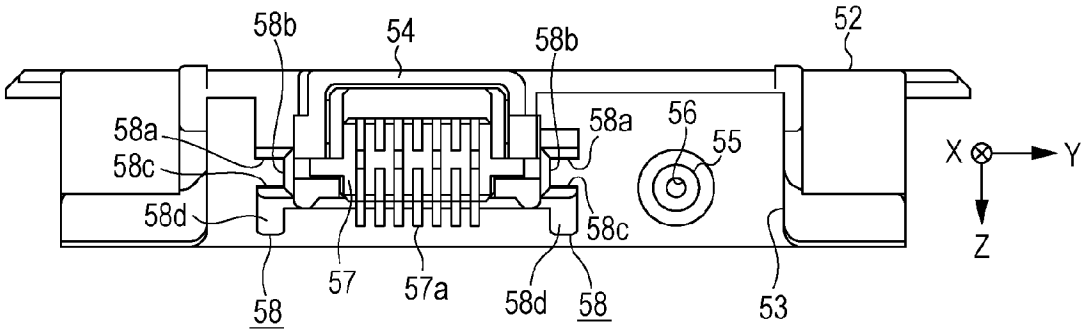

The positions of the guide protrusions 81*a* and 81*b* are different in the thickness direction Z (see FIGS. 11A and 11B). The guide protrusion 81*a* engages with the movement guide portion 49 from the bottom surface side and the guide protrusion 81*b* engages with the movement guide portion 49 from the top surface side. That is, the waste liquid container 81 is mounted on the mounting unit 52. Therefore, when the waste liquid container 81 is moved in the mounting direction X in the waste liquid container accommodation portion 48, the guide protrusions 81*a* and 81*b* engage with the movement guide portion 49, and thus the movement of the waste liquid container 81 in the ejection direction J is suppressed.

Figure 5:
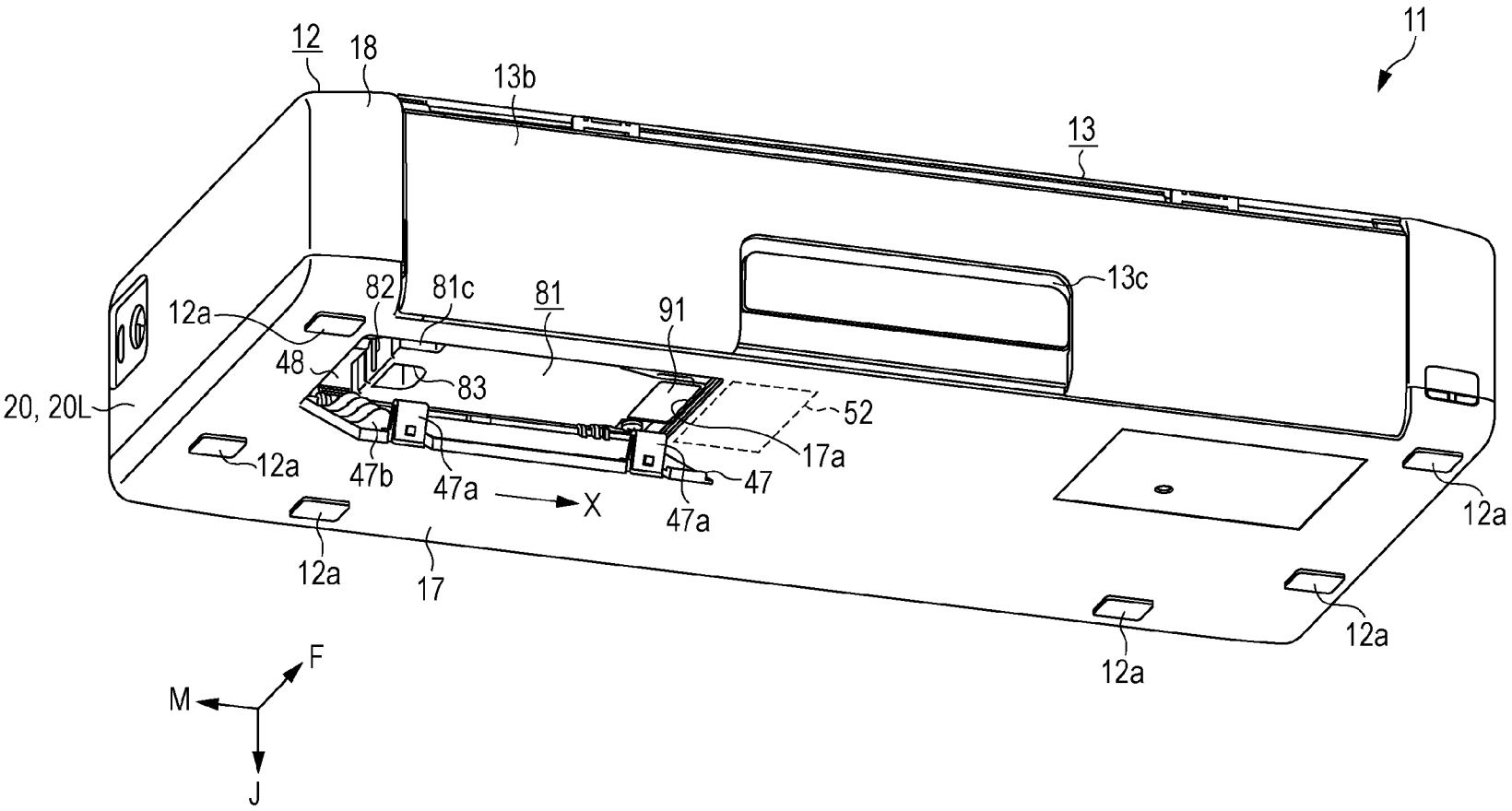
FIG. 5 is a perspective view illustrating a waste liquid container mounted on the liquid ejecting apparatus.

On the bottom wall 17 of the casing unit 12, as illustrated in FIG. 5, a mounting opening 17*a* through which the waste liquid container 81 is mounted on the mounting unit 52 of the liquid ejecting apparatus 11 is installed to communicate with the waste liquid container accommodation portion 48. An opening/closing lid 47 including a pair of locking claws 47*a* is joined to the mounting opening 17*a* so that the opening/closing lid 47 is pivoted to be opened or closed.

A locking protrusion 47*b* regulating the movement of the waste liquid container 81 mounted on the mounting unit 52 in the detaching direction protrudes in the opening/closing lid 47. A movement regulation portion 82 which can engage with the locking protrusion 47*b* protrudes in the rear end portion of the waste liquid container 81.

When the waste liquid container 81 is accommodated in the waste liquid container accommodation portion 48 from the mounting opening 17*a* and the waste liquid container 81 is subsequently moved toward the mounting unit 52 in the mounting direction X, the waste liquid container 81 is mounted on the mounting unit 52.

When the waste liquid container 81 is mounted on the mounting unit 52 in this way and the opening/closing lid 47 is subsequently pivoted so that the locking claws 47*a* engage with the mounting opening 17*a*, the locking protrusion 47*b* and the movement regulation portion 82 engage with each other so that the movement of the waste liquid container 81 in the detaching direction is regulated.

A finger-catch portion 83 caught by a finger or the like when the waste liquid container 81 is removed from the mounting unit 52 is recessed in the waste liquid container 81. When the waste liquid container 81 is removed from the mounting unit 52, the opening/closing lid 47 is opened to release the engagement of the locking protrusion 47*b* with the movement regulation portion 82 and the waste liquid container 81 is subsequently moved in the detaching direction, for example, by catching the finger-catch portion 83 with a finger. Then, the waste liquid container 81 is taken out from the waste liquid container accommodation portion 48 via the mounting opening 17*a*. The waste liquid container 81 is exchanged by mounting and detaching the waste liquid container 81, for example, when a capacity of the waste liquid in the waste liquid container 81 exceeds a regulation capacity.

Next, the configuration of the cap 42 will be described in detail.

Figure 6:
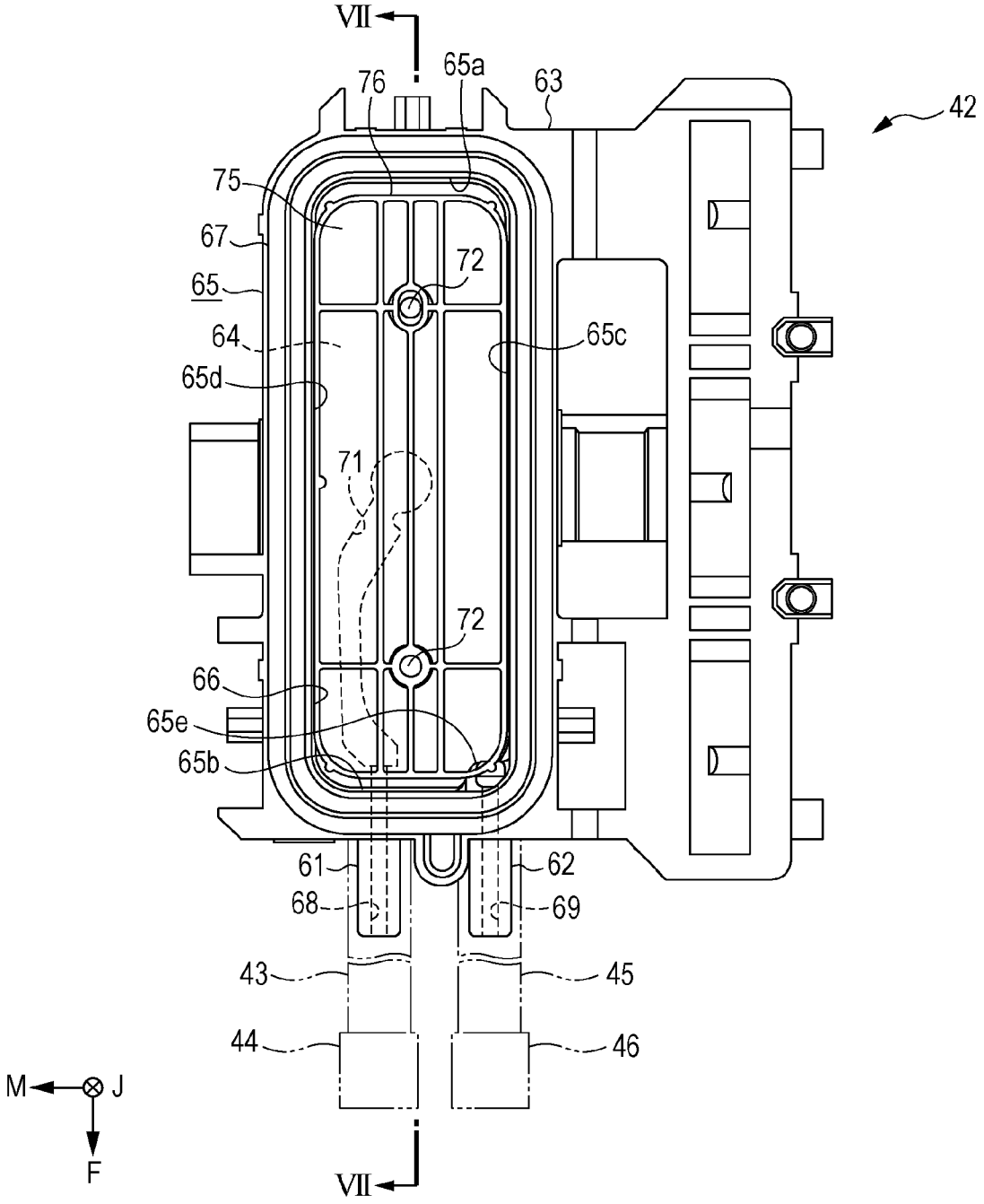
FIG. 6 is a plan view illustrating a cap.

As illustrated in FIG. 6, the cap 42 includes a cap member 63 in which a first connection protrusion 61 to which the suction tube 43 is connected protrudes and a second connection protrusion 62 to which the ventilation tube 45 is connected protrudes. In the embodiment, the first connection protrusion 61 and the second connection protrusion 62 are disposed to be arranged in the movement direction M, and the second connection protrusion 62 is disposed at a position closer to the home position than the first connection protrusion 61.

The cap member 63 includes a bottom portion 64 that extends in the transport direction F and the movement direction M and a side wall portion 65 that intersects the bottom portion 64 and extends in the ejection direction J. The bottom portion 64 of the cap member 63 has a substantially rectangular shape of which a longitudinal direction is the transport direction F and a transverse direction is the movement direction M in a plan view. When a part of the side wall portion 65 on the upstream side in the transport direction F is referred to as a first side wall 65*a*, a part thereof on the downstream side in the transport direction F is referred to as a second side wall 65*b*, a part thereof on a first end side (the right side in FIG. 7) in the movement direction M is referred to as a third side wall 65*c*, and a part thereof on a second end side (the left side in FIG. 7) in the movement direction M is referred to as a fourth side wall 65*d*, the side walls 65*c* and 65*d* are longer than the side walls 65*a* and 65*b*. The first connection protrusion 61 and the second connection protrusion 62 protrude in the transport direction F to project from the second side wall 65*b*.

Figure 7:
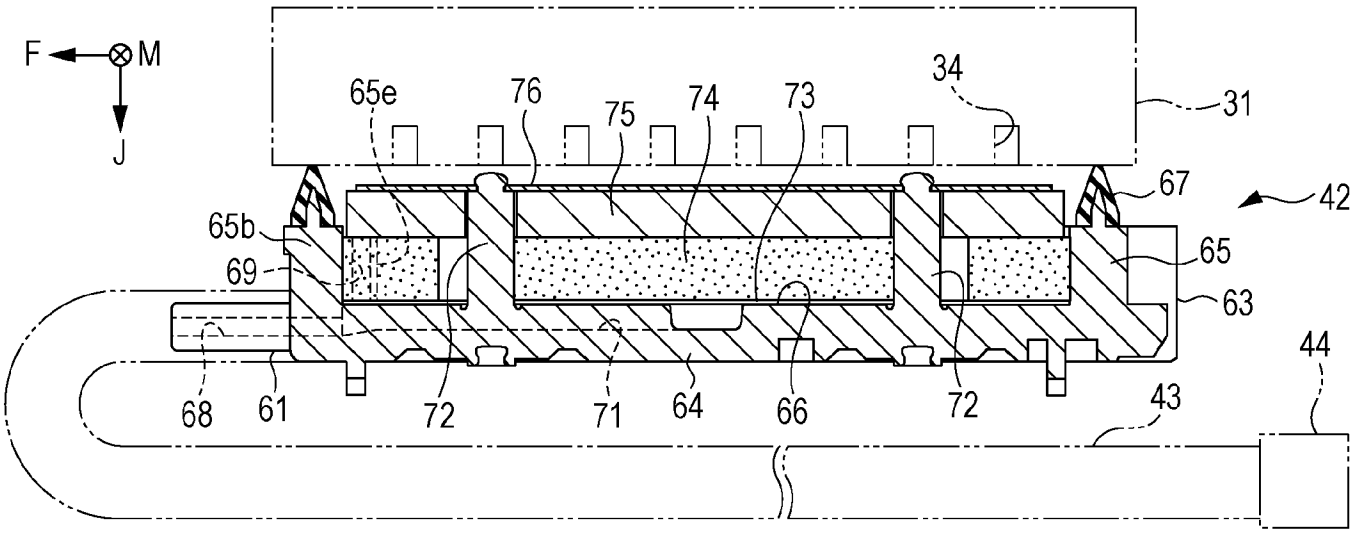
FIG. 7 is a sectional view taken along the line VII-VII of FIG. 6.

As illustrated in FIG. 7, the bottom portion 64 and the side wall portion 65 of the cap member 63 form a liquid storage portion 66 that can store a liquid. An elastically deformable lip portion 67 with a circular shape is joined to the front end of the side wall portion 65 of the cap member 63. When the cap 42 forms the enclosed space, the lip portion 67 is elastically deformed to come into close contact with the liquid ejecting unit 31, and thus the degree of close contact of the enclosed space increases.

The cap member 63 includes a discharge hole 68 formed to penetrate through the first connection protrusion 61 and the second side wall 6*b*. That is, the discharge hole 68 communicating with the suction tube 43 is formed in the cap member 63.

Figure 8:
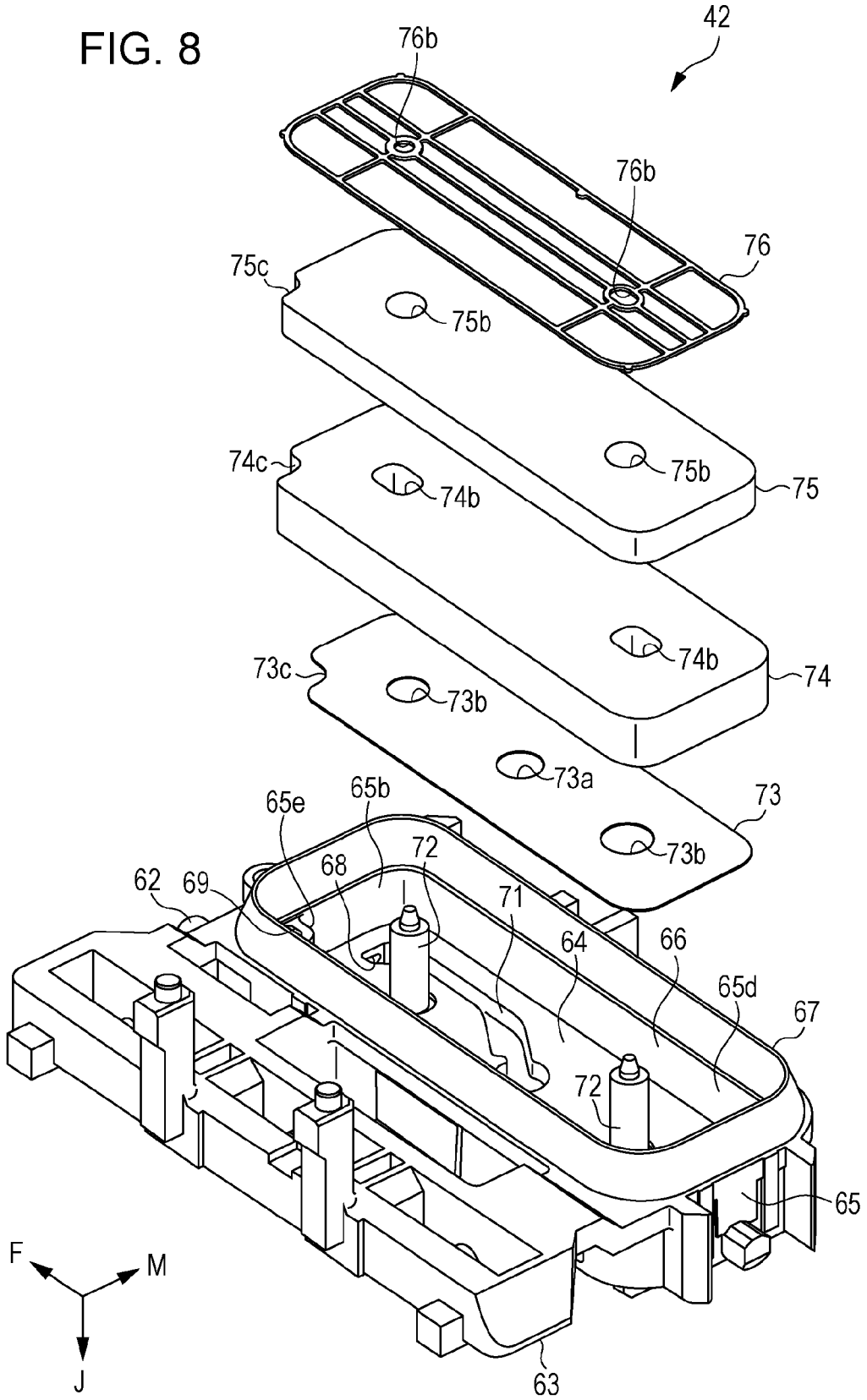
FIG. 8 is an exploded perspective view illustrating the cap.

As illustrated in FIG. 8, a ventilation passage formation portion 65*e* protrudes at a position corresponding to the second connection protrusion 62 of the second side wall 65*b* to project to the liquid storage portion 66. The cap member 63 includes a ventilation hole 69 formed to penetrate through the second connection protrusion 62, the second side wall 65*b*, and the ventilation passage formation portion 65*e*.

A groove 71 communicating with the discharge hole 68 and extending the longitudinal direction of the bottom portion 64 is recessed in the bottom portion 64 of the cap member 63. when an end portion of the groove 71 connected to the discharge hole 68 is assumed to be a downstream end, an upstream end of the groove 71 forms a substantially circular shape in a plan view and is located near the middle of the bottom portion 64 in the longitudinal direction (the transport direction F) and the transverse direction (the movement direction M). In the liquid storage portion 66, the ventilation hole 69 is opened at a position closer to the discharge hole 68 than the upstream end of the substantially circular shape of the groove 71 in a plan view and a position distant from the bottom portion 64.

In the bottom portion 64 of the cap member 63, a plurality of support shafts 72 (two support shafts in the embodiment) protrude in the longitudinal direction (the transport direction F). In the embodiment, the upstream end forming the circular shape of the groove 71 in a plan view is disposed between the two support shafts 72 in the longitudinal direction of the bottom portion 64. The groove 71 is wound to avoid the support shafts 72.

Figure 9:
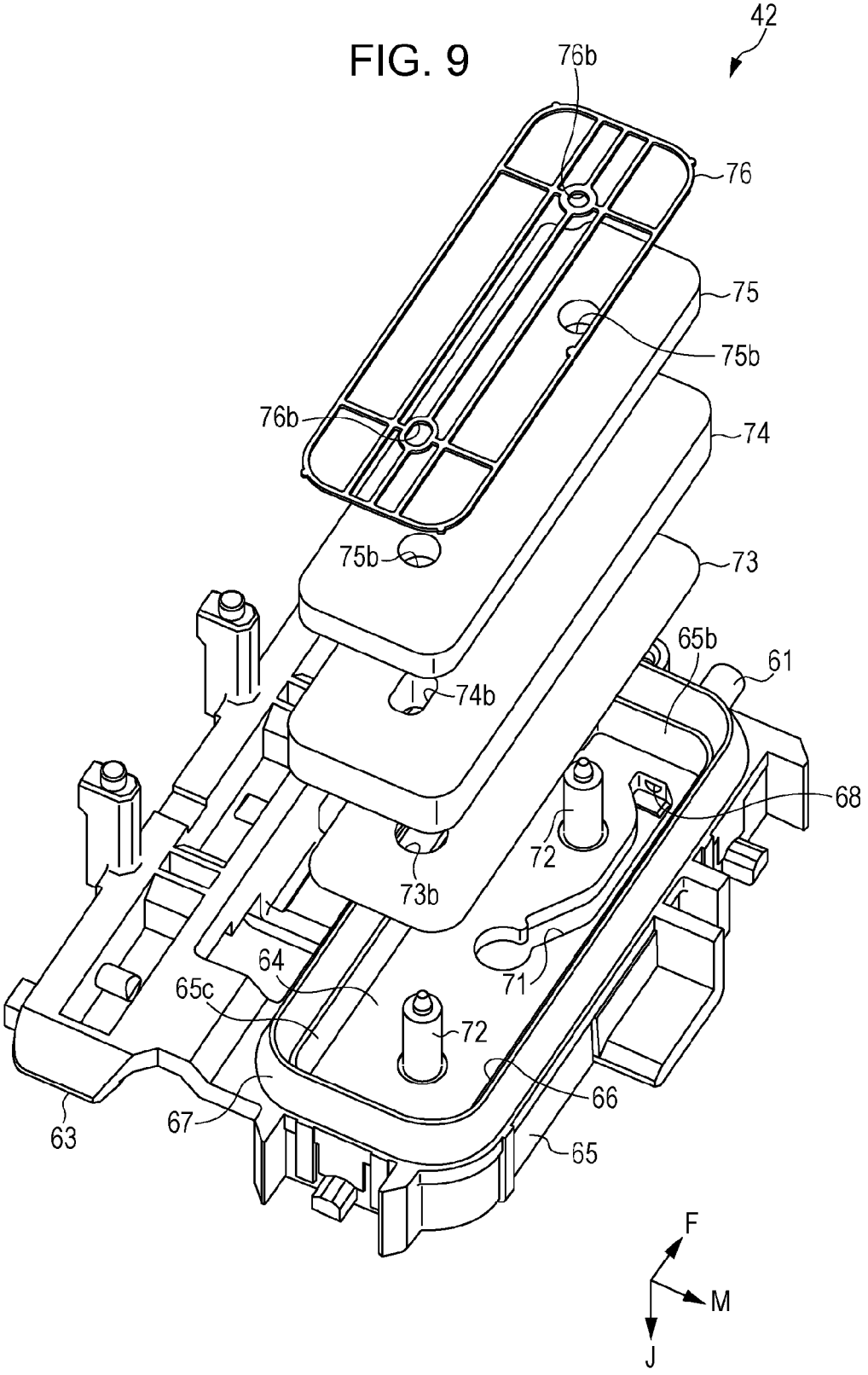
FIG. 9 is an exploded perspective view illustrating the cap.

As illustrated in FIGS. 8 and 9, a sheet-shaped member 73 with flexibility overlaps with the bottom portion 64 to cover the groove 71 in the liquid storage portion 66 of the cap 42.

In the sheet-shaped member 73, as illustrated in FIG. 8, a suction hole 73*a* is formed at a position at which the suction hole 73*a* overlaps with the upstream end of the groove 71. In the sheet-shaped member 73, through holes 73*b* are formed so that the support shafts 72 are inserted inside the liquid storage portion 66. In the sheet-shaped member 73, a notch 73*c* is formed at a position corresponding to the ventilation passage formation portion 65*e*.

In the liquid storage portion 66, liquid absorbers 74 and 75 capable of absorbing a liquid are accommodated to overlap in a layer shape with the sheet-shape member 73 interposed between the bottom portion 64 and the liquid absorbers 74 and 75. In the liquid absorbers 74 and 75, through holes 74*b* and 75*b* through which the support shaft 72 can be inserted in the liquid storage portion 66 are formed, respectively. In the liquid absorbers 74 and 75, notches 74*c* and 75*c* are formed at positions corresponding to the ventilation passage formation portion 65*e*.

In the embodiment, of the liquid absorbers 74 and 75, the liquid absorber 74 disposed on the side of the sheet-shaped member 73 is formed of a porous material and the liquid absorber 75 disposed on the side of the lip portion 67 is formed of a non-woven fabric. A plurality of holes formed inside the liquid absorber 74 formed of the porous material are continuous holes communicating with each other and preferably have high affinity to the liquid stored in the liquid storage portion 66.

In the embodiment, the liquid absorber 74 is formed of an elastic body with higher compressive elastic modulus than the liquid absorber 75 and the cap member 63. In the embodiment, the two kinds of liquid absorbers 74 and 75 formed of different materials are accommodated in the liquid storage portion 66, but liquid absorbers formed of any one kind of material may be accommodated. Liquid absorbers formed of materials different from the materials exemplified in the embodiment may be adopted.

The cap 42 preferably includes a pressure member 76 pressing the sheet-shaped member 73 via the liquid absorbers 74 and 75. The pressure member 76 can be formed of, for example, a metal in a netlike shape so that the outside surface of the liquid absorber 75 is broadly exposed while uniformly pressing the outside surface which is a surface on the side of the lip portion 67 of the liquid absorber 75.

The pressure member 76 includes an insertion hole 76*b* through which the front end of the support shaft 72 can be inserted. The pressure member 76 is fixed to the cap member 63 by crushing the front end of the support shaft 72 inserted into the insertion hole 76*b* and forming the front end in a hemisphere shape, as illustrated in FIG. 7.

The pressure member 76 is preferably maintained in a state in which the pressure member 76 presses the liquid absorbers 74 and 75 inside the liquid storage portion 66 to compress and deform the liquid absorbers 74 and 75. In the embodiment, the liquid absorber 74 compressed and deformed more easily (smoothly) than the liquid absorber 75 is compressed and deformed at a higher compression ratio than the liquid absorber 75 through the pressing of the pressure member 76.

Figure 10:
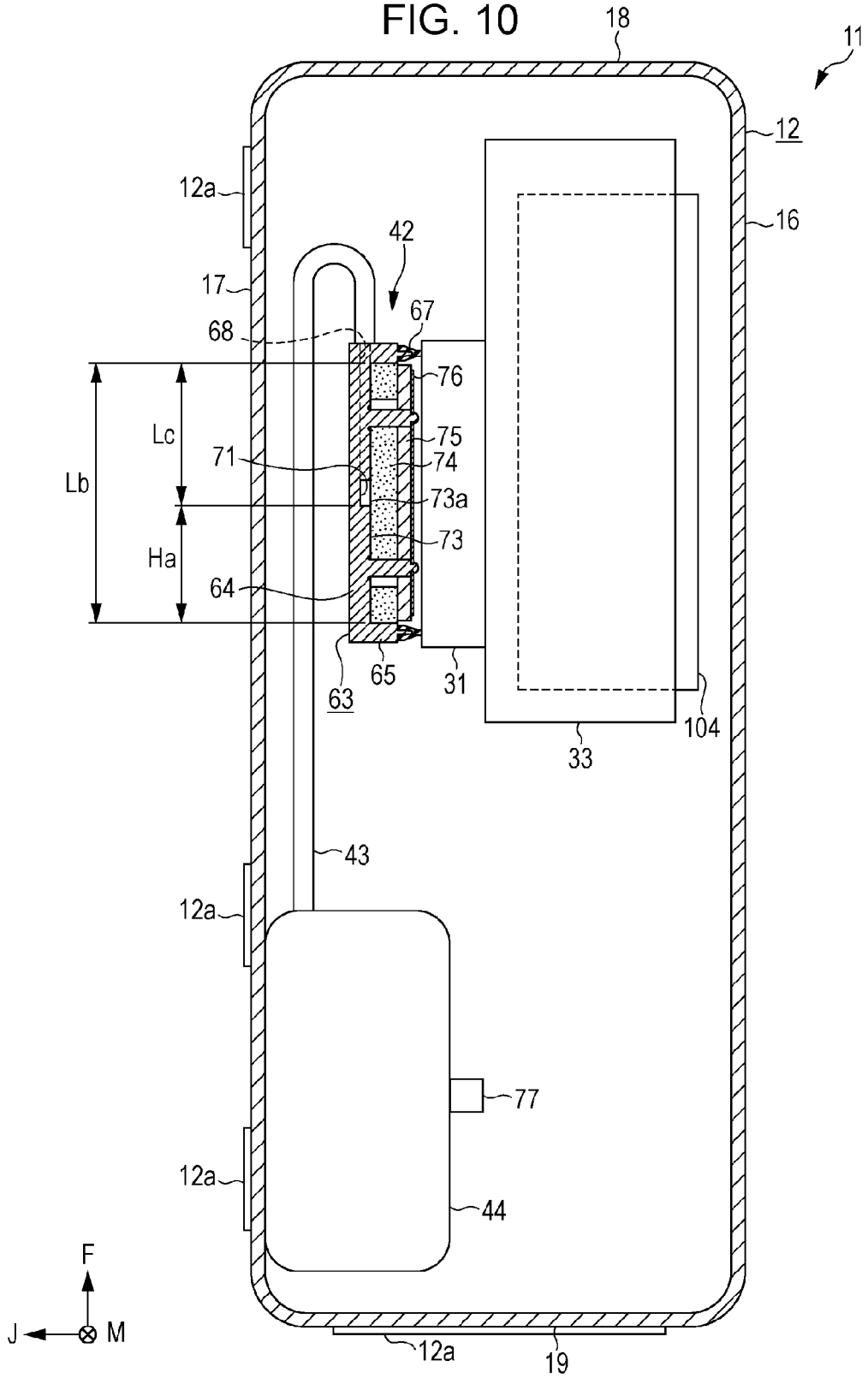
FIG. 10 is a sectional view schematically illustrating the vertical liquid ejecting apparatus.

As illustrated in FIG. 10, "$Ha+Lc \geq Lb$" is preferably satisfied when Ha is a liquid level height of the liquid which can be absorbed by capillary forces of the liquid absorbers 74 and 75, Lb is the length of the bottom portion 64 in the extension direction (the transport direction F which is the longitudinal direction of the bottom portion 64 in the embodiment) of the discharge hole 68, and Lc is the distance between the discharge hole 68 and the suction hole 73*a* in the extension direction. When the suction hole 73*a* is disposed to overlap with the upstream end of the groove 71, the distance Lc between the discharge hole 68 and the suction hole 73*a* is substantially identical to the length of the groove 71 in the extension direction.

For example, when the density of the liquid absorber 74, which is a foam body foamed by minutely dispersing a gas of a synthetic resin of urethane, polyvinyl alcohol, or the like, is in the range of 0.023 g/cc to 0.099 g/cc and the diameter of the hole (bubble) is in the range of about 200 micrometers to about 300 micrometers, the ink can be sucked and raised by about 15 mm to 25 mm by the capillary force of the continuous holes communicating with each other.

The liquid absorber 75 formed of a non-woven fabric can suck and raise the ink by approximately 20 mm by the capillary force of a gap between fibers when the density is in the range of 0.065 g/cc to 0.175 g/cc and the gap between fibers is about 70 micrometers. It can be said that the capability to maintain the liquid of the liquid absorber is higher as the value of the liquid level height Ha of the liquid which can be absorbed by the capillary force is larger.

In the embodiment, as the result obtained by adopting a urethane foam of which the density is about 0.023 g/cc and the diameter of the hole is about 300 micrometers as the liquid absorber 74, the liquid level height Ha of the liquid which can be absorbed by the capillary force by the liquid absorber 74 is about 15 mm. Further, as the result obtained by adopting a non-woven fabric formed of a synthetic fiber of which the density is about 0.175 g/cc and the gap between fibers is about 70 micrometers as the liquid absorber 75, the liquid level height Ha of the liquid which can be absorbed by the capillary force by the liquid absorber 75 is about 23 mm.

Next, an operation of the cap 42 will be described.

Since the discharge hole 68 is formed to penetrate through the side wall portion 65 in the cap member 63 included in the cap 42, the first connection protrusion 61 protrudes toward the lateral side (in the longitudinal direction of the cap member 63) used to connect the suction tube 43. Therefore, the cap 42 can be reduced in size (thinned) in the ejection direction J further than when the first connection protrusion projects from the bottom portion 64 in the ejection direction J.

By protruding the second connection protrusion 62 forming the ventilation hole 69 toward the second side wall 65*b* in the same direction as that of the first connection protrusion 61, the cap 42 can be reduced in size further than when the first connection protrusion 61 and the second connection protrusion 62 protrude in different directions.

In the liquid ejecting apparatus 11, it is preferable to reduce the area of the mounted surface necessary to vertically placing the liquid ejecting apparatus 11, as illustrated in FIG. 10. From this viewpoint, the area of the mounted surface necessary to vertically place the liquid ejecting apparatus 11 can be reduced by thinning the cap 42 (reducing the size of the cap 42 in the ejection direction J) and thinning the liquid ejecting apparatus 11.

In the embodiment, a passage communicating with the discharge hole 68 is formed by the sheet-shaped member 73 and the groove 71 recessed by the bottom portion 64. Therefore, when the suction mechanism 44 is driven, the inside of the liquid storage portion 66 is sucked via the suction hole 73*a* and the discharge hole 68 formed in the sheet-shaped member 73.

At this time, by covering the groove 71 with the thin sheet-shaped member 73 to form the passage, the cap 42 and the liquid ejecting apparatus 11 can be thinned further than when the groove 71 is covered with a plate or the like. When the sheet-shaped member 73 covering the groove 71 is thinned, the sheet-shaped member 73 is easily bent at the time of driving of the suction mechanism 44. Therefore, it is possible to remove the gap between the bottom portion 64 (the bottom surface forming the liquid storage portion 66) and the sheet-shaped member 73 and sucking the inside of the liquid storage portion 66 effectively.

In particular, in the embodiment, since the liquid absorber 74 with high compressive elastic modulus is disposed to be compressed and deformed at a position at which the liquid absorber 74 comes into contact with the sheet-shaped member 73, the sheet-shaped member 73 is tightly pressed against the bottom portion 64 by an elastic restoration force of the liquid absorber 74.

Here, when the suction cleaning is performed in the liquid ejecting apparatus 11, the liquid discharged from the nozzles 34 and thus the liquid droplets adhered to the liquid ejecting unit 31 remain in some cases. The liquid absorber 75 present on the side of the lip portion 67 has a function of removing the liquid droplets from the liquid ejecting unit 31 by touching and absorbing the liquid droplets adhered to the liquid ejecting unit 31.

Therefore, when the enclosed space is formed by the cap 42, it is necessary dispose the liquid absorber 75 at a position close to the liquid ejecting unit 31. When the liquid absorber 75 absorbs the liquid and expands, there is a concern of a liquid surface (meniscus) formed in the nozzles 34 being disturbed due to touch to the nozzles 34. Therefore, the liquid absorber 75 located on the side of the lip portion 67 is preferably deformed small by absorption of the liquid or the like.

From this viewpoint, when the liquid absorber 74 with a large elastic deformation ratio is disposed on the side of the sheet-shaped member 73 and the liquid absorber 75 with a small deformation ratio is disposed on the side of the lip portion 67, the contact of the liquid absorber 75 to the nozzles 34 can be suppressed while the sheet-shaped member 73 is pressed against the bottom portion 64 by the liquid absorber 74. Even when only the hardly deformable liquid absorber 75 is accommodated in the liquid storage portion 66, the liquid absorber 75 is pressed by the pressure member 76 so that the sheet-shaped member 73 can be pressed against the bottom portion 64.

The bottom portion 64 of the cap member 63 is formed in the substantially rectangular shape in a plan view and the discharge hole 68 is installed in the second side wall 65*b* which is the short side. Therefore, when the liquid storage portion 66 is sucked directly from the discharge hole 68, it is difficult that the suction force to affect the side of the first side wall 65*a*. From this point, in the cap member 63, the discharge hole 68 is installed in the side wall portion 65, but the discharge hole 68 communicates with the suction hole 73*a* disposed near the middle of the bottom portion 64 via the groove 71. Therefore, when the suction mechanism 44 is driven, the liquid absorbed by the liquid absorbers 74 and 75 is sucked from the vicinity of the middle of the bottom portion 64.

Incidentally, when the liquid ejecting apparatus 11 is vertically placed, as illustrated in FIG. 10, the second side wall 65*b*, the discharge hole 68, and the ventilation hole 69 in the cap 42 are disposed vertically upward the liquid storage portion 66, and the first connection protrusion 61 and the second connection protrusion 62 are at the posture in the vertical direction at which the first connection protrusion 61 and the second connection protrusion 62 project vertically upward from the second side wall 65*b*. When the liquid maintaining force of the liquid absorbers 74 and 75 is small and the cap 42 takes the posture in the vertical direction, it is difficult to suck the liquid located vertically downward more than the suction hole 73*a*.

When the condition of "Ha+Lc≥Lb" is satisfied, that is, "Ha≥Lb−Lc" is satisfied, the liquid present on the side of the first side wall 65*a* can be sucked and raised up to the suction hole 73*a* by the capillary forces of the liquid absorbers 74 and 75 despite the fact that the liquid ejecting apparatus 11 is placed vertically. That is, the liquid vertically downward than the suction hole 73*a* can be sucked and raised by the capillary forces of the liquid absorbers 74 and 75 and the liquid can be discharged from the liquid storage portion 66 of the cap 42 oriented in the vertical direction through the driving of the suction mechanism 44.

Even when the mounted surface of the liquid ejecting apparatus 11 is inclined, there is a concern of the posture of the cap 42 being inclined and the discharge hole 68 being located vertically more upward than the suction hole 73*a*. Therefore, even when the liquid ejecting apparatus 11 is not placed vertically, the liquid can be discharged from the inclined cap 42 as long as the condition of "Ha+Lc≥Lb" is satisfied, and thus it is preferable to satisfy this condition.

In the embodiment, the value of Ha of the liquid absorber 74 is smaller than that of the liquid absorber 75 and Ha is set to be 15 mm in that the liquid absorber 74 is disposed at a position which the liquid absorber 74 comes into contact with the sheet-shaped member 73. When the suction hole 73*a* is disposed in the middle in the longitudinal direction of the bottom portion 64, Lc is the value which is substantially the same as ½ Lb. Therefore, even when the length Lb in the longitudinal direction of the bottom portion 64 is lengthened up to about 30 mm, the liquid of the liquid storage portion 66 placed in the vertical direction can be sucked by satisfying the condition of "Ha+Lc≥Lb." When the position of the suction hole 73*a* in the longitudinal direction of the bottom portion 64 approaches the first side wall 65*a* more than the middle, condition of "Ha+Lc≥Lb" can be satisfied despite the fact that the length Lb in the longitudinal direction of the bottom portion 64 is longer than 30 mm.

For example, at the time of power-off, the capping is performed in a state in which the liquid retains inside the liquid storage portion 66 in order to prevent the nozzles 34 from drying. Therefore, when the ventilation hole 69 is located on the vertical downside inside the liquid storage portion 66, there is a concern of the liquid flowing in the ventilation hole 69 to be clogged and the liquid being leaking. From this viewpoint, by opening the ventilation hole 69 to the side of the second side wall 65*b* and the position distant from the bottom portion 64, the liquid can be prevented from flowing in the ventilation hole 69 at either posture of the vertical placing or the horizontal placing.

Here, when the capping is released in the state in which the liquid ejecting apparatus 11 is vertically placed, there is a concern of the liquid being leaking in the liquid storage portion 66 and the inside of the casing unit 12 being staining. In order to reduce this concern, it is preferable to restrict releasing of the capping when the liquid ejecting apparatus 11 includes a detection unit 77 that detects the posture of the casing unit 12 and the detection unit 77 detects that the posture of the casing unit 12 is vertically placed. Further, it is also preferable to restrict a predetermined operation, such as a liquid ejecting operation (printing, flushing, or the like), a maintenance operation for the nozzles 34, or exchange of the liquid container 104, by which the inside of the casing unit 12 stains due to leakage of the liquid.

Further, it is preferable to stop feeding the medium S when the liquid ejecting apparatus 11 includes a medium sensor (not illustrated) detecting that the medium S is inserted into the insertion opening 14, the medium sensor detects the medium S, and the detection unit 77 detects that the posture of the casing unit 12 is the vertical placing. Thus, it is possible to reduce occurrence of transport failure of the medium S. When the medium sensor detects the medium S and the detection unit 77 detects that the posture of the casing unit 12 is the vertical placing, the medium S may be prevented from being fed by increasing a motor toque of the transport motor 25 which is the driving source.

When an optical detection sensor (for example, the optical sensor "RPI-1035" manufactured by ROHM) is adopted, the detection unit 77 may be disposed at any position inside the casing unit 12. Of the positions inside the casing unit 12, the detection unit 77 is preferably disposed at a position on a member to which a vibration source generating proper vibration is joined.

For example, the detection unit 77 according to the embodiment is fixed to the suction mechanism 44 inside the casing unit 12. At the time of the driving of the suction mechanism 44, proper vibration is transferred to the detection unit 77. Therefore, when the detection unit 77 that uses a spindle rolling by the force of gravity is used, a detection failure caused due to adhering after long-term storage can be suppressed according to, for example, a method of driving the suction mechanism 44 before detection and performing the detection.

By adopting a method of not performing detection during the driving of the suction mechanism 44 and performing the detection at a timing at which the driving of the suction mechanism 44 is stopped, it is possible to suppress erroneous detection due to vibration of the vibration source at the time of normal detection. Here, when a vibration frequency of the vibration source is set to be equal to or less than an audio frequency is set to be equal to or less than 20 Hz, noise caused due to the vibration can be reduced. Thus, it is preferable to set the vibration frequency of the vibration source to be equal to or less than the audio frequency.

When the detection unit 77 detects inclination in the longitudinal direction of the cap member 63 and an inclination angle in the longitudinal direction of the cap member 63 with respect to the horizon exceeds a predetermined threshold value (for example, 20 times), it is preferable to restrict the above-described predetermined operation. A threshold value of the inclination angle at which the operation is restricted may be arbitrarily changed according to, for example, the height (the length in the ejection direction J) of the side wall portion 65 and the liquid maintaining forces of the liquid absorbers 74 and 75.

Further, even when the liquid ejecting operation (the printing, the flushing, or the like) is performed without performing the capping and the inclination angle exceeds a predetermined threshold, it is preferable to stop the liquid ejecting operation and the feeding operation for the medium S or increase the motor torque of the transport motor 25. In particular, when the liquid ejecting apparatus 11 includes a storage cell and an operation is possible with the power of the storage cell, there is a concern that a manipulation button or the like is pushed erroneously without intention in the middle of carrying of the liquid ejecting apparatus 11, and thus, for example, the capping is released or the liquid is ejected. Therefore, when the liquid ejecting apparatus 11 includes a storage cell, in particular, it is preferable to restrict an operation due to the detection of the inclined angle.

Next, the configuration of the mounting unit 52 will be described in detail.

As illustrated in FIGS. 11A and 11B, a connection concave portion 53 opened in the detaching direction (the opposite direction to the mounting direction X) and the thickness direction Z is recessed in the mounting unit 52. In the connection concave portion 53, a projection 54 projecting in the detaching direction and a cylindrical discharge portion 55 discharging the waste liquid protrude to be arranged in the width direction Y. A connection hole 56 communicating with the discharge tube 51 is formed in the discharge portion 55.

A substrate connection portion 57 electrically connected to the control unit 103 (see FIG. 2) is provided to the projection 54. The substrate connection portion 57 includes a movable contact portion 57*a* which can be elastically displaced by a contact pressure. The movable contact portion 57*a* projects from the projection 54 in the thickness direction Z when an external force is not received, and the movable contact portion 57*a* is elastically displaced in a direction close to the projection 54 when an external force is received.

The projection 54 includes a pair of engaging projection 58 formed to project in the width direction Y. The pair of engaging projections 58 is disposed at positions at which the substrate connection portion 57 is interposed therebetween in the width direction Y. The substrate connection portion 57 projects more than the engaging projections 58 in the detaching direction, and the engaging projections 58 protrude more than the substrate connection portion 57 in the thickness direction Z.

In the engaging projection 58, as illustrated in FIG. 11B, an concave portion is recessed which has engaging surfaces 58*a* and 58*c* extending in the mounting direction X and the width direction Y and facing each other, an engaging surface 58*b* extending in the mounting direction X and the thickness direction Z and intersecting the engaging surfaces 58*a* and 58*c*. The engaging surface 58*a* faces in the thickness direction Z and the engaging surface 58*c* faces in the opposite direction to the thickness direction Z. A front end surface 58*d* of the engaging projection 58 intersecting the engaging surfaces 58*a*, 58*b*, and 58*c* extends in the width direction Y and the thickness direction Z. The center of the connection hole 56 is located on a plane (which is an imaginary surface indicated by a one-dot chain line in FIG. 11B) including the engaging surface 58*c*.

Subsequently, the configuration of the waste liquid container 81 will be described in detail.

Figure 12:
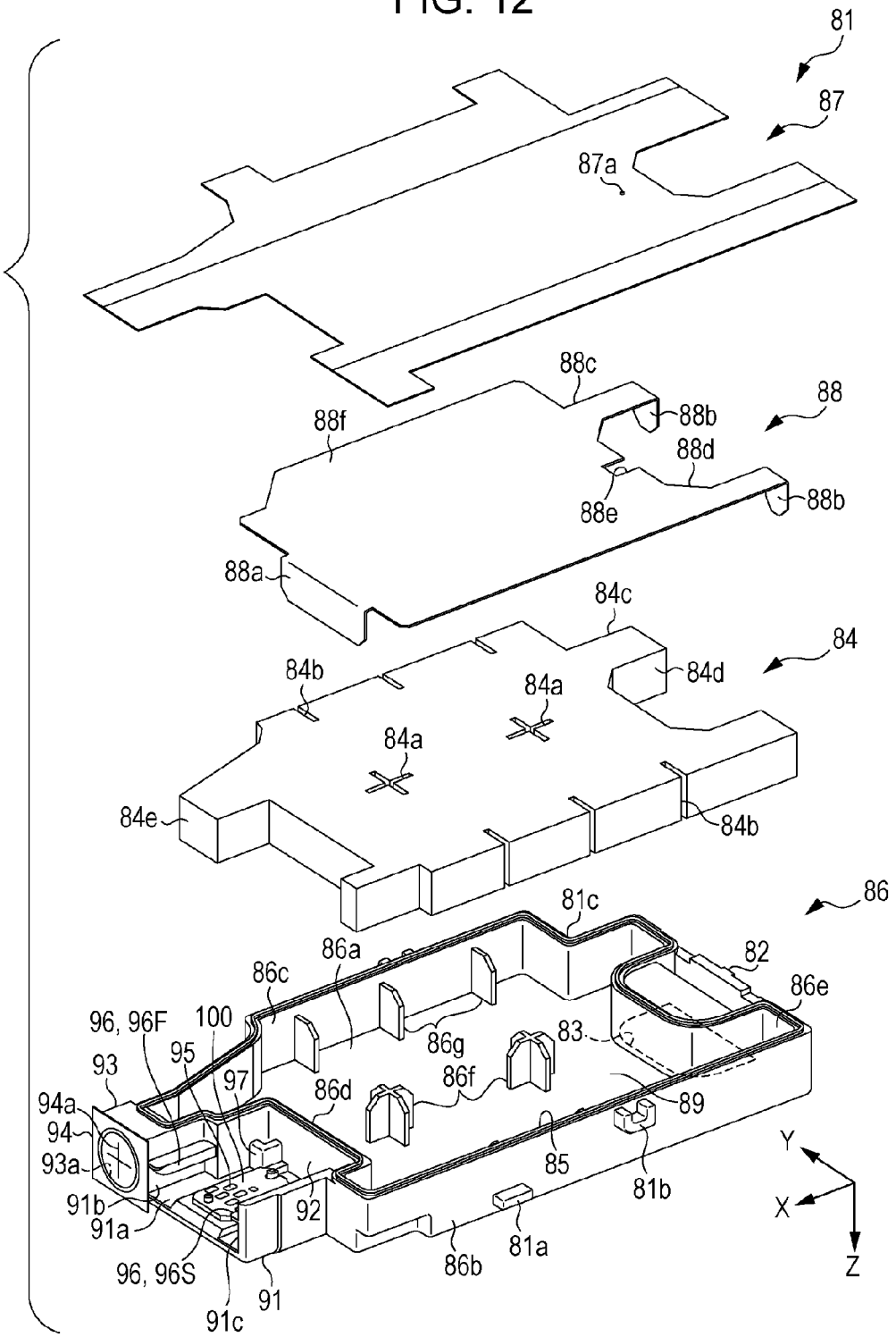
FIG. 12 is an exploded perspective view illustrating the waste liquid container according to the embodiment.
Figure 13:
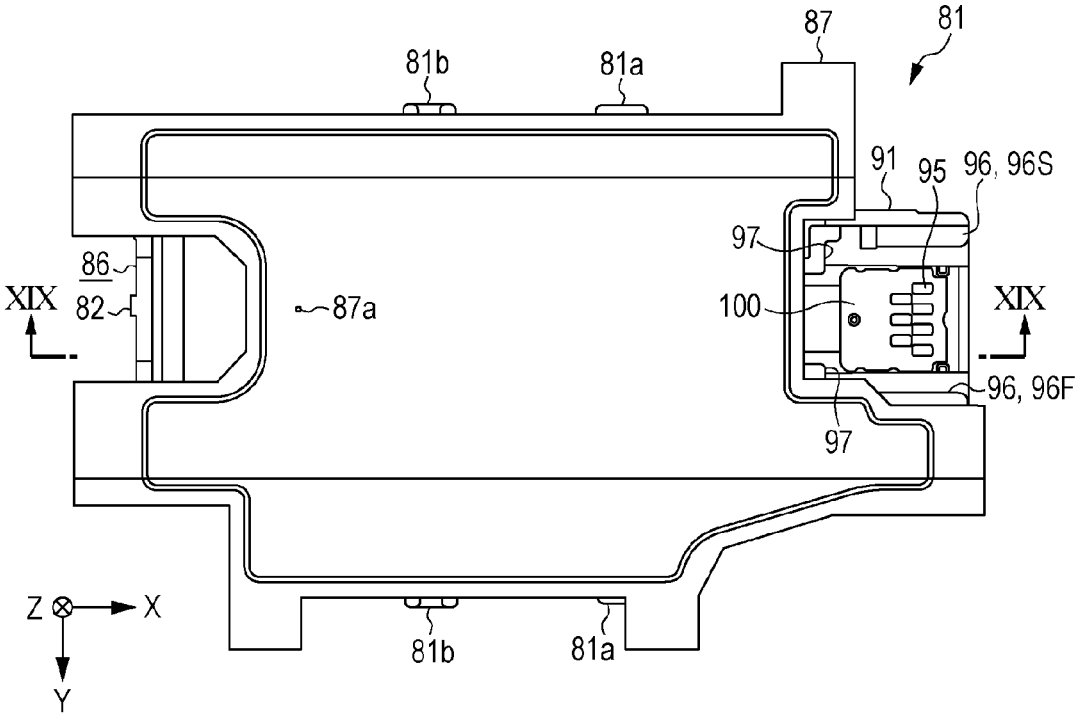
FIG. 13 is a front view illustrating the waste liquid container according to the embodiment.
Figure 14:
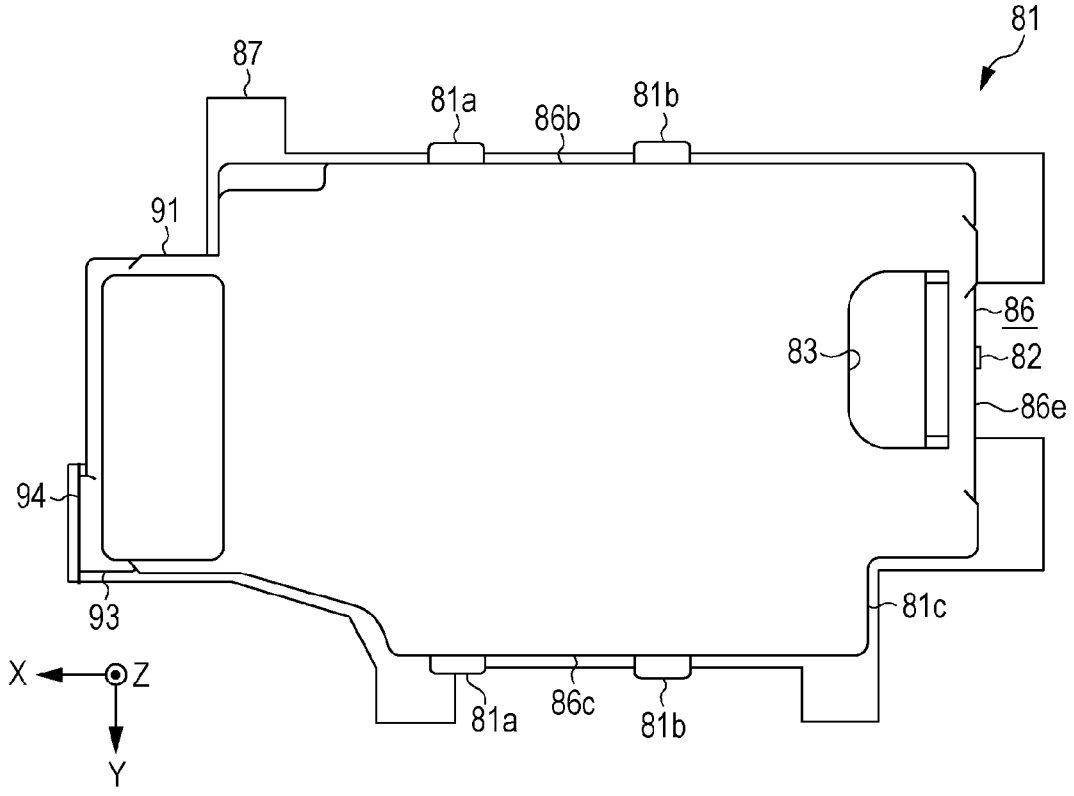
FIG. 14 is a rear view illustrating the waste liquid container illustrated in FIG. 13.
Figure 15:
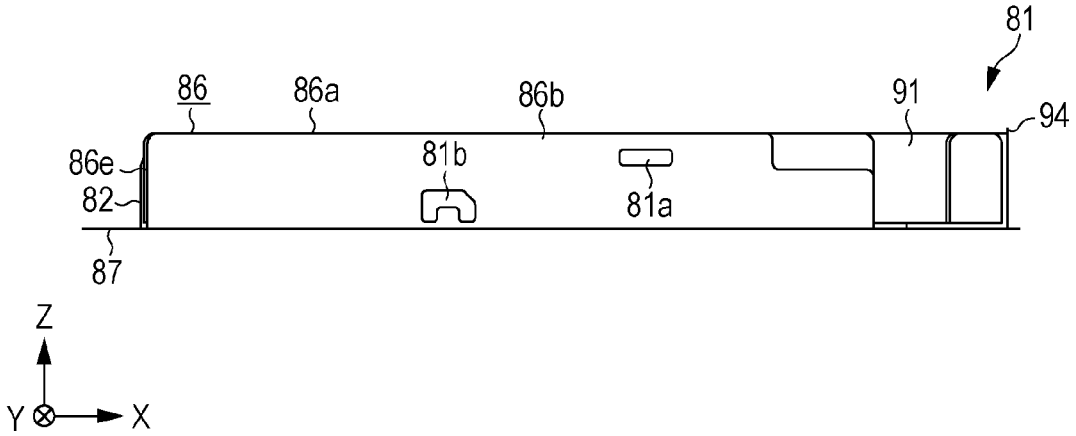
FIG. 15 is a plan view illustrating the waste liquid container illustrated in FIG. 13.
Figure 16:
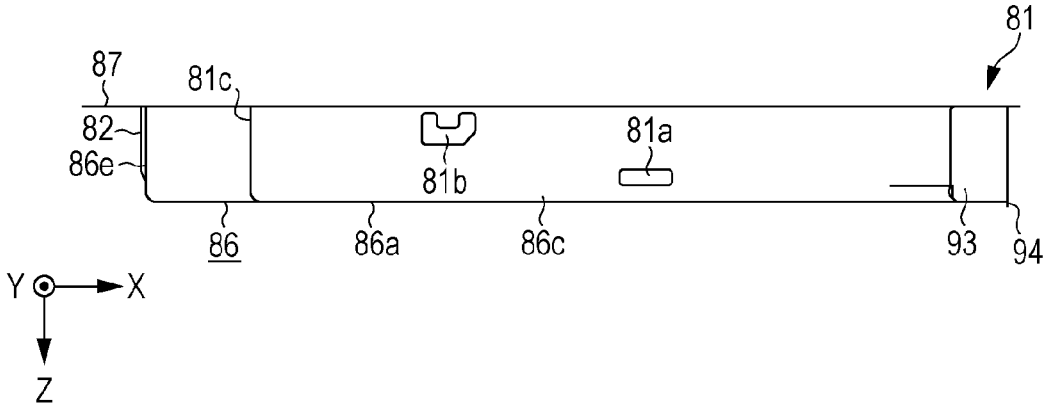
FIG. 16 is a bottom view illustrating the waste liquid container illustrated in FIG. 13.

FIG. 12 is an exploded perspective view illustrating the waste liquid container 81. FIGS. 13 to 18 are diagrams illustrating the outer appearance of the waste liquid container 81.

In the embodiment, when L1 is the length of the waste liquid container 81 in the mounting direction X, L2 is the length of the waste liquid container 81 in the width direction Y, and L3 is the length (thickness) of the waste liquid container 81 in the thickness direction Z, "L1>L2>L3" is satisfied. That is, the waste liquid container 81 has an externally thin shape of which a longitudinal direction is the mounting direction X and of which a length in the thickness direction Z is short. Therefore, the waste liquid container 81 is properly mounted on the thin liquid ejecting apparatus 11.

As illustrated in FIG. 12, the waste liquid container 81 includes an absorber 84 which can absorb the waste liquid, an accommodation member 86 which has a box-like shape with a bottom and in which an accommodation concave portion 85 capable of accommodating the absorber 84, a film member 87 which covers an opening of the accommodation concave portion 85, and a reinforcement member 88 which is disposed between the absorber 84 and the sheet-shaped member 73. The reinforcement member 88 is a member that has higher rigidity than the film member 87.

The accommodation member 86 includes a bottom wall portion 86*a* which forms an inner bottom surface of the accommodation concave portion 85, a pair of side wall portions 86*b* and 86*c* which extends in the mounting direction X and the thickness direction Z and intersects the bottom wall portion 86*a*, and a front wall portion 86*d* and a rear wall portion 86*e* which intersect the wall portions 86*a*, 86*b*, and 86*c*. The accommodation concave portion 85 is formed by the wall portions 86*a*, 86*b*, 86*c*, 86*d*, and 86*e* and a containing portion 89 capable of containing the waste liquid is surrounded to be formed by the accommodation concave portion 85 and the film member 87. An atmosphere communication hole 87*a* communicating the containing portion 89 with the atmosphere is formed in the film member 87. The number of atmosphere communication holes 87*a* or the position of the atmosphere communication hole 87*a* can be changed arbitrarily.

The accommodation member 86 includes a convex portion 91 projecting from the containing portion 89 in the mounting direction X in one end (front end) thereof in the mounting direction X. Both ends of the convex portion 91 in the width direction Y are disposed more inside in the width direction Y than the side wall portions 86*b* and 86*c* formed at both ends of the containing portion 89 in the width direction Y. A notch 81*c* formed by notching one corner in the width direction Y is formed at the other end (rear end) of the accommodation member 86 in the mounting direction X.

As illustrated in FIG. 5, when the waste liquid container 81 is mounted on the mounting unit 52 and the opening/closing lid 47 is closed, one pair of locking claws 47*a* formed in the opening/closing lid 47 is received in a gap formed by forming the convex portion 91 and the notch 81*c* in the accommodation member 86. Further, to correspond to the reception of the locking claws 47*a*, the corner which is a connection portion between the side wall portion 86*c* and the convex portion 91 is notched at the front end of the accommodation member 86.

As illustrated in FIGS. 12 to 18, the guide protrusions 81*a* and 81*b* protrude to the side wall portions 86*b* and 86*c* of the accommodation member 86 to project toward the outside in the width direction Y. The guide protrusion 81*b* is disposed at a position closer to the film member 87 than the guide protrusion 81*a* in the thickness direction Z. The guide protrusion 81*a* is disposed at a position closer to the convex portion 91 than the guide protrusion 81*b* in the mounting direction X.

In the convex portion 91, as illustrated in FIG. 12, a connection concave portion 92 opened in the opposite direction to the thickness direction Z and the mounting direction X and a waste liquid introduction portion 93 extending in the mounting direction X are formed to be arranged in the width direction Y. The end of the waste liquid introduction portion 93 in the detaching direction communicates with the containing portion 89 and the end of the waste liquid introduction portion 93 in the mounting direction X is opened to the front end surface of the convex portion 91. The waste liquid introduction portion 93 includes an insertion opening 93*a* opened in the mounting direction X.

The insertion opening 93*a* of the waste liquid introduction portion 93 is covered with a film 94. A cross-shaped incision 94*a* is formed in the film 94. A part of the wall surface of the waste liquid introduction portion 93 is formed by the film member 87.

The convex portion 91 includes a first wall portion 91*a* which is formed to extend from the bottom wall portion 86*a*, a second wall portion 91*b* which intersects the first wall portion 91*a* and forms a part of the wall surface of the waste liquid introduction portion 93, a third wall portion 91*c* which intersects the first wall portion 91*a* and is disposed at a position confronting the second wall portion 91*b*, and a fourth wall portion 91*d* (see FIG. 20) which forms a part of the wall surface of the waste liquid introduction portion 93. The wall portions 91*a*, 91*b*, and 91*c* and the front wall portion 86*d* form the connection concave portion 92.

In the first wall portion 91*a*, a circuit substrate 100 including connection terminals 95 are joined to be located inside the connection concave portion 92. The circuit substrate 100 includes a memory element that stores information such as the capacity of waste liquid contained in the containing portion 89.

Inside the connection concave portion 92, a pair of guide portions 96 (96F and 96S) are formed so that the connection terminals 95 are interposed therebetween in the width direction Y. Of the pair of guide portions 96F and 96S, one guide portion 96F protrudes to the second wall portion 91*b* to project toward the inside of the connection concave portion 92 and the other guide portion 96S protrudes to the third wall portion 91*c* to project toward the inside of the connection concave portion 92. That is, at one end (front end) of the accommodation member 86, the guide portion 96F is disposed between the connection terminals 95 and the waste liquid introduction portion 93 in the width direction Y.

Figure 17:
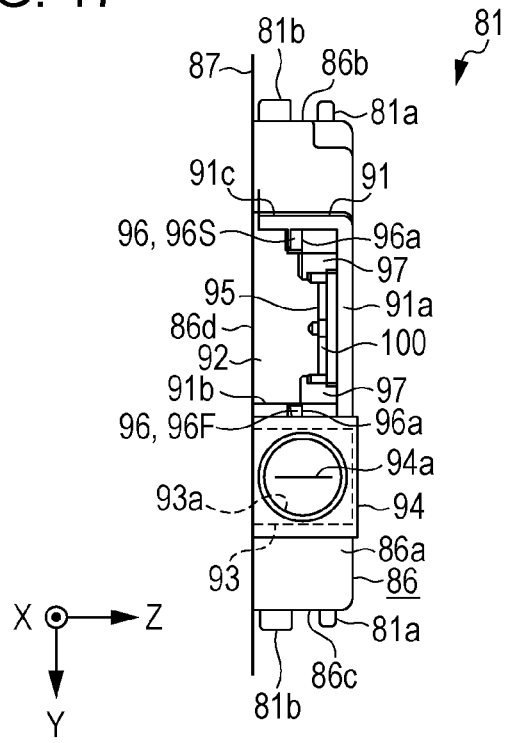
FIG. 17 is a right side view illustrating the waste liquid container illustrated in FIG. 13.
Figure 18:
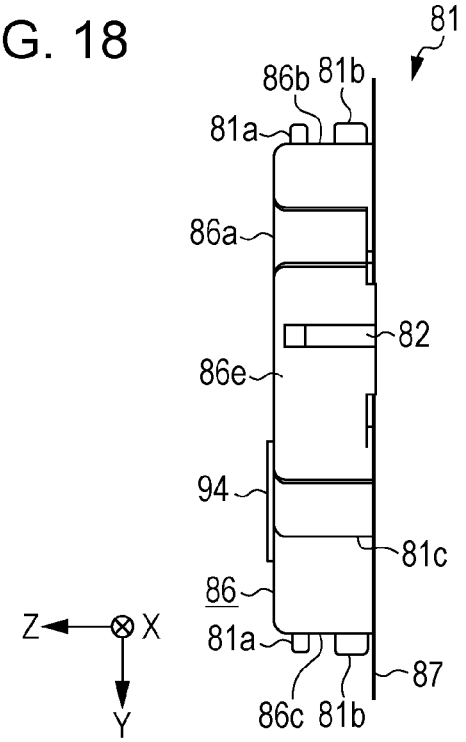
FIG. 18 is a left side view illustrating the waste liquid container illustrated in FIG. 13.

As illustrated in FIG. 17, one pair of guide portions 96 (96F and 96S) each includes a guide surface 96*a* extending in the mounting direction X and the width direction Y. The guide surface 96*a* is oriented in the opposite direction (the thickness direction Z) to the connection terminals 95. An opening center (the center of the insertion opening 93*a* and the incision 9*a*) of the waste liquid introduction portion 93 is located on a plane (which is an imaginary surface indicated by a one-dot chain line in FIG. 17) including the two guide surfaces 96*a*.

A pair of regulation protrusions 97 projecting in the mounting direction X more than the front wall portion 86*d* is formed on the inner rear side of the connection concave portion 92 more than the connection terminals 95. As illustrated in FIG. 12, the regulation protrusions 97 are located between the guide portions 96 and the front wall portion 86*d* in the mounting direction X.

As illustrated in FIG. 12, the accommodation member 86 includes a plurality of protrusions 86*f* and 86*g* projecting inside the containing portion 89. In the embodiment, the protrusions 86*f* formed in a cross shape in a front view protrude from the bottom wall portion 86*a* and the protrusions 86*g* formed in a plate shape protrude from the side wall portions 86*b* and 86*c*. The lengths of the protrusions 86*f* and 86*g* in the thickness direction Z are shorter than those of the side wall portions 86*b* and 86*c* and the ends of the protrusions 86*f* and 86*g* in the thickness direction Z come into contact with the bottom wall portion 86*a*.

The absorber 84 has a plate shape of which a length in the thickness direction Z is slightly shorter than the protrusions 86*f* and 86*g* and has insertion portions 84*a* and 84*b* into which the protrusions 86*f* and 86*g* are inserted. When the absorber 84 is accommodated in the accommodation concave portion 85, the protrusions 86*f* and 86*g* are inserted into the insertion portions 84*a* and 84*b* so that movement in the mounting direction X and the width direction Y inside the containing portion 89 is suppressed.

A notch 84*c* corresponding to the notch 81*c* and a notch concave portion 8*d* corresponding to the finger-catch portion 83 are formed at the rear end of the absorber 84. An extension portion 84*e* accommodated at the rear end of the waste liquid introduction portion 93 is formed at the front end of the absorber 84. The extension portion 84*e* is not disposed near the insertion opening 93*a* of the waste liquid introduction portion 93 and a gap is formed between the insertion opening 93*a* and the extension portion 84*e* inside the waste liquid introduction portion 93.

The reinforcement member 88 includes a body portion 88*f* which covers the surface of the absorber 84 on the side of the film member 87, a first locking portion 88*a* which is locked in the front end of the absorber 84, and a pair of second locking portions 88*b* which is locked in the rear end of the absorber 84. When the reinforcement member 88 is accommodated in the containing portion 89, the first locking portion 88*a* engages with the front end of the absorber 84 and the second locking portions 88*b* engage with the rear end of the absorber 84 so that movement in the mounting direction X in the containing portion 89 is suppressed.

The reinforcement member 88 is preferably formed of a sheet-shaped resin material, but may be formed of, for example, a metal material in a plate shape or a netlike shape. When the reinforcement member 88 is formed in the sheet shape or the plate shape formed of the resin material or the metal material, the first locking portion 88*a* and the second locking portions 88*b* can be formed to be integrated with the body portion 88*f* by bending the front end and the rear end of the reinforcement member 88 in the thickness direction Z.

In the rear end of the reinforcement member 88, a notch 88C corresponding to the notch 81*c* and a first notch concave portion 88*d* corresponding to the finger-catch portion 83 are formed. In the rear end of the reinforcement member 88, a second notch concave portion 88*e* is formed at a position corresponding to the inner bottom of the first notch concave portion 88*d*. The second notch concave portion 88*e* is located between the absorber 84 and the atmosphere communication hole 87*a* of the film member 87 and communicates with the atmosphere communication hole 87*a* and the containing portion 89. Therefore, for example, the reinforcement member 88 is formed in a netlike shape, the second notch concave portion 88*e* may not be formed in the reinforcement member 88.

Figure 19:
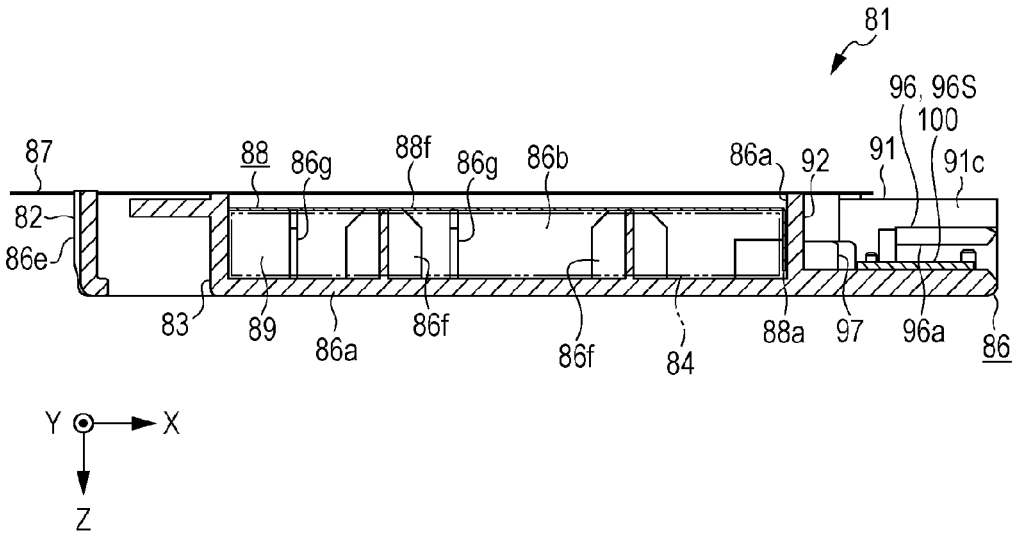
FIG. 19 is a sectional view taken along the line XIX-XIX of FIG. 13.

As illustrated in FIG. 19, when the reinforcement member 88 is accommodated in the containing portion 89, the body portion 88*f* is disposed between the film member 87 and the protrusions 86*f* and 86*g* formed in the accommodation member 86. Therefore, when the waste liquid container 81 is disposed so that the thickness direction Z is the gravity direction, the reinforcement member 88 is supported by the protrusions 86*f* and 86*g*.

When the reinforcement member 88 is formed of a material with high rigidity and the lengths of the first locking portion 88*a* and the second locking portions 88*b* are longer than that of the absorber 84 in the thickness direction Z, the body portion 88*f* is supported by the first locking portion 88*a* and the second locking portions 88*b*. Therefore, in this case, the protrusions 86*f* and 86*g* may not be formed in the accommodation member 86.

Figure 20:
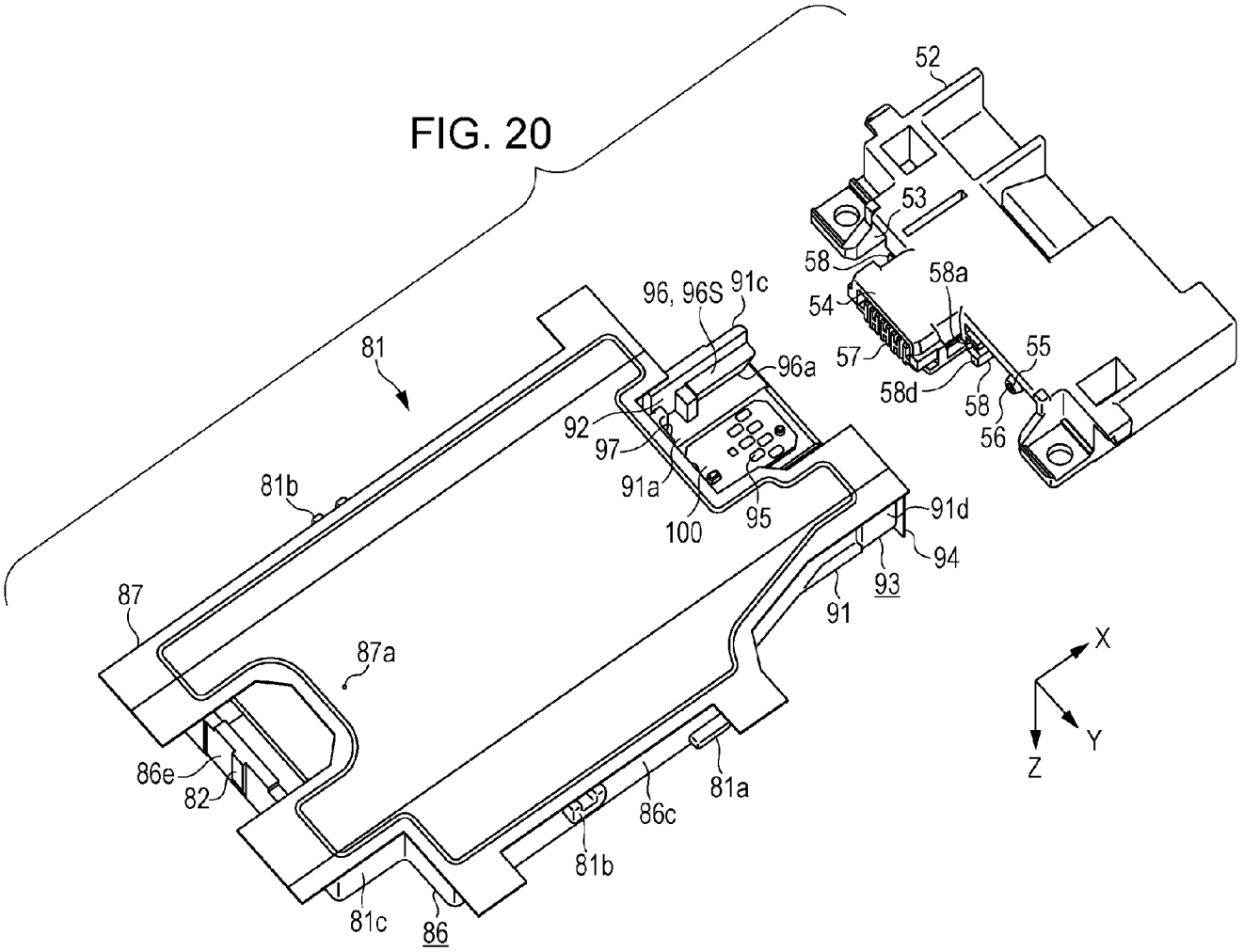
FIG. 20 is a perspective view illustrating the waste liquid container before the mounting.

As illustrated in FIG. 20, the connection concave portion 92 of the waste liquid container 81 is opened in the mounting direction X and is formed at one end (front end) of the waste liquid container 81 in the mounting direction X to be opened in the mounting direction X and insertable into the projection 54 at the time of the mounting on the mounting unit 52. On the other hand, the connection concave portion 53 of the mounting unit 52 is opened in the detaching direction to be insertable into the convex portion 91 formed at the one end of the waste liquid container 81.

Figure 21:
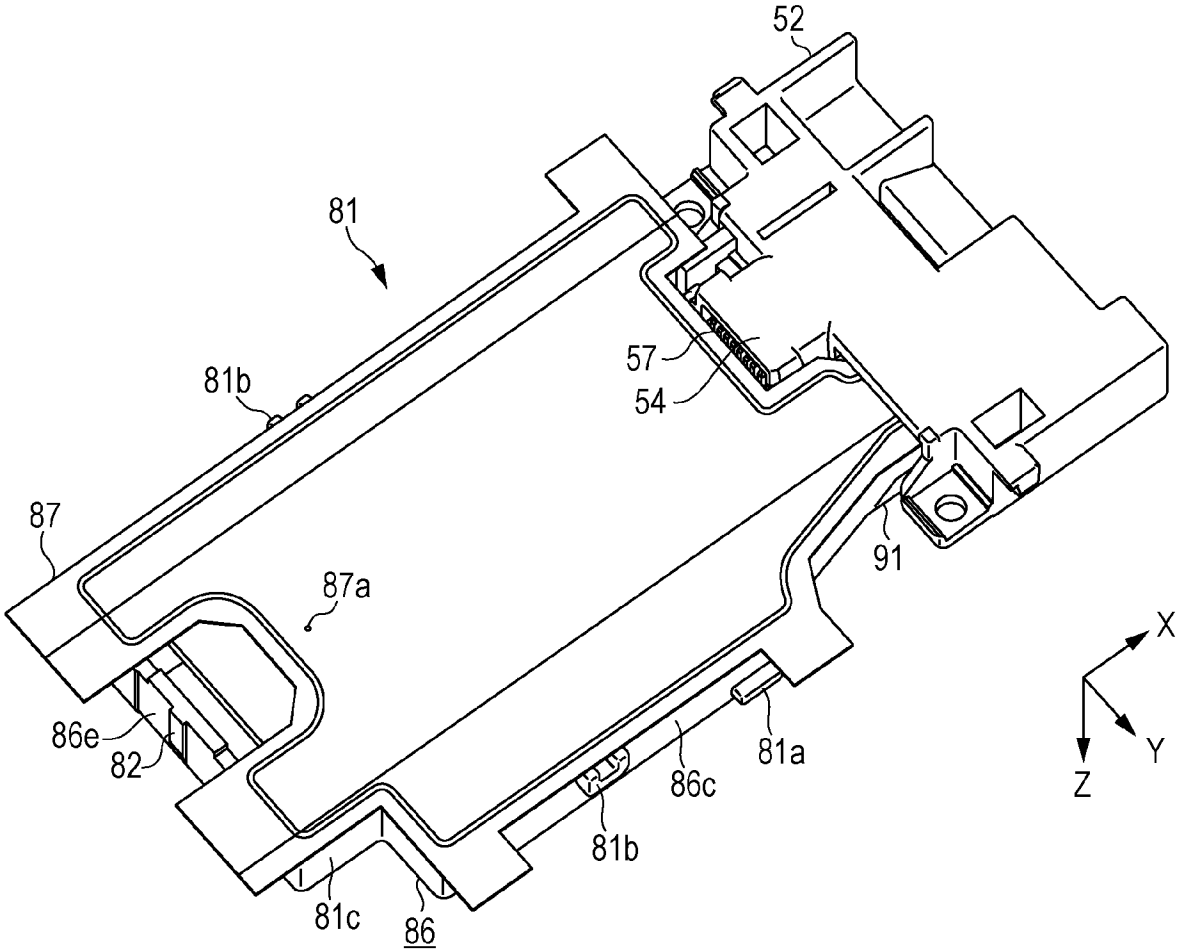
FIG. 21 is a perspective view illustrating the waste liquid container after the mounting.

FIG. 21 illustrates the waste liquid container 81 mounted on the mounting unit 52.

Next, operations of the mounting unit 52 and the waste liquid container 81 will be described.

As illustrated in FIG. 20, when the waste liquid container 81 is moved toward the mounting unit 52 in the mounting direction X in order to mount the waste liquid container 81 on the mounting unit 52, the convex portion 91 of the waste liquid container 81 is inserted into the connection concave portion 53 of the mounting unit 52 and the projection 54 is inserted into the connection concave portion 92 of the waste liquid container 81.

At this time, one pair of guide portions 96 formed inside the connection concave portion 92 guides the projection 54 so that the positions of the connection terminals 95 are aligned with the substrate connection portion 57 and the position of the waste liquid introduction portion 93 is aligned with the discharge portion 55.

Figure 22:
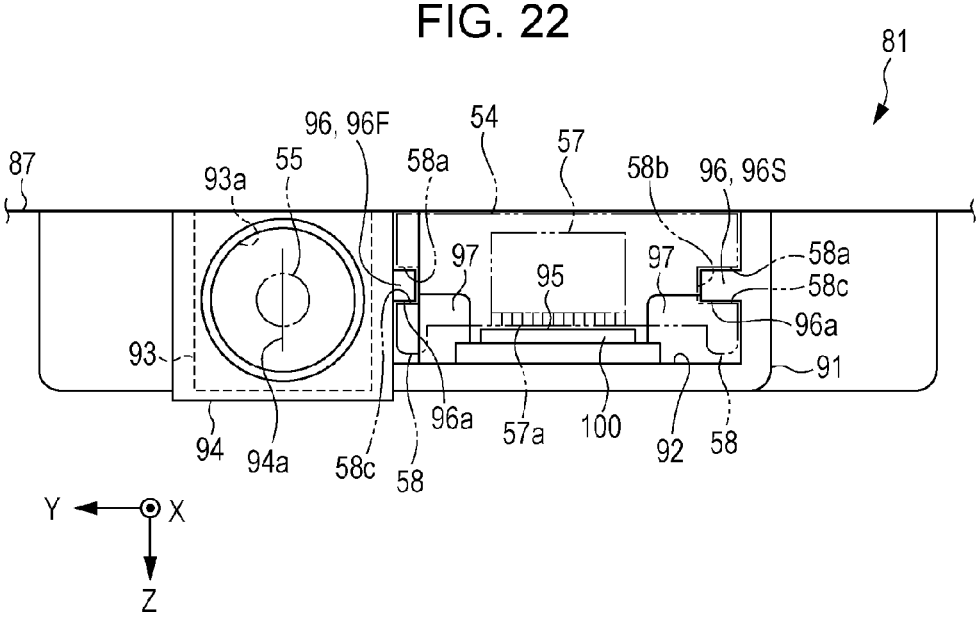
FIG. 22 is a schematic view illustrating an operation of the waste liquid container.

Specifically, as illustrated in FIG. 22, the guide portions 96 are inserted into the concave portion formed by the engaging surfaces 58*a*, 58*b*, and 58*c* of the engaging projection 58 formed in the projection 54. The guide portions 96 formed in a convex shape are moved in the mounting direction X along the engaging surfaces 58*a*, 58*b*, and 58*c* formed in a concave shape so that the guide surfaces 96*a* of the guide portions 96 face the engaging surface 58*c*. That is, the guide portions 96 are directly moved in the mounting direction X so that the movement in the opposite direction to the thickness direction Z is suppressed by the engaging surface 58*a*, the movement in the thickness direction Z is suppressed by the engaging surface 58*c*, and the movement in the width direction Y is suppressed by the engaging surface 58*b*.

Here, since one pair of guide portions 96 is formed with the connection terminals 95 therebetween in the width direction Y, the projection 54 is guided by one pair of guide portions 96 so that the positions of the connection terminals 95 can be aligned with the substrate connection portion 57. The one guide portion 96F is disposed between the connection terminals 95 and the waste liquid introduction portion 93 in the width direction Y, the projection 54 is guided by the guide portion 96F so that the position of the waste liquid introduction portion 93 can be aligned with the discharge portion 55. Thus, the position alignment of the connection terminals 95 to the substrate connection portion 57 and the position alignment of the waste liquid introduction portion 93 to the discharge portion 55 are performed by one pair of guide portions 96.

Then, when the regulation protrusions 97 of the waste liquid container 81 collide with the front end surface 58*d* of the engaging projection 58, the movement of the waste liquid container 81 in the mounting direction X is regulated and the mounting of the waste liquid container 81 on the mounting unit 52 is completed. The position of the waste liquid container 81 at this time is referred to as a mounted position.

Thus, the front end surface 58*d* of the engaging projection 58 and the regulation protrusions 97 function as a positioning unit that stops the waste liquid container 81 moved in the mounting direction X at the mounted position. The movement of the waste liquid container 81 in the mounting direction X can also be regulated by causing the projection 54 to collide with the front wall portion 86*d* without forming the regulation protrusions 97. However, when the regulation protrusions 97 and the engaging projections 58 are formed to decrease a contact area of the waste liquid container 81 and the projection 54, accuracy of the positioning is improved.

Figure 23:
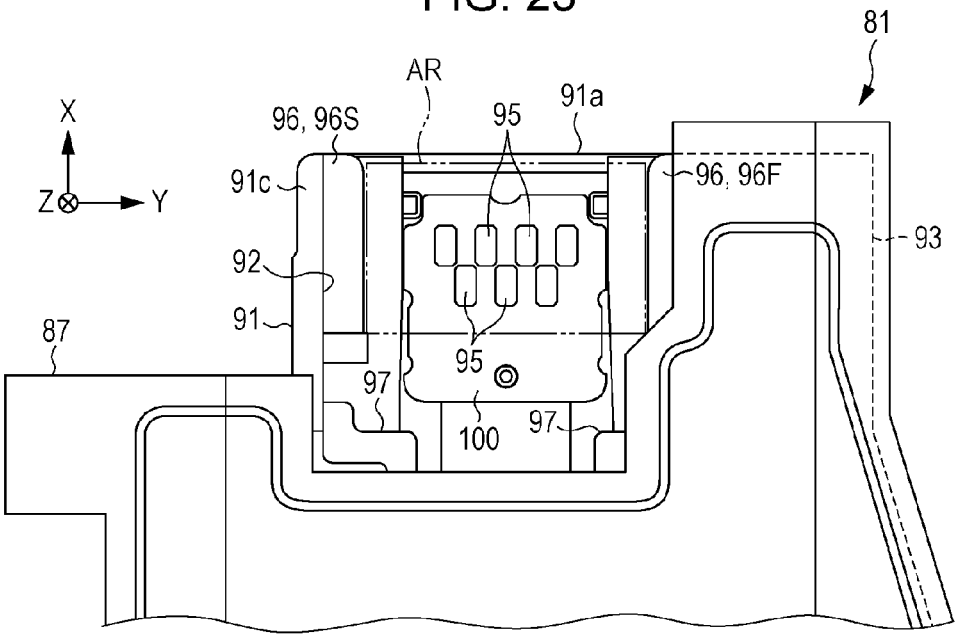
FIG. 23 is a front view illustrating a connection concave portion of the waste liquid container.

As illustrated in FIG. 23, it is preferable to dispose the connection terminals 95 so that the connection terminals 95 face a region AR (indicated by a two-dot chain line in FIG. 23) between the one guide portion 96F and the other guide portion 96S of the one pair of guide portions 96. Thus, the positions of the connection terminals 95 can be accurately aligned with the substrate connection portion 57 more than when the region AR and the connection terminals 95 are distant in the mounting direction X.

As illustrated in FIG. 22, when the waste liquid container 81 is located at the mounted position, the movable contact portion 57*a* of the substrate connection portion 57 comes into contact with the connection terminals 95 by a predetermined contact pressure to be elastically displaced and the connection terminals 95 are electrically connected to the substrate connection portion 57. Thus, the circuit substrate 100 is electrically connected to the control unit 103, and thus information regarding the capacity or the like of the waste liquid can be transmitted between the circuit substrate 100 and the control unit 103.

When the waste liquid container 81 is located at the mounted position, the guide surface 96*a* of the one pair of guide portions 96 engages with the engaging surface 58*c* formed in the projection 54 by an elastic restoration force of the movable contact portion 57*a* pressed and elastically displaced by the connection terminals 95. Therefore, the connection terminals 95 are also moved in the direction distant from the substrate connection portion 57 by the elastic restoration force of the movable contact portion 57*a* and the guide surface 96*a* engages with the engaging surface 58*c* so that the movement of the connection terminals 95 is suppressed. As a result, the state in which the connection terminals 95 come into contact with the movable contact portion 57*a* by a predetermined contact pressure is maintained.

Since the connection terminals 95 are disposed in parallel to a plane (which is an imaginary surface indicated by a one-dot chain line in FIG. 22) including one pair of guide surfaces 96*a* to form a plane, contact pressures with the plurality of movable contact portions 57*a* projecting in the thickness direction become uniform.

The center of the connection hole 56 is located on the plane (which is the imaginary surface indicated by the one-dot chain line in FIG. 22) including two engaging surfaces 58*c*, and the opening center of the waste liquid introduction portion 93 is located on the plane (which is the imaginary surface indicated by the one-dot chain line in FIG. 22) including the two guide surfaces 96*a*. Therefore, when the waste liquid container 81 is moved to the mounted position, the engaging surface 58*c* and the guide surface 96*a* facing each other come into contact with each other by the elastic restoration force of the movable contact portion 57*a* so that the center position of the connection hole 56 and the center position of the waste liquid introduction portion 93 are disposed on the same plane. Thus, since the center position of the connection hole 56 matches the center position of the waste liquid introduction portion 93 in the thickness direction Z, the positions of the waste liquid introduction portion 93 and the discharge portion 55 can be aligned more accurately, and then the discharge portion 55 can be inserted into the waste liquid introduction portion 93.

With the movement of the waste liquid container 81 to the mounted position, the discharge portion 55 is inserted into the waste liquid introduction portion 93 via the incision 94*a* and the insertion opening 93*a* so that the discharge portion 55 and the waste liquid introduction portion 93 are connected to each other. Thus, the waste liquid discharged from the discharge portion 55 can be introduced to the waste liquid container 81.

In the discharge portion 55, a gap formed between the insertion opening 93*a* and the extension portion 84*e* is disposed inside the waste liquid introduction portion 93. The containing portion 89 communicates with the atmosphere via the atmosphere communication hole 87*a*. Therefore, when the waste liquid is introduced into the containing portion 89 via the discharge portion 55, the air corresponding to the capacity of the introduced waste liquid is discharged out of the containing portion 89 via the atmosphere communication hole 87*a*.

Here, on the wall portion facing the film member 87 of the waste liquid container 81 in the waste liquid container accommodation portion 48, a concave portion (not illustrated) serving as an air passage may be formed from the position corresponding to the atmosphere communication hole 87*a* formed in the waste liquid container 81 in a direction distant from the circuit substrate 100. Thus, the waste liquid discharged from the discharge portion 55 is contained smoothly in the containing portion 89, the waste liquid contained in the containing portion 89 is absorbed by the absorber 84, and evaporation of the waste liquid contained in the containing portion 89 is accelerated.

When an absorber capable of absorbing the liquid is disposed in the above-described concave portion and the liquid contained in the waste liquid container 81 leaks from the atmosphere communication hole 87*a*, the leaking liquid is absorbed by the absorber so that adhering of the leaking liquid to the circuit substrate 100 can be suppressed.

When the waste liquid introduction portion 93 is distant from the atmosphere communication hole 87*a* in an inflow direction of the waste liquid to the containing portion 89, the air and the liquid in the containing portion 89 smoothly disperse in the inflow direction due to the fact that the flow of a fluid (the air and the liquid) is directed from the waste liquid introduction portion 93 to the atmosphere communication hole 87*a* is rarely disturbed.

As illustrated in FIG. 4, when the waste liquid introduction portion 93 is mounted on the mounting unit 52, the waste liquid is introduced into the waste liquid introduction portion 93 from the side of the absorber 28 which is the side of the first end E1 of the movement direction M to the second end E2. When the waste liquid introduction portion 93 is mounted on the mounting unit 52, the atmosphere communication hole 87*a* is disposed on the side of the second end E2 distant from the absorber 28 more than the waste liquid introduction portion 93. That is, in the embodiment, since the waste liquid introduction portion 93 and the atmosphere communication hole 87*a* are located at the positions distant in the inflow direction (the movement direction M) of the waste liquid, the waste liquid can smoothly disperse in the longitudinal direction (the movement direction M) of the absorber 84.

Information regarding the amount of waste liquid introduced from the discharge portion 55 to the waste liquid container 81 is transmitted from the control unit 103 to the circuit substrate 100 and is stored in the memory element included in the circuit substrate 100. When the control unit 103 reads the capacity of waste liquid stored in the memory element included in the circuit substrate 100 at a predetermined timing and the capacity of waste liquid reaches a given value, the control unit 103 displays, for example, the fact that the capacity of waste liquid reaches the given value on the display unit 102 to prompt the user to exchange the waste liquid container 81.

Here, when the user detaches the waste liquid container 81 containing the waste liquid from the liquid ejecting apparatus 11 and holds a portion of the film member 87 to press the portion of the film member 87, there is a concern that the absorber 84 is compressed and deformed via the film member 87 and the waste liquid absorbed in the absorber 84 exudes to leak from the waste liquid introduction portion 93.

From this viewpoint, in the waste liquid container 81 according to the embodiment, the reinforcement member 88 is disposed between the film member 87 and the protrusions 86*f* and 86*g*. Therefore, even when the portion of the film member 87 is pressed, the reinforcement member 88 and the protrusions 86*f* and 86*g* receive the pressing force, so that the compression and the deformation of the absorber 84 is suppressed. Thus, the leakage of the waste liquid from the waste liquid container 81 is suppressed.

In the waste liquid container 81, the waste liquid introduction portion 93 and the connection terminals 95 are arranged in the width direction Y. Therefore, even when the waste liquid container 81 is disposed or mounted so that the thickness direction Z is the gravity direction and the waste liquid leaks from the waste liquid introduction portion 93, the leaking waste liquid is rarely adhered to the connection terminals 95. Therefore, for example, when the waste liquid container 81 is detached from the liquid ejecting apparatus 11 during the use and the waste liquid container 81 during the use is mounted on the liquid ejecting apparatus 11 again, occurrence of a contact failure of the connection terminals 95 and the substrate connection portion 57 caused due to the adhering of the waste liquid to the connection terminals 95 is suppressed.

According to the foregoing embodiment, the following advantages can be obtained.

(1) The passage communication with the discharge hole 68 is formed by the groove 71 recessed in the bottom portion 64 and the sheet-shaped member 73 overlapping with the bottom portion 64. Therefore, when the suction mechanism 44 is driven, the inside of the liquid storage portion 66 is sucked via the suction hole 73*a* formed in the sheet-shaped member 73. That is, the suction hole 73*a* of the sheet-shaped member 73 is formed at the position at which the suction hole 73*a* overlaps with a part of the groove 71. Therefore, even when the discharge hole 68 is formed in the side wall portion 65, the inside of the liquid storage portion 66 can be sucked from the position overlapping with the suction hole 73*a* of the groove 71 formed in the bottom portion 64. Accordingly, in the cap member 63 in which the bottom portion 64 and the side wall portion 65 form the liquid storage portion 66, the liquid inside the liquid storage portion 66 can be effectively discharged from the discharge hole 68 formed in the side wall portion 65.

(2) When the suction mechanism 44 is driven and the space surrounded by the groove 71 recessed concavely in the bottom portion 64 and the sheet-shaped member 73 is sucked, the sheet-shaped member 73 is bent and displaced to come into close contact with the bottom portion 64. Thus, the inside of the liquid storage portion 66 can be sucked efficiently via the suction hole 73*a* without the gap between the sheet-shaped member 73 and the bottom portion 64.

(3) Since the liquid absorbers 74 and 75 absorb the liquid discharged from the liquid ejecting unit 31, the leakage of the liquid from the liquid storage portion 66 can be suppressed. By accommodating the liquid absorbers 74 and 75 in the liquid storage portion 66 with the sheet-shaped member 73 between bottom portion 64 and the liquid absorbers 74 and 75, the sheet-shaped member 73 does not come out of the liquid storage portion 66.

(4) The pressure member 76 can regulate the movement of the liquid absorbers 74 and 75 and the sheet-shaped member 73 and can press the sheet-shape member 73 against the bottom portion 64. Thus, the inside of the liquid storage portion 66 can be sucked efficiently via the suction hole 73*a* without the gap between the sheet-shaped member 73 and the bottom portion 64.

(5) Since the pressure member 76 compresses and deforms the liquid absorbers 74 and 75, the sheet-shaped member 73 can be pressed against the bottom portion 64 by the elastic restoration force of the liquid absorbers 74 and 75. Thus, the inside of the liquid storage portion 66 can be sucked efficiently via the suction hole 73*a* without the gap between the sheet-shaped member 73 and the bottom portion 64.

(6) The value (Ha+Lc) obtained by adding the liquid level height Ha of the liquid absorbed and raised by the capillary forces of the liquid absorbers 74 and 75 and the distance Lc between the discharge hole 68 and the suction hole 73*a* is greater than the length Lb of the bottom portion 64 in the extension direction of the discharge hole 68. Therefore, the posture of the cap member 63 is changed and the discharge hole 68 is disposed vertically more upward than the groove 71, the liquid of the liquid storage portion 66 can be absorbed and raised up to the discharge hole 68.

(7) Since the ventilation hole 69 is opened at the position distant from the bottom portion 64 in the liquid storage portion 66, the inflow of the liquid to the ventilation hole 69 can be suppressed. When the cap member 63 is inclined and the discharge hole 68 is at the posture at which the discharge hole 68 is located vertically more upward than the suction hole 73*a* and thus the ventilation hole 69 is located at the position closer to the discharge hole 68 than the suction hole 73*a*, the inflow of the liquid to the ventilation hole 69 can be suppressed.

(8) When the waste liquid container 81 is moved in the mounting direction X to be mounted on the mounting unit 52, the projection 54 is inserted into the connection concave portion 92 of the waste liquid container 81 so that the positions of the connection terminals 95 recessed in the connection concave portion 92 can be substantially aligned with the position of the substrate connection portion 57 recessed in the projection 54. Subsequently, the projection 54 is guided by the pair of guide portions 96 in the connection concave portion 92, so that the positions of the connection terminals 95 are accurately aligned with the substrate connection portion 57. One of the pair of guide portions 96 is disposed between the connection terminals 95 and the waste liquid introduction portion 93 in the width direction Y. Therefore, when the positions of the connection terminals 95 are aligned, the position of the waste liquid introduction portion 93 can be aligned. Accordingly, the waste liquid container 81 can be mounted on the mounting unit 52 while the position of the waste liquid container 81 is aligned with the substrate connection portion 57 and the discharge portion 55 of the waste liquid formed in the mounting unit 52.

(9) By protruding the one guide portion 96F from the second wall portion 91*b* forming the waste liquid introduction portion 93 and the connection concave portion 92, the distance between the waste liquid introduction portion 93 and the guide portion 96 is shortened. Thus, the position of the waste liquid introduction portion 93 can be aligned accurately by the guide portions 96.

(10) The opening center of the waste liquid introduction portion 93 is located on the plane including the guide surface 96*a* of the one pair of guide portions 96. Therefore, the guide surface 96*a* guides the projection 54 formed in the mounting unit 52, and thus the position of the waste liquid introduction portion 93 can be aligned in the thickness direction Z intersecting both of the mounting direction X and the width direction Y.

(11) At least some of the connection terminals 95 are disposed to face the region AR between the guide portions 96F and 96S. Therefore, the positions of the connection terminals 95 can be accurately aligned with the substrate connection portion 57 more than when the region AR and the connection terminals 95 are distant from each other in the mounting direction X.

(12) When the waste liquid container 81 is mounted on the mounting unit 52, the guide portions 96 and the projection 54 engage with each other by the elastic restoration force of the movable contact portion 57*a* pressed by the connection terminals 95, so that the state in which the movable contact portion 57*a* comes into contact with the connection terminals 95 by the predetermined contact pressure can be maintained. Thus, for example, even when the waste liquid container 81 is slightly moved due to vibration or the like, the state in which the connection terminals 95 are electrically connected to the substrate connection portion 57 can be maintained.

(13) Since both ends of the convex portion 91 in the width direction Y are disposed more inside in the width direction Y than both ends of the containing portion 89 in the width direction Y, it is possible to suppress unnecessary collision of the connection concave portion 92 and the waste liquid introduction portion 93 to other members or the like more than when the connection concave portion 92 and the waste liquid introduction portion 93 are disposed at the end in the width direction Y.

(14) By covering the opening of the accommodation concave portion 85 formed in the accommodation member 86 with the film member 87, the size of the accommodation concave portion 85 can be reduced in the depth direction (the thickness direction Z) more easily than when the opening of the accommodation concave portion 85 is covered with a plate-shaped member. By disposing the reinforcement member 88 between the absorber 84 and the film member 87, deformation of the absorber 84 is suppressed when the absorber 84 accommodated in the accommodation concave portion 85 is pressed via the film member 87. Thus, the leakage of the liquid absorbed in the absorber 84 can be suppressed.

(15) By inserting the protrusions 86*f* and 86*g* formed in the accommodation member 86 into the insertion portions 84*a* and 84*b* formed in the absorber 84, it is possible to suppress movement of the absorber 84 inside the accommodation concave portion 85.

(16) By disposing the reinforcement member 88 between the protrusions 86*f* and 86*g* and the film member 87, movement of the reinforcement member 88 pressed via the film member 87 can be suppressed by the protrusions 86*f* and 86*g*. Accordingly, it is possible to suppress occurrence of leakage of the waste liquid absorbed by the absorber 84 when the reinforcement member 88 is moved to press the absorber 84.

(17) By forming the reinforcement member 88 in the sheet shape, it is possible to ensure a large space for accommodating the absorber 84 inside the accommodation concave portion 85. Further, a resin material is easily molded, and thus is suitable to form the reinforcement member 88 in the sheet shape.

The foregoing embodiment may be modified as in the following modification examples.

When the liquid ejecting apparatus 11 does not include the atmosphere opening valve 46 and the ventilation tube 45, the ventilation hole 69 and the second connection protrusion 62 may not be formed in the cap member 63.

When the suction hole 73*a* formed in the sheet-shaped member 73 is located at a position at which the suction hole 73*a* overlaps with the groove 71, the suction hole 73*a* can be disposed at any position in the cap 42. For example, the plurality of suction holes 73*a* may be disposed in the longitudinal direction of the groove 71. The upstream end side of the groove 71 may be branched into a plurality of ends and the suction holes 73*a* may be disposed at positions at which the suction holes 73*a* overlap with the plurality of branched ends.

In the cap 42, the sheet-shaped member 73 may not necessarily have the size enough to cover the entire bottom portion 64. The sheet-shaped member 73 may have a shape and a size enough to cover at least the groove 71.

In the cap 42, the sheet-shaped member 73 may be attached to the bottom portion 64. In this case, the cap 42 may not include the liquid absorbers 74 and 75 and the pressure member 76 and the sheet-shaped member 73 may not have flexibility.

The engaging projection 58 formed in the mounting unit 52 may not include the concave portion, and the engaging projection 58 with a convex shape engages with the guide portion 96 with a convex shape. Alternatively, the guide portion 96 included in the waste liquid container 81 may be formed in a concave shape and the engaging projection 58 with the convex shape may be inserted into the concave guide portion 96.

The waste liquid container 81 may not include the convex portion 91 or the notch 81*c*.

In the waste liquid container 81, the film member 87 covering the opening of the accommodation concave portion 85 included in the accommodation member 86 may be substituted with a plate member. When the opening of the accommodation concave portion 85 is covered with the plate member, the waste liquid container 81 may not include the reinforcement member 88.

In the waste liquid container 81, the guide portion 96F may be formed in another wall from the second wall portion 91*b* forming the waste liquid introduction portion 93 and the connection concave portion 92. One pair of guide portions 96F and 96S may be formed to project outside from the convex portion 91 in the width direction Y. For example, the guide portion 96F may be formed in the fourth wall portion 91*d* forming the waste liquid introduction portion 93 to project outside in the width direction Y in the waste liquid container 81. In this case, the guide portion 96S may be formed in the third wall portion 91*c* to project outside in the width direction Y.

In the waste liquid container 81, one pair of guide portions 96F and 96S may be formed in the second wall portion 91*b* and the fourth wall portion 91*d* forming the waste liquid introduction portion 93, respectively, to project outside in the width direction Y.

In the foregoing embodiment, the structures of the projection 54 and the guide portions 96 used to align the position of the waste liquid container 81 with the mounting unit 52 can also be adopted to position alignment when the liquid container 104 is mounted on the liquid ejecting apparatus 11 (the carriage 33 and the like).

The liquid ejected by the liquid ejecting unit is not limited to ink. For example, a liquid material in which particles of a functional material are dispersed or mixed in a liquid may be used. For example, a liquid material containing a material such as an electrode material or a color material (pixel material) used to manufacture a liquid crystal display, an electroluminescence (EL) display, and a surface light emission display in a disperse or resolved form may be ejected to perform recording.

The medium is not limited to a sheet, but a plastic film, a thin plate, or the like may be used or a fabric used in a textile printing apparatus may be used.

Second Embodiment

Hereinafter, an embodiment of a liquid ejecting apparatus and an attachment mounted on the liquid ejecting apparatus will be described with reference to the drawings. The liquid ejecting apparatus is, for example, an ink jet printer that performs recording (printing) by ejecting ink which is an example of a liquid to a medium such as a sheet.

Figure 24:
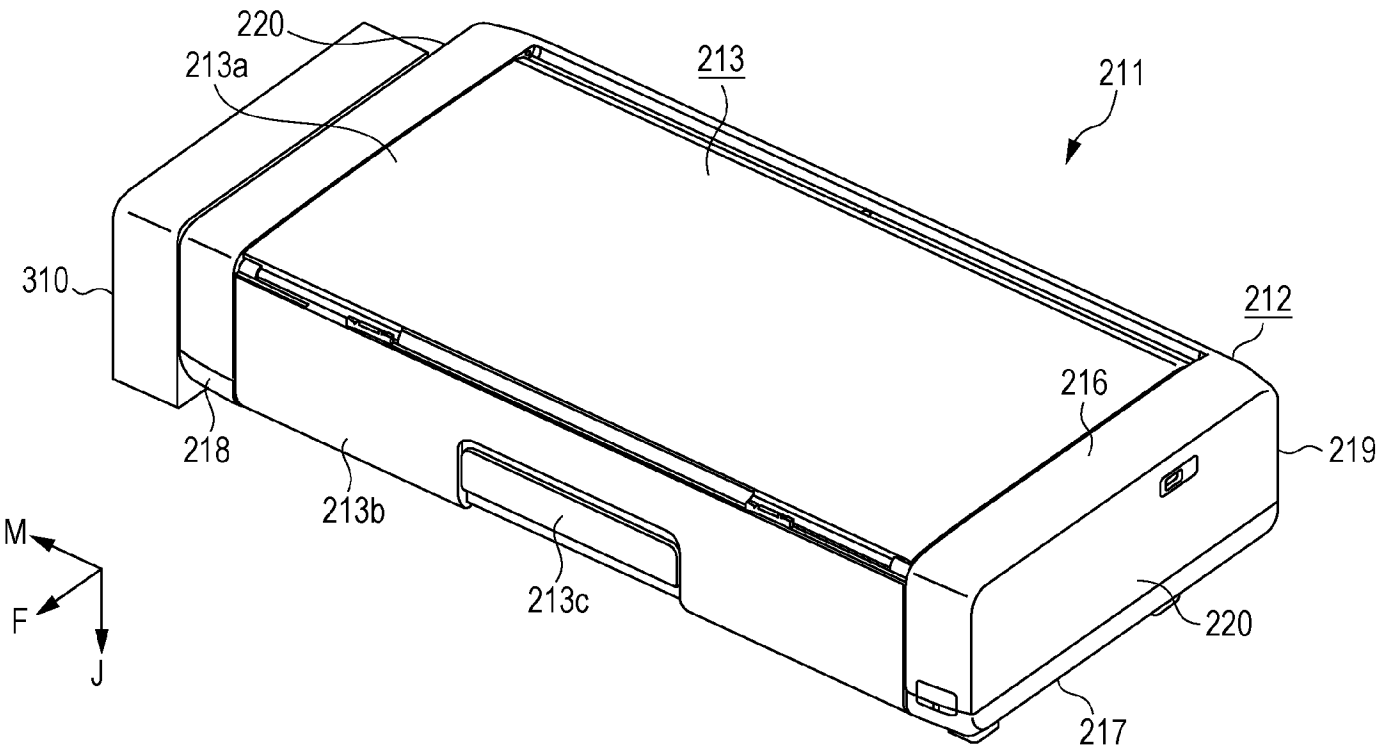
FIG. 24 is a perspective view illustrating a liquid ejecting apparatus according to a second embodiment.

As illustrated in FIG. 24, a liquid ejecting apparatus 211 includes a rectangular box-like casing unit 212, an opening/closing body 213 mounted on the casing unit 212, and a waste liquid containing unit 310 disposed on a side surface of the casing unit 212. The opening/closing body 213 includes a rectangular plate-shaped body portion 213*a* that is joined to be pivotable with respect to the casing unit 212 and a rectangular plate-shape extension portion 213*b* that is joined such that a base end portion is pivotable with respect to the body portion 213*a*.

The extension portion 213*b* is smaller than the body portion 213*a*. A hand-catch portion 213*c* is recessed on the front end side of the extension portion 213*b*. The opening/closing body 213 is disposed at a close position illustrated in FIG. 24 and an open position illustrated in FIG. 25 by catching the hand-catch portion 213*c* with a hand and pivoting the extension portion 213*b* and the body portion 213*a* at up to predetermined angles, respectively.

Figure 25:
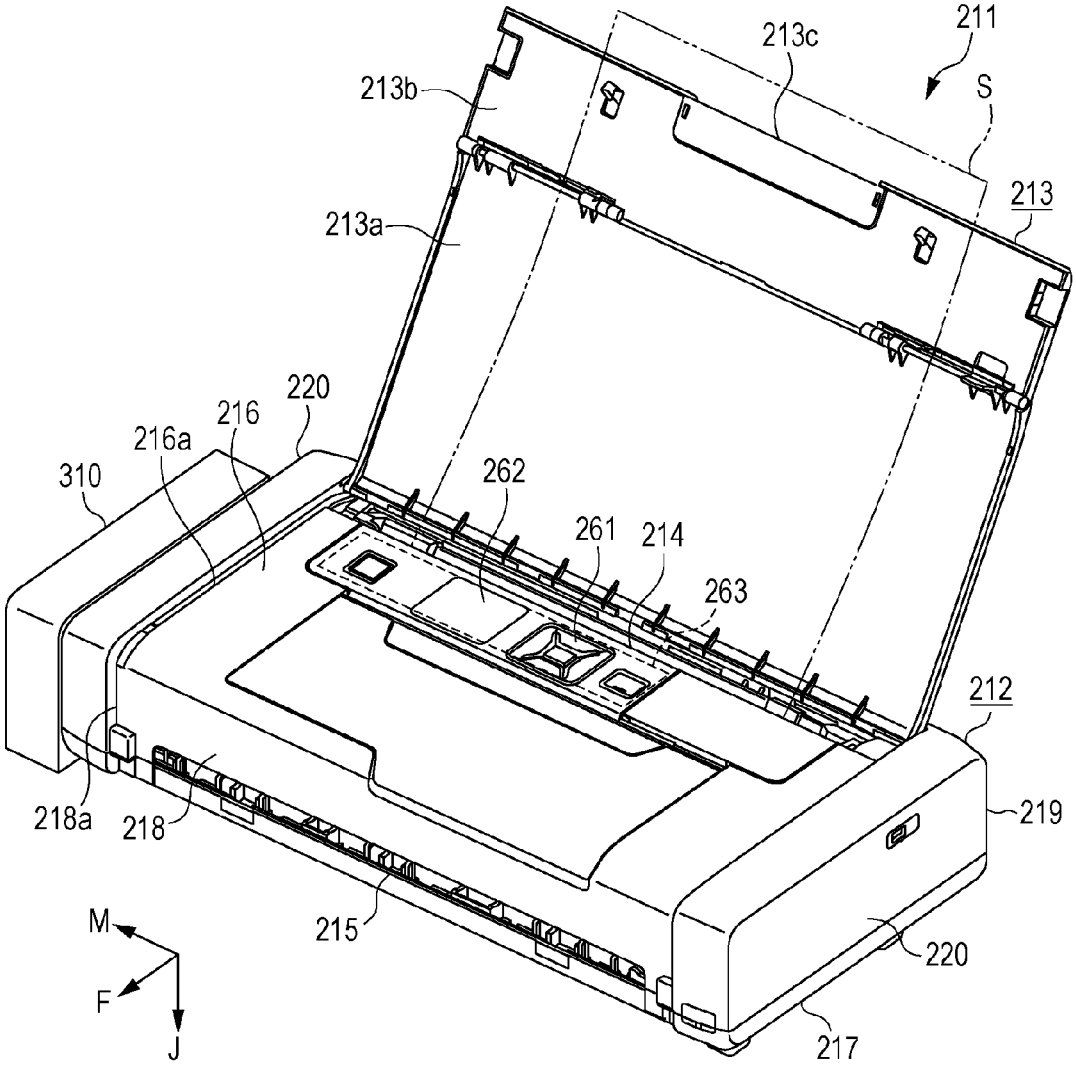
FIG. 25 is a perspective view illustrating the liquid ejecting apparatus in which an opening/closing body is disposed at an open position.

When the opening/closing body 213 is disposed at the open position, as illustrated in FIG. 25, an insertion opening 214 through which a medium S is inserted into the casing unit 212 and a discharge opening 215 through which the medium S is discharged from the casing unit 212 are exposed. The opening/closing body 213 disposed at the open position functions as a support base (sheet feeding tray) supporting the medium S inserted into the insertion opening 214.

In the casing unit 212, the outer wall to which the insertion opening 214 is opened is referred to as a top wall 216, the outer wall opposite to the top wall 216 is referred to as a bottom wall 217, the outer wall to which the discharge opening 215 is opened is referred to as a front wall 218, and the outer wall opposite to the front wall 218 is referred to as a rear wall 219. In the casing unit 212, a pair of outer walls intersecting the top wall 216, the bottom wall 217, the front wall 218, and the rear wall 219 is referred to as outside walls 220. In the casing unit 212, the side of the top wall 216 is referred to as a top surface side and the side of the bottom wall 217 is referred to as a bottom surface side in some cases.

A manipulation unit 261 manipulating the liquid ejecting apparatus 211 and a display unit 262 displaying a manipulation result of the manipulation unit 261, an operation status of the liquid ejecting apparatus 211, and the like are disposed on the external surface (top wall) side of the top wall 216. A control unit 263 controlling an operation of the liquid ejecting apparatus 211 is disposed on the internal surface (bottom surface) side of the top wall 216. The manipulation unit 261 and the display unit 262 are electrically connected to the control unit 263.

In the opening/closing body 213 disposed at the close position, the body portion 213*a* partially overlaps with a part of the top wall 216 so insertion opening 214, the manipulation unit 261, and the display unit 262 are covered and the extension portion 213*b* partially overlaps with the front wall 218 so that the discharge opening 215 is covered. Concave portions 216*a* and 218*a* accommodating the body portion 213*a* and the extension portion 213*b* disposed at the close position are recessed in the top wall 216 and the front wall 218. When the opening/closing body 213 is disposed at the close position, the opening/closing body 213 is accommodated in the concave portions 216*a* and 218*a* so that the outside surface thereof are substantially flush with the outside surface of the casing unit 212 to be integrated with the casing unit 212.

Figure 26:
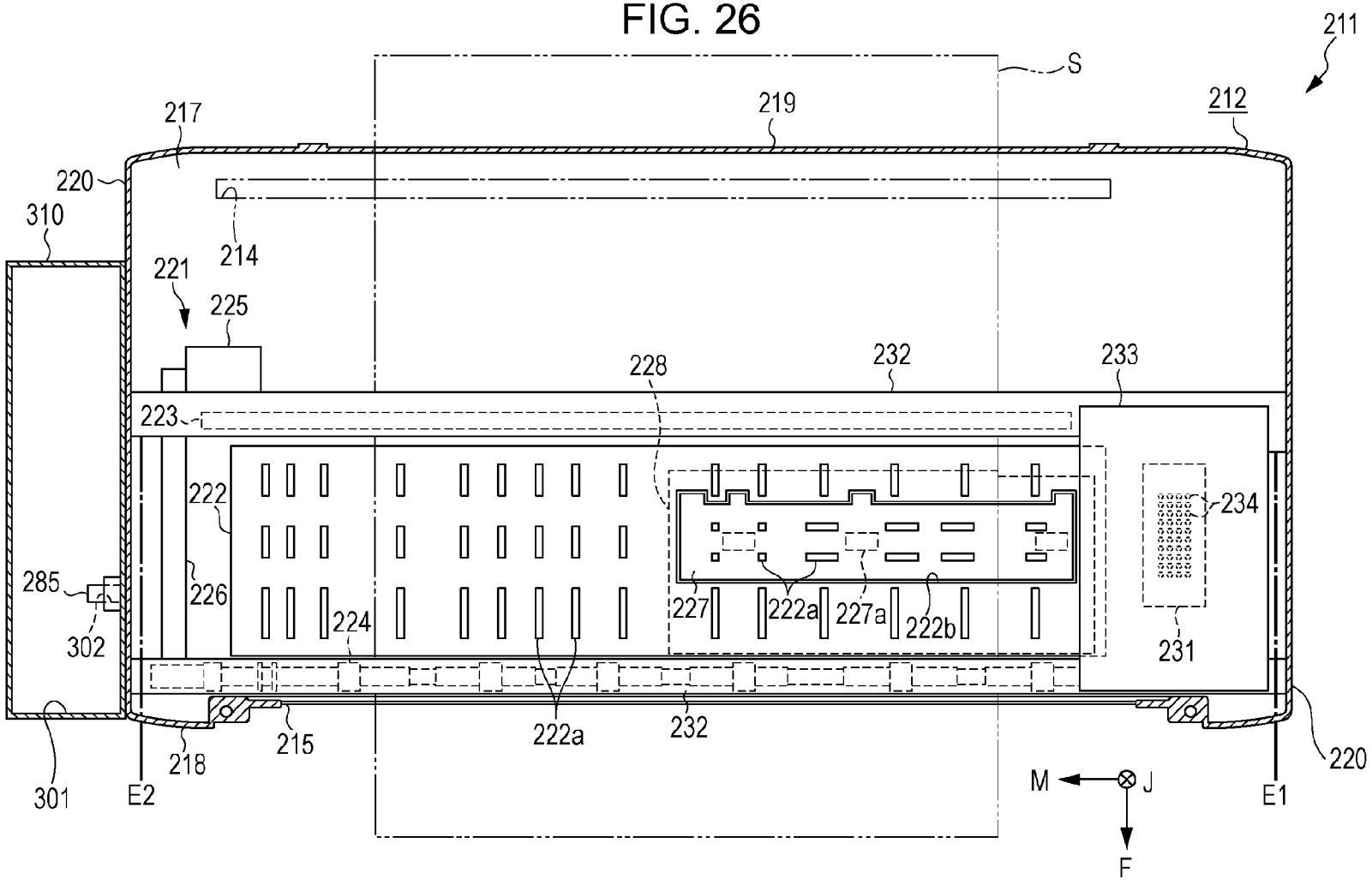
FIG. 26 is a sectional view illustrating a configuration of the liquid ejecting apparatus relevant to liquid ejection.

As illustrated in FIG. 26, a transport mechanism 221 that transports the medium S inserted from the insertion opening 214 to the discharge opening 215 and a medium support portion 222 that supports the medium S which is being transported are accommodated in the casing unit 212. In FIG. 26, a part of the configuration is not illustrated to facilitate understanding of description of the configuration related to liquid ejection.

The transport mechanism 221 includes a transport roller 223 that transports the medium S from the insertion opening 214 to the medium support portion 222 and a discharge roller 224 that transports the medium S from the medium support portion 222 to the discharge opening 215. The transport mechanism 221 includes a transport motor 225 which is a driving source and a power transmission mechanism 226 which is formed by a gear train or the like transmitting a driving force of the transport motor 225 to the transport roller 223 and the discharge roller 224.

The liquid ejecting apparatus 211 includes a liquid ejecting unit 231 that ejects a liquid to the medium S supported by the medium support portion 222 and a carriage 233 that holds the liquid ejecting unit 231 and reciprocates along a guide rail 232 installed in the casing unit 212. The liquid ejecting unit 231 includes a plurality of nozzles 234 ejecting the liquid as liquid droplets.

The liquid ejecting unit 231 ejects the liquid droplets from the nozzles 234 while reciprocating in a movement direction M intersecting a transport direction F of the medium S along with the carriage 233. For example, the liquid ejected by the liquid ejecting unit 231 is supplied from a liquid container (not illustrated) (for example, an ink cartridge) detachably mounted on the carriage 233. In the embodiment, an ejection direction J in which the liquid droplets are ejected from the nozzles 234 is a gravity direction intersecting both of the transport direction F and the movement direction M.

In a movement region of the liquid ejecting unit 231, the side of a first end E1 (the right end in FIG. 26) in the movement direction M is set as a home position of the liquid ejecting unit 231. In the movement region, the liquid ejecting unit 231 alternately performs forward movement oriented from the first end E1 to a second end E2 (the left end in FIG. 26) in the movement direction M and backward movement oriented from the second end E2 to the first end E1. In the embodiment, the transport motor 225 is disposed at a position closer to the insertion opening 214 than the medium support portion 222 in the transport direction F and at a position closer to the second end E2 than the first end E1 in the movement direction M.

In the medium support portion 222, a plurality of support protrusions 222*a* supporting the medium S are installed to be arranged in the movement direction M and the transport direction F. In the medium support portion 222, a sheet accommodation concave portion 222*b* is installed on the side of the first end E1 in the movement direction M. A liquid droplet acceptance sheet 227 capable of absorbing the liquid is accommodated in the sheet accommodation concave portion 222*b*.

An absorber 228 capable of absorbing the liquid is disposed between the bottom wall 217 and the sheet accommodation concave portion 222*b* of the medium support portion 222. The absorber 228 is preferably greater than the liquid droplet acceptance sheet 227 in an absorption capacity of the liquid. In the medium support portion 222, a plurality of openings are installed at positions corresponding to the inner bottom of the sheet accommodation concave portion 222*b*. In the liquid droplet acceptance sheet 227, a plurality of extension portions 227*a* of which front ends droop via the openings to come into contact with the absorber 228 are installed.

For example, when non-margin printing is performed up to the margin of the medium S with a small size, such as an L photo sheet or a postcard so that printing is performed without margin, the liquid droplet acceptance sheet 227 accepts the liquid droplets beyond the margin of the medium S. The liquid accepted by the liquid droplet acceptance sheet 227 transitions to the absorber 228 along the extension portions 227*a* to be absorbed by the absorber 228.

Figure 27:
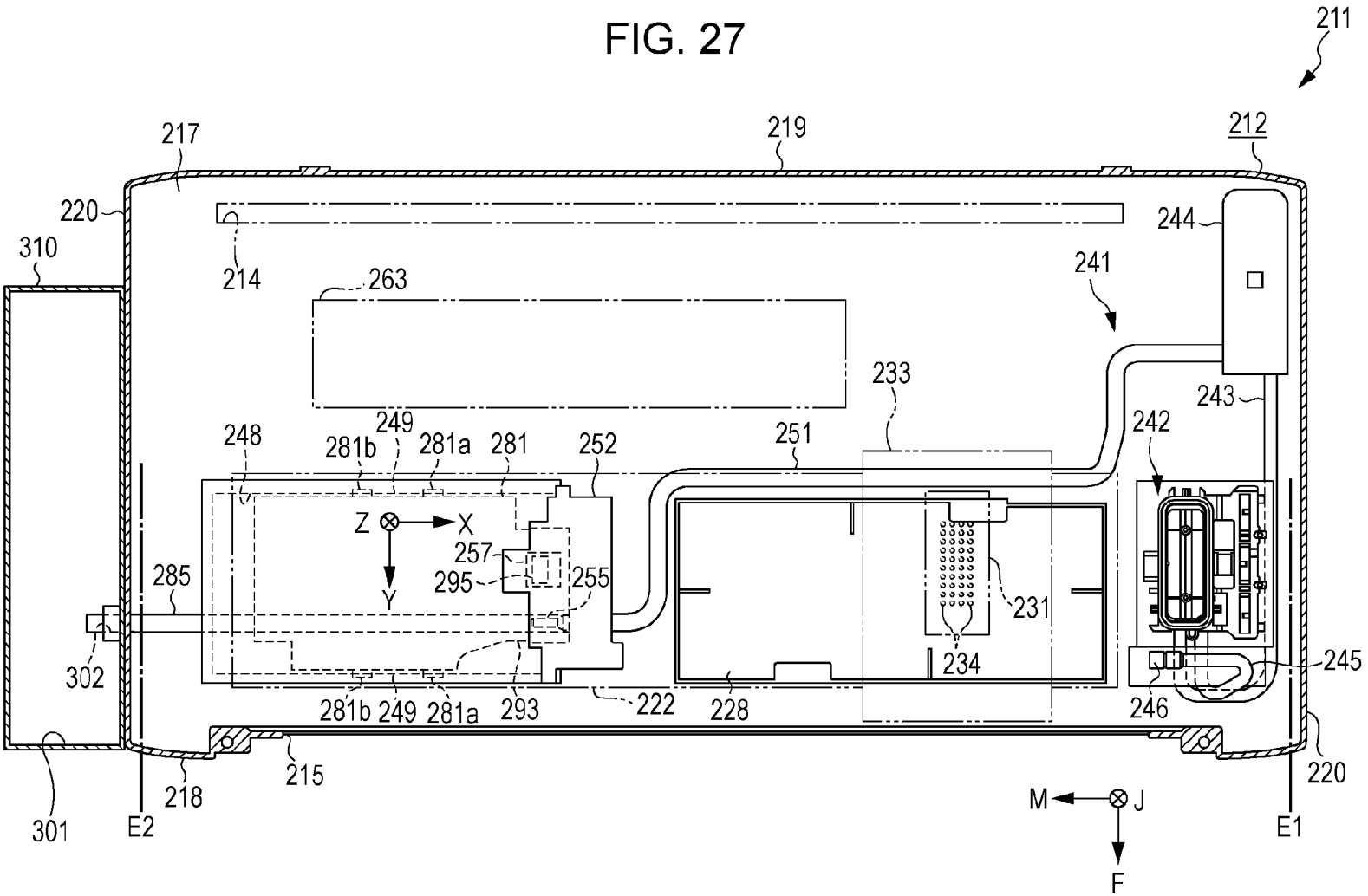
FIG. 27 is a sectional view illustrating a configuration of the liquid ejecting apparatus relevant to maintenance.

As illustrated in FIG. 27, the liquid ejecting apparatus 211 includes a maintenance mechanism 241 that performs maintenance of the liquid ejecting unit 231. In FIG. 27, to facilitate description understanding of a configuration related to maintenance, a part of the configuration is not illustrated and the configurations of the medium support portion 222, the carriage 233, and the liquid ejecting unit 231 are indicated by two-dot chain lines.

The maintenance mechanism 241 includes a cap 242 that is disposed at a position corresponding to the home position in the movement direction M, a suction mechanism 244 that is connected to the cap 242 via a suction tube 243, a ventilation tube 245 of which a base end side is connected to the cap 242, and an atmosphere opening valve 246 that is installed on the front end side of the ventilation tube 245.

The cap 242 can be moved in the ejection direction J and is moved between a capping position at which the cap 242 comes into contact with the liquid ejecting unit 231 moved to the home position and an evacuation position at which the cap 242 does not come into contact with the liquid ejecting unit 231.

When the cap 242 is moved to the capping position at which the cap 242 comes into contact with the liquid ejecting unit 231, the cap 242 forms an enclosed space to which the nozzles 234 are opened. Thus, forming the enclosed space to which the nozzles 234 are opened by the cap 242 is referred to as "capping." When the cap 242 is moved from the capping position to the evacuation position, the capping is released. Then, the liquid ejecting unit 231 is moved to the home position to wait in the capped state at the time of power-off or the like at which the liquid is not ejected.

When the atmosphere opening valve 246 is displaced to a valve opening position at which the front end of the ventilation tube 245 is opened, the enclosed space formed by the cap 242 enters a state communicating with the atmosphere. When the atmosphere opening valve 246 is displaced to a valve closing position at which the front end of the ventilation tube 245 is closed, a state in which the enclosed space is enclosed is formed so that the nozzles 234 are prevented from drying.

The suction mechanism 244 is, for example, a suction pump that is formed by a tube pump or the like generating a suction force by crushing an elastically deformable tube by a pressing member in an eccentric state while being moved rotatably. When the atmosphere opening valve 246 is located at the valve closing position and the suction mechanism 244 is driven, the enclosed space is depressurized so that a negative pressure is formed. Thus, suction cleaning of discharging the liquid from the liquid ejecting unit 231 via the nozzles 234 is performed. When the suction mechanism 244 is formed by the tube pump, the enclosed space can be allowed to communicate with the atmosphere by releasing the crushing of the rube by the pressing member. Therefore, in this case, the atmosphere opening valve 246 and the ventilation tube 245 may not be included.

The suction cleaning is performed as a maintenance operation to resolve an ejection failure, for example, when the ejection failure of the liquid occurs due to clogging or the like of the nozzles 234. Therefore, the liquid discharged from the nozzles 234 through the suction cleaning is treated as a waste liquid containing solute components or the like of bubbles mixed inside the liquid ejecting unit 231 or the thickened liquid.

After the suction cleaning is performed, the negative pressure of the enclosed space is released by displacing the atmosphere opening valve 246 to the valve opening position, and then the capping is released by relatively moving the cap 242 in a direction distant from the liquid ejecting unit 231. Thereafter, idle suction is performed to discharge the liquid remaining in the cap 242 by driving the suction mechanism 244.

As a maintenance operation performed to resolve an ejection failure, the liquid ejecting unit 231 performs flushing in some cases by ejecting liquid droplets toward the cap 242 located at the evacuation position. After the flushing is performed, idle suction is performed to discharge the liquid accepted by the cap 242 by driving the suction mechanism 244.

The liquid ejecting apparatus 211 includes a mounting unit 252 connected to the suction mechanism 244 via a connection tube 251. The mounting unit 252 is disposed at a position interposed between the medium support portion 222 and the bottom wall 217 in the ejection direction J and a position closer to the second end E2 (the left end in FIG. 27) than the absorber 228 in the movement direction M. An attachment 281 guiding the waste liquid discharged from the mounting unit 252 to the waste liquid containing unit 310 is detachably mounted on the mounting unit 252.

The attachment 281 according to the embodiment is moved from the side of the second end E2 to the side of the first end E1 to be mounted on the mounting unit 252 of the liquid ejecting apparatus 211. The attachment 281 mounted on the liquid ejecting apparatus 211 is moved from the side of the first end E1 to the side of the second end E2 to be removed from the mounting unit 252. From this viewpoint, a direction (an opposite direction to the movement direction M) oriented from the second end E2 to the first end E1 is referred to as a "mounting direction X" of the attachment 281 and a direction (the movement direction M) oriented from the first end E1 to the second end E2 is referred to as a "demounting direction" of the attachment 281 in some cases. In the attachment 281, one end (the right end in FIG. 27) which is the front side (which is the side on which the attachment 281 is mounted on the mounting unit 252) of the mounting direction X is referred to as a front end and the other end (the left end in FIG. 27) which is an opposite side to the one end is referred to as a rear end in some case.

A direction intersecting the mounting direction X of the attachment 281 is referred to as a width direction Y and a direction intersecting both of the mounting direction X and the width direction Y is referred to as a thickness direction Z. In the embodiment, the width direction Y is a direction orthogonal to the mounting direction X and is a direction identical to the transport direction F when the attachment 281 is mounted on the mounting unit 252. In the embodiment, the thickness direction Z is a direction orthogonal to both of the mounting direction X and the width direction Y and is a direction identical to the ejection direction J when the attachment 281 is mounted on the mounting unit 252.

As illustrated in FIG. 27, on the bottom wall 217 of the casing unit 212, an accommodation chamber 248 is recessed to be opened in the ejection direction J (the bottom surface side). The length of the accommodation chamber 248 is longer than the length of the attachment 281 in the mounting direction X.

In the accommodation chamber 248, a space is formed to accommodate the mounting unit 252 and the attachment 281 described above. In the accommodation chamber 248, a movement guide portion 249 guiding the attachment 281 mounted on and detached from the mounting unit 252 is formed to extend in the mounting direction X. On the other hand, guide protrusions 281*a* and 281*b* engaging with the movement guide portion 249 at the time of the mounting on the mounting unit 252 protrude on both of both end sides of the attachment 281 in the width direction Y.

Figure 29:
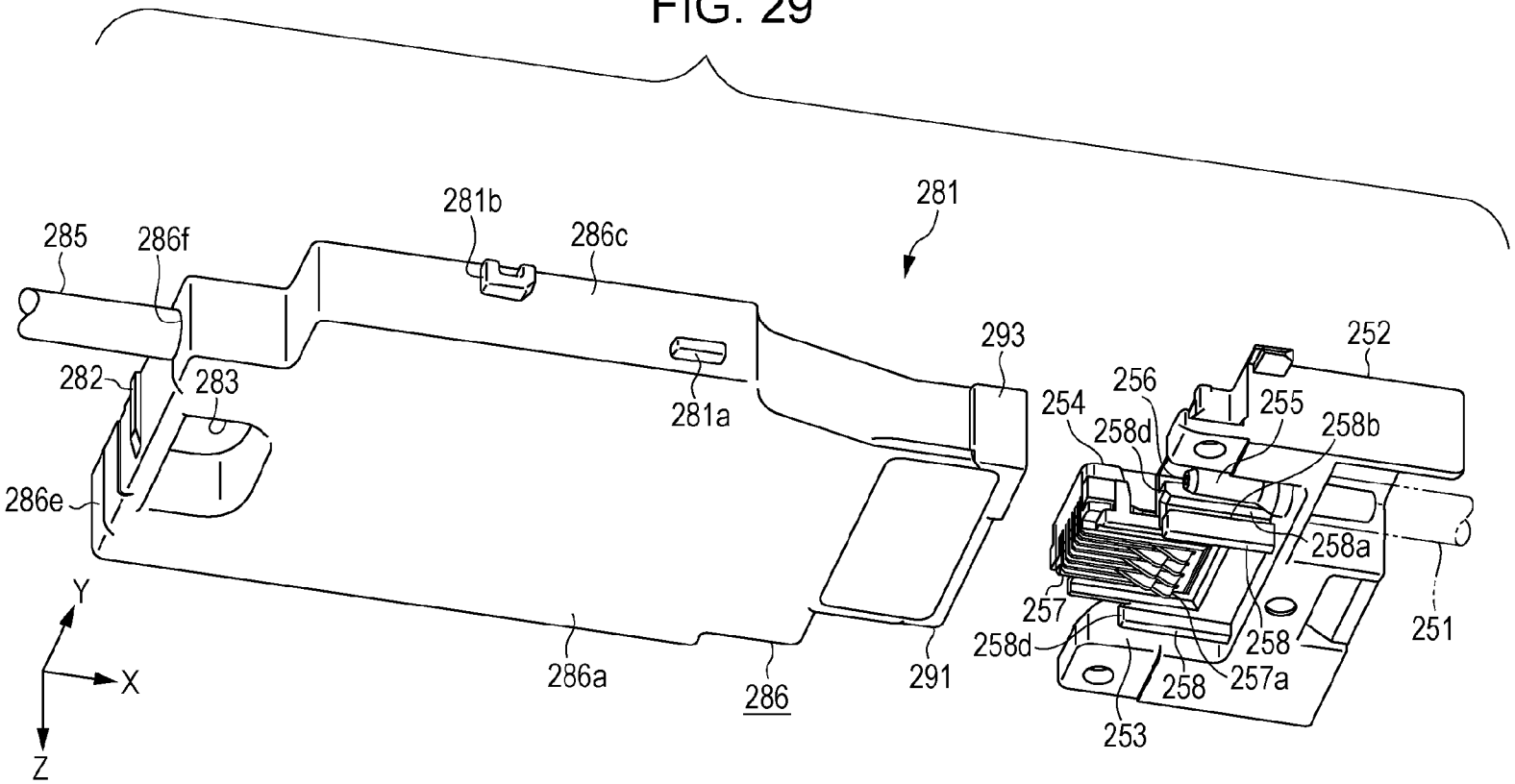
FIG. 29 is a perspective view illustrating a mounting unit and an attachment.

The positions of the guide protrusions 281*a* and 281*b* are different in the thickness direction Z (see FIG. 29). The guide protrusion 281*a* engages with the movement guide portion 249 from the bottom surface side and the guide protrusion 281*b* engages with the movement guide portion 249 from the top surface side. That is, the attachment 281 is mounted on the mounting unit 252. Therefore, when the attachment 281 is moved in the mounting direction X in the accommodation chamber 248, the guide protrusions 281*a* and 281*b* engage with the movement guide portion 249, and thus the movement of the attachment 281 in the ejection direction J is suppressed.

Figure 28:
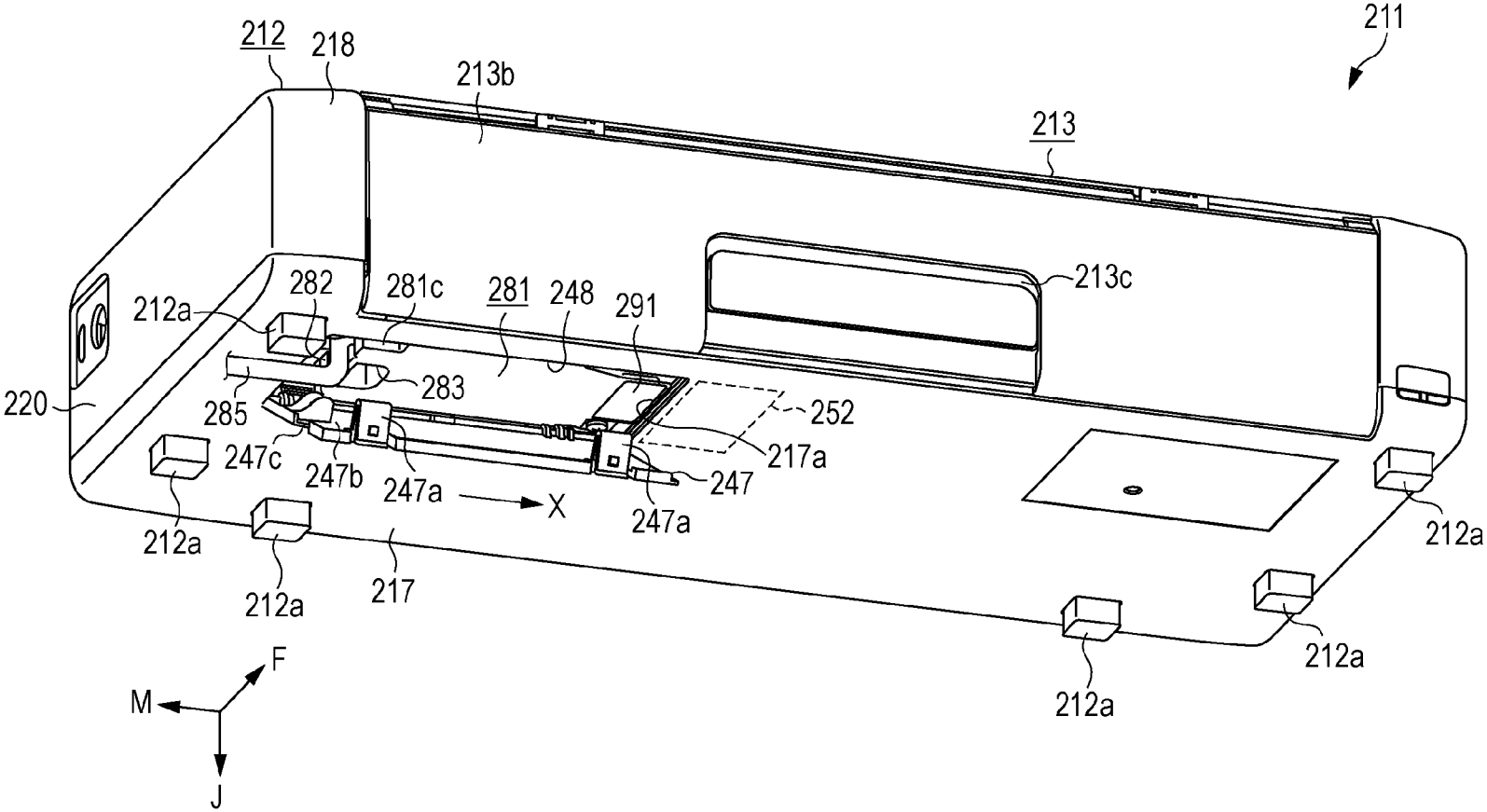
FIG. 28 is a perspective view illustrating the configuration of the liquid ejecting apparatus on a bottom surface side.

As illustrated in FIG. 28, a plurality of support legs 212*a* are formed to project on the bottom wall 217 of the casing unit 212. Thus, when the liquid ejecting apparatus 211 is mounted on any mounted surface (plane), a gap is formed between the mounted surface and the bottom wall 217 of the casing unit 212.

As illustrated in FIG. 28, a mounting opening 217*a* through which the attachment 281 is mounted on the mounting unit 252 of the liquid ejecting apparatus 211 is installed on the bottom wall 217 of the casing unit 212 to communicate with the accommodation chamber 248. An opening/closing lid 247 including a pair of locking claws 247*a* is joined to the mounting opening 217*a* so that the opening/closing lid 247 is pivoted to be opened or closed.

A locking protrusion 247*b* regulating the movement of the attachment 281 mounted on the mounting unit 252 in the demounting direction protrudes in the opening/closing lid 247. In the opening/closing lid 247, a notch 247*c* is formed in a portion in which the locking protrusion 247*b* is formed. Even when the opening/closing lid 247 is closed, the accommodation chamber 248 and the outside of the casing unit 212 communicate by the notch 247*c*. On the other hand, a movement regulation portion 282 which can engage with the locking protrusion 247*b* protrudes at the rear end of the attachment 281.

When the attachment 281 is accommodated in the accommodation chamber 248 from the mounting opening 217*a* and the attachment 281 is subsequently moved toward the mounting unit 252 in the mounting direction X, the attachment 281 is mounted on the mounting unit 252. Here, when the attachment 281 is mounted on the mounting unit 252, the attachment 281 is accommodated in the accommodation chamber 248.

When the attachment 281 is mounted on the mounting unit 252 in this way and the opening/closing lid 247 is subsequently pivoted so that the locking claws 247*a* engage with the mounting opening 217*a*, the locking protrusion 247*b* and the movement regulation portion 282 engage with each other so that the movement of the attachment 281 in the demounting direction is regulated.

A finger-catch portion 283 caught by a finger or the like when the attachment 281 is removed from the mounting unit 252 is recessed in the attachment 281. When the attachment 281 is removed from the mounting unit 252, the opening/closing lid 247 is opened to release the engagement of the locking protrusion 247*b* with the movement regulation portion 282 and the attachment 281 is subsequently moved in the demounting direction, for example, by catching the finger-catch portion 283 with a finger. Then, the attachment 281 is taken out from the accommodation chamber 248 via the mounting opening 21*a*.

Next, the configuration of the mounting unit 252 will be described in detail with reference to FIGS. 29 and 30.

Figure 30:
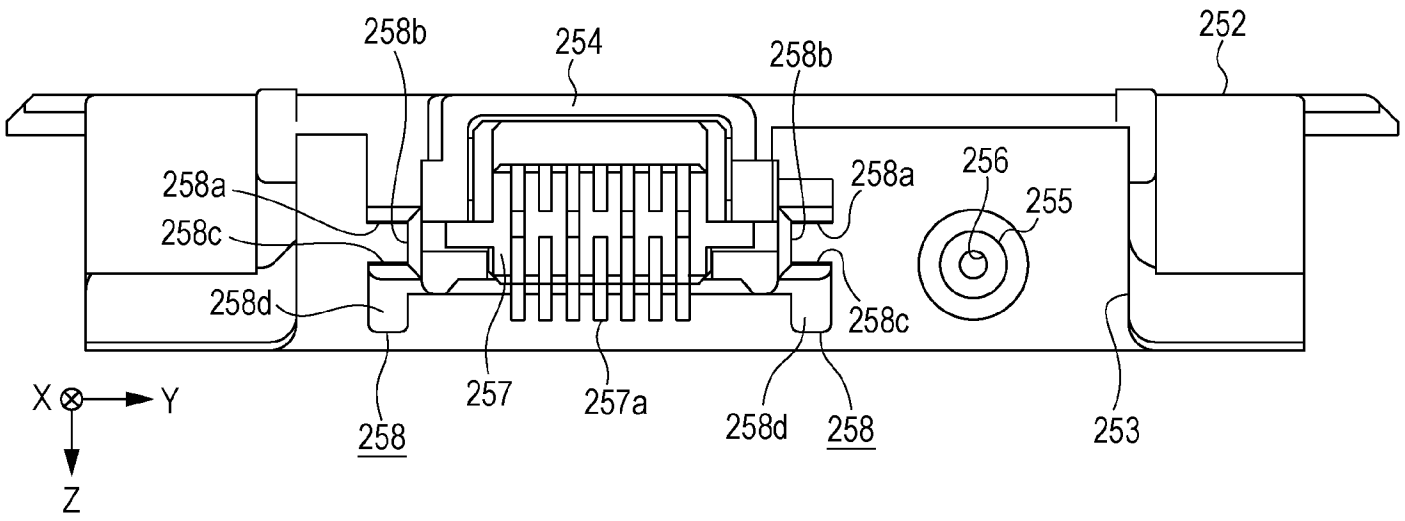
FIG. 30 is a front view illustrating the mounting unit when viewed in a mounting direction.

As illustrated in FIGS. 29 and 30, a connection concave portion 253 opened in the demounting direction (the opposite direction to the mounting direction X) and the thickness direction Z is recessed in the mounting unit 252. In the connection concave portion 253, a projection 254 projecting in the demounting direction and a cylindrical discharge portion 255 discharging the waste liquid protrude to be arranged in the width direction Y. A connection hole 256 communicating with the connection tube 251 is formed in the discharge portion 255.

A substrate connection portion 257 electrically connected to the control unit 263 (see FIG. 25) is joined to the projection 254. The substrate connection portion 257 includes a movable contact portion 257*a* which can be elastically deformed by a contact pressure. The movable contact portion 257*a* projects from the projection 254 in the thickness direction Z when an external force is not received, and the movable contact portion 257*a* is elastically deformed in a direction close to the projection 254 when an external force is received.

The projection 254 includes a pair of engaging projection 258 formed to project in the width direction Y. The pair of engaging projections 258 is disposed at positions at which the substrate connection portion 257 is interposed therebetween in the width direction Y. The substrate connection portion 257 projects more than the engaging projections 258 in the demounting direction, and the engaging projections 258 protrude more than the substrate connection portion 257 in the thickness direction Z.

In the engaging projection 258, as illustrated in FIG. 30, an concave portion is recessed which has engaging surfaces 258*a* and 258*c* extending in the mounting direction X and the width direction Y and facing each other, an engaging surface 258*b* extending in the mounting direction X and the thickness direction Z and intersecting the engaging surfaces 258*a* and 258*c*. The engaging surface 258*a* faces in the thickness direction Z and the engaging surface 258*c* faces in the opposite direction to the thickness direction Z. A front end surface 258*d* of the engaging projection 258 intersecting the engaging surfaces 258*a*, 258*b*, and 258*c* extends in the width direction Y and the thickness direction Z. The center of the connection hole 256 is located on a plane (which is an imaginary surface indicated by a one-dot chain line in FIG. 30) including the engaging surface 258*c*.

The configuration of the attachment 281 will be described in detail with reference to FIGS. 31 and 32.

In the embodiment, when L1 is the length of the attachment 281 in the mounting direction X, L2 is the length of the attachment 281 in the width direction Y, and L3 is the length (thickness) of the attachment 281 in the thickness direction Z, "L1>L2>L3" is satisfied. That is, the attachment 281 has an externally thin shape of which a longitudinal direction is the mounting direction X and of which a length in the thickness direction Z is short. Therefore, the attachment 281 is properly mounted on the thin liquid ejecting apparatus 211.

Figure 31:
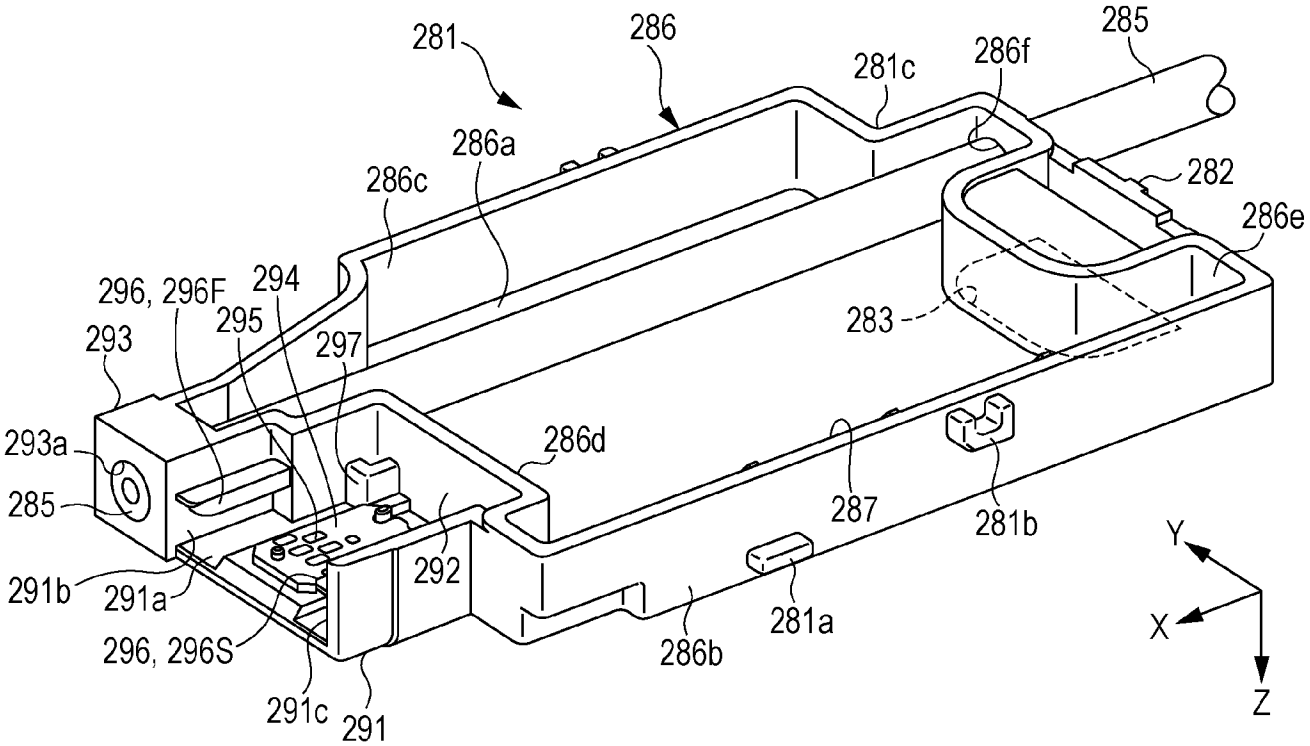
FIG. 31 is a perspective view illustrating the attachment.

As illustrated in FIG. 31, the attachment 281 includes a discharge tube 285 through which the waste liquid discharged from the discharge portion 255 flows up to the waste liquid containing unit 310 and a case member 286 that accommodates the discharge tube 285.

As illustrated in FIG. 31, the case member 286 includes a bottom wall portion 286*a* which forms an inner bottom surface extending in a direction intersecting the thickness direction Z, a pair of side wall portions 286*b* and 286*c* which extends in the mounting direction X and the thickness direction Z and intersects the bottom wall portion 286*a*, and a front wall portion 286*d* and a rear wall portion 286*e* which intersect the wall portions 286*a*, 286*b*, and 286*c*. A tube accommodation portion 287 is formed by the wall portions 286*a*, 286*b*, 286*c*, 286*d*, and 286*e*.

The case member 286 includes a convex portion 291 projecting from the tube accommodation portion 287 in the mounting direction X in one end (front end) thereof in the mounting direction X. Both ends of the convex portion 291 in the width direction Y are disposed more inside in the width direction Y than the side wall portions 286*b* and 286*c* formed at both ends of the tube accommodation portion 287 in the width direction Y. An escape notch 281*c* formed by notching one corner in the width direction Y is formed at the other end (rear end) of the case member 286 in the mounting direction X.

As illustrated in FIG. 28, when the attachment 281 is mounted on the mounting unit 252 and the opening/closing lid 247 is closed, one pair of locking claws 247*a* formed in the opening/closing lid 247 is received in a gap formed by forming the convex portion 291 and the escape notch 281*c* in the case member 286. Further, to correspond to the reception of the locking claws 247*a*, the corner which is a connection portion between the side wall portion 286*c* and the convex portion 291 is notched at the front end of the case member 286.

As illustrated in FIG. 31, an insertion hole 286*f* communicating with the inside and outside of the tube accommodation portion 287 is formed in the rear wall portion 286*e* of the case member 286 to penetrate in the mounting direction X. The discharge tube 285 is inserted into the insertion hole 286*f*.

Figure 32:
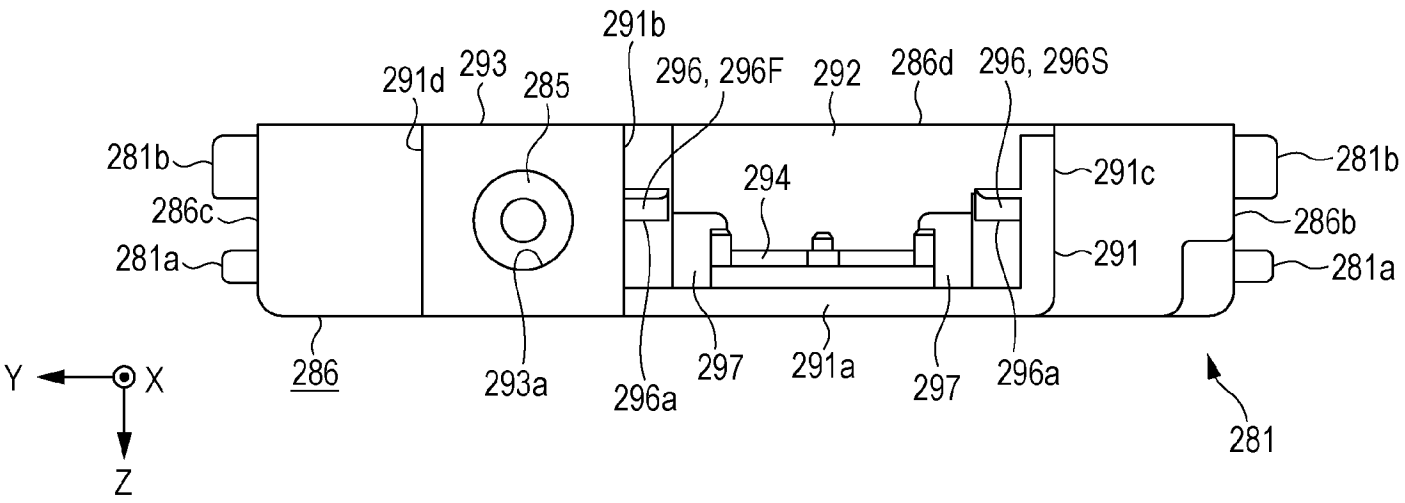
FIG. 32 is a side view illustrating the attachment when viewed in an anti-mounting direction.

As illustrated in FIGS. 31 to 32, the guide protrusions 281*a* and 281*b* protrude to the side wall portions 286*b* and 286*c* of the case member 286 to project toward the outside in the width direction Y. The guide protrusion 281*b* is disposed at a position closer to the opening of the tube accommodation portion 287 than the guide protrusion 281*a* in the thickness direction Z. The guide protrusion 281*a* is disposed at a position closer to the convex portion 291 than the guide protrusion 281*b* in the mounting direction X.

In the convex portion 291, as illustrated in FIG. 31, a connection concave portion 292 opened in the opposite direction to the thickness direction Z and the mounting direction X and a waste liquid introduction portion 293 extending in the mounting direction X are formed to be arranged in the width direction Y. The end of the waste liquid introduction portion 293 in the demounting direction communicates with the tube accommodation portion 287 and the end of the waste liquid introduction portion 293 in the mounting direction X is opened to the front end surface of the convex portion 291. The waste liquid introduction portion 293 includes an insertion opening 293*a* opened in the mounting direction X. The end of the discharge tube 285 is fitted to the insertion opening 293*a* of the waste liquid introduction portion 293.

The convex portion 291 includes a first wall portion 291*a* which is formed to extend from the bottom wall portion 286*a*, a second wall portion 291*b* which intersects the first wall portion 291*a* and forms a part of the wall surface of the waste liquid introduction portion 293, a third wall portion 291*c* which intersects the first wall portion 291*a* and is disposed at a position confronting the second wall portion 291*b*, and a fourth wall portion 291*d* (see FIG. 32) which forms a part of the wall surface of the waste liquid introduction portion 293. The wall portions 291*a*, 291*b*, and 291*c* and the front wall portion 286*d* form the connection concave portion 292.

In the first wall portion 291*a*, a circuit substrate 294 including connection terminals 295 is joined to be detachably mounted and to be located inside the connection concave portion 292. The circuit substrate 294 includes a memory element that stores information (=information regarding the amount of waste liquid contained in the waste liquid containing unit 310) regarding the amount of waste liquid discharged from the discharge portion 255.

Inside the connection concave portion 292, a pair of guide portions 296 (296F and 296S) are formed so that the connection terminals 295 are interposed therebetween in the width direction Y. Of the pair of guide portions 296F and 296S, one guide portion 296F protrudes to the second wall portion 291*b* to project toward the inside of the connection concave portion 292 and the other guide portion 296S protrudes to the third wall portion 291*c* to project toward the inside of the connection concave portion 292. That is, at one end (front end) of the case member 286, the guide portion 296F is disposed between the connection terminals 295 and the waste liquid introduction portion 293 in the width direction Y.

As illustrated in FIG. 32, one pair of guide portions 296 (296F and 296S) each includes a guide surface 296*a* extending in the mounting direction X and the width direction Y. The guide surface 296*a* is oriented in the opposite direction (the thickness direction Z) to the connection terminals 295. An opening center (the center of the insertion opening 293*a*) of the waste liquid introduction portion 293 is located on a plane (which is an imaginary surface indicated by a one-dot chain line in FIG. 32) including the two guide surfaces 296*a*.

As illustrated in FIGS. 31 and 32, a pair of regulation protrusions 297 projecting in the mounting direction X more than the front wall portion 286*d* is formed on the inner rear side of the connection concave portion 292 more than the connection terminals 295. The regulation protrusions 297 are located between the guide portions 296 and the front wall portion 286*d* in the mounting direction X.

Figure 33:
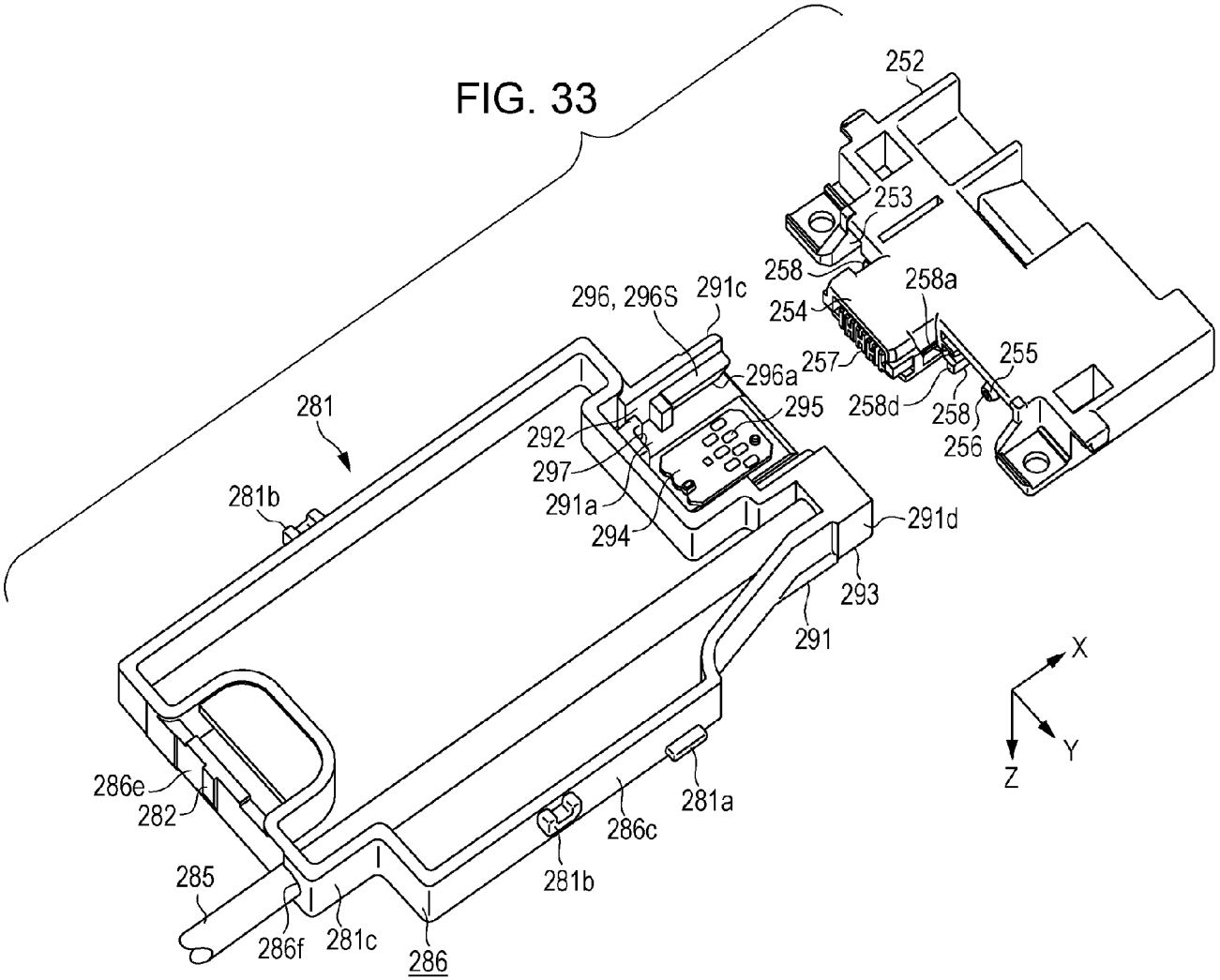
FIG. 33 is a perspective view illustrating the mounting unit and the attachment before the mounting.

As illustrated in FIG. 33, the connection concave portion 292 of the attachment 281 is opened in the mounting direction X and is formed at one end (front end) of the attachment 281 in the mounting direction X to be inserted to the projection 254 at the time of the mounting on the mounting unit 252. On the other hand, the connection concave portion 253 of the mounting unit 252 is opened in the demounting direction to be insertable to the convex portion 291 formed at one end of the attachment 281.

As illustrated in FIG. 24, the waste liquid containing unit 310 is formed in a substantially rectangular box-like shape and is formed as a separate body from the attachment 281. The waste liquid containing unit 310 includes a waste liquid containing chamber 301 that contains the waste liquid therein. In the waste liquid containing unit 310, as illustrated in FIG. 27, an insertion opening 302 communicating with the inside and outside of the waste liquid containing chamber 301 is formed on the side surface on the side of the casing unit 212. The discharge tube 285 extending from the attachment 281 is fitted to the insertion opening 302. Thus, the waste liquid discharged from the discharge portion 255 of the mounting unit 252 is contained in the waste liquid containing unit 310 via the discharge tube 285 of the attachment 281. From this viewpoint, in the embodiment, an example of a "waste liquid recovery unit" is configured to include the attachment 281, the discharge tube 285, and the waste liquid containing unit 310.

Here, as illustrated in FIG. 28, the discharge tube 285 is formed along the bottom surface of the casing unit 212. The discharge tube 285 is formed at a position corresponding to the notch 247*c* of the opening/closing lid 247. Thus, even when the discharge tube 285 is disposed at the close position in the opening/closing lid 247, the connection state of the attachment 281 and the waste liquid containing unit 310 can be maintained.

A leakage suppression member such as a seal member may be formed in the insertion opening 302 so that the waste liquid contained in the waste liquid containing unit 310 does not leak from the insertion opening 302, or a waste liquid absorber absorbing the waste liquid may be installed inside the waste liquid containing unit 310.

Next, an operation of the liquid ejecting apparatus 211 will be described focusing on the mounting unit 252 and the attachment 281.

Figure 34:
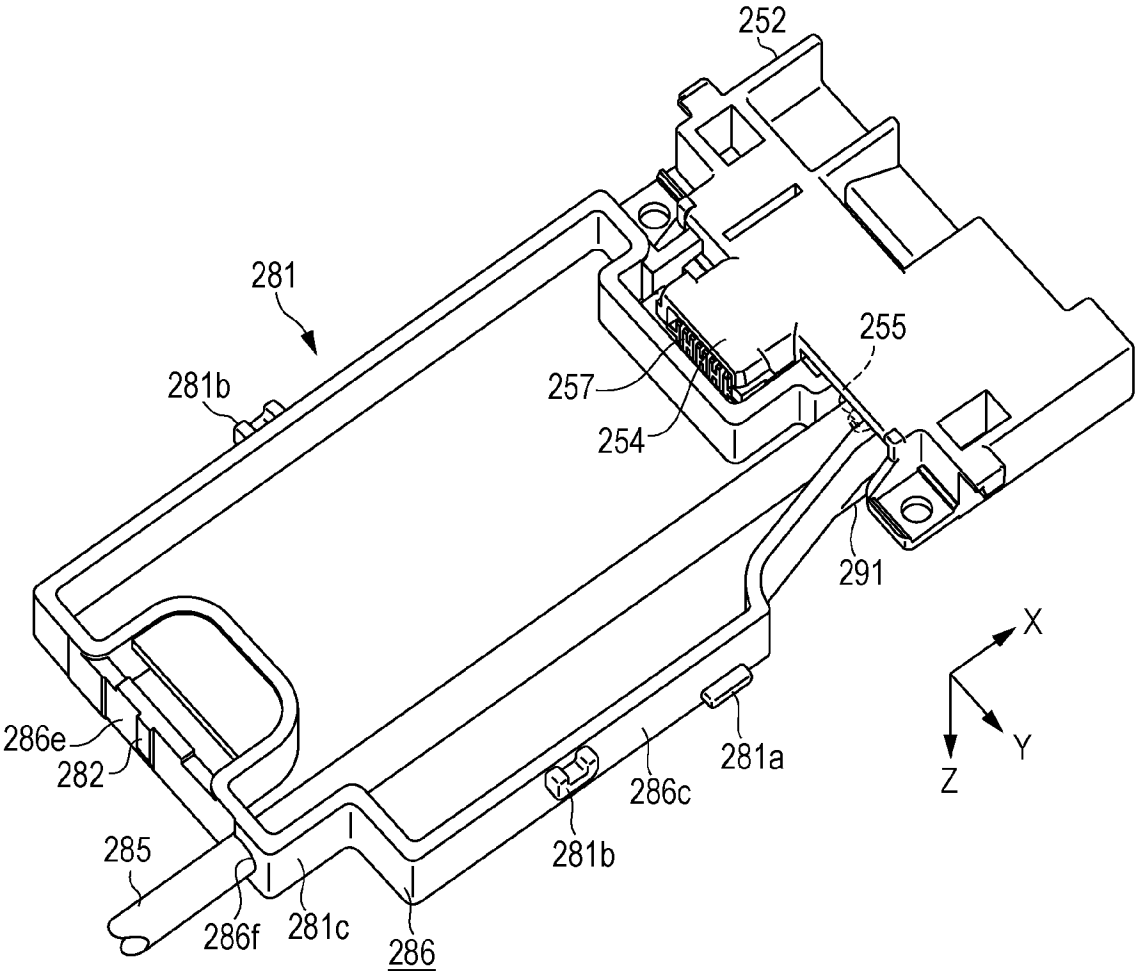
FIG. 34 is a perspective view illustrating the mounting unit and the attachment after the mounting.

As illustrated in FIG. 33, when the attachment 281 is moved toward the mounting unit 252 in the mounting direction X in order to mount the attachment 281 on the mounting unit 252, the convex portion 291 of the attachment 281 is inserted into the connection concave portion 253 of the mounting unit 252 and the projection 254 is inserted into the connection concave portion 292 of the attachment 281. As a result, as illustrated in FIG. 34, the attachment 281 is mounted on the mounting unit 252.

At this time, as illustrated in FIG. 33, one pair of guide portions 296 formed inside the connection concave portion 292 guides the projection 254 so that the positions of the connection terminals 295 are aligned with the substrate connection portion 257 and the position of the waste liquid introduction portion 293 (the discharge tube 285) is aligned with the discharge portion 255.

Figure 35:
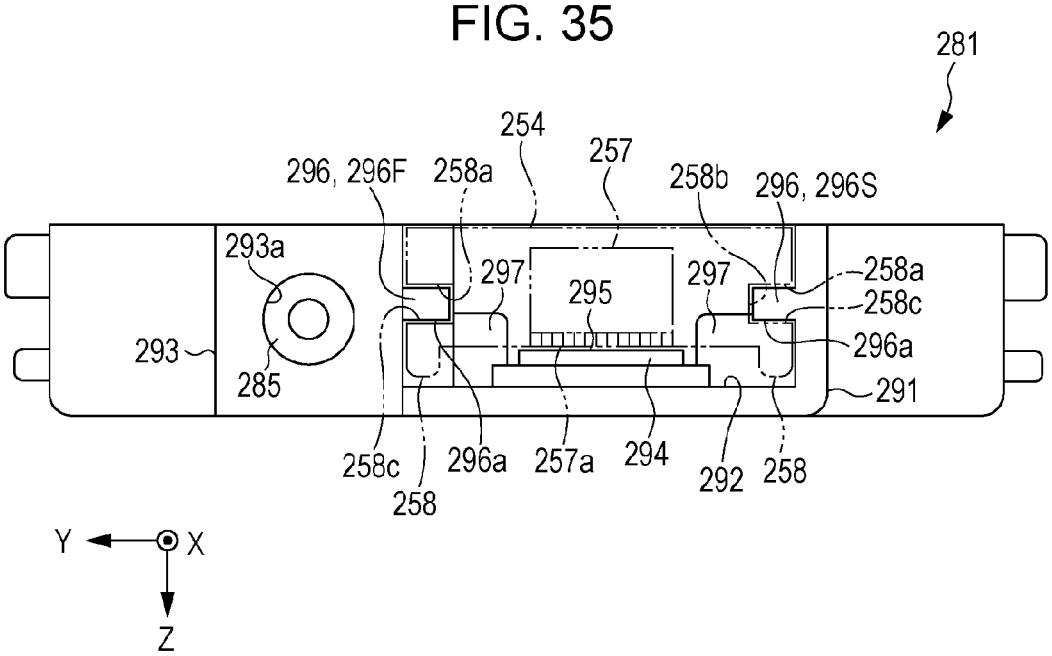
FIG. 35 is a schematic view illustrating a mounting form of the mounting unit and the attachment.

Specifically, as illustrated in FIG. 35, the guide portions 296 are inserted into the concave portion formed by the engaging surfaces 258*a*, 258*b*, and 258*c* of the engaging projection 258 formed in the projection 254. The guide portions 296 formed in a convex shape are moved in the mounting direction X along the engaging surfaces 258*a*, 258*b*, and 258*c* formed in a concave shape so that the guide surfaces 296*a* of the guide portions 296 face the engaging surface 258*c*. That is, the guide portions 296 are directly moved in the mounting direction X so that the movement in the opposite direction to the thickness direction Z is suppressed by the engaging surface 258*a*, the movement in the thickness direction Z is suppressed by the engaging surface 258*c*, and the movement in the width direction Y is suppressed by the engaging surface 258*b*.

Here, since one pair of guide portions 296 is formed with the connection terminals 295 therebetween in the width direction Y, the projection 254 is guided by one pair of guide portions 296 so that the positions of the connection terminals 295 can be aligned with the substrate connection portion 257. The one guide portion 296F is disposed between the connection terminals 295 and the waste liquid introduction portion 293 (the end of the discharge tube 285) in the width direction Y, the projection 254 is guided by the guide portion 296F so that the position of the waste liquid introduction portion 293 can be aligned with the discharge portion 255. Thus, the position alignment of the connection terminals 295 to the substrate connection portion 257 and the position alignment of the waste liquid introduction portion 293 (the end of the discharge tube 285) to the discharge portion 255 are performed by one pair of guide portions 296.

Then, when the regulation protrusions 297 of the attachment 281 collide with the front end surface 258*d* of the engaging projection 258, the movement of the attachment 281 in the mounting direction X is regulated and the mounting of the attachment 281 on the mounting unit 252 is completed. The position of the attachment 281 at this time is referred to as a "mounted position."

Thus, the front end surface 258*d* of the engaging projection 258 and the regulation protrusions 297 function as a positioning unit that stops the attachment 281 moved in the mounting direction X at the mounted position. The movement of the attachment 281 in the mounting direction X can also be regulated by causing the projection 254 to collide with the front wall portion 286*d* without forming the regulation protrusions 297. However, when the regulation protrusions 297 and the engaging projections 258 are formed to decrease a contact area of the attachment 281 and the projection 254, accuracy of the positioning is improved.

Figure 36:
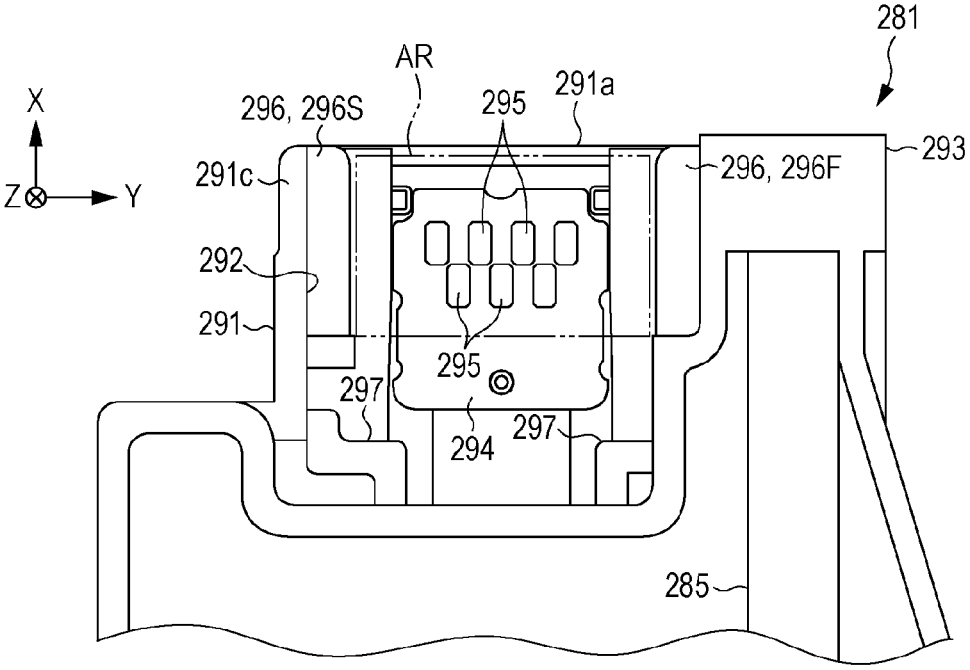
FIG. 36 is a top view illustrating the attachment when viewed from the vertical upper side.

As illustrated in FIG. 36, it is preferable to dispose the connection terminals 295 so that the connection terminals 295 face a region AR (indicated by a two-dot chain line in FIG. 36) between the one guide portion 296F and the other guide portion 296S of the one pair of guide portions 296. Thus, the positions of the connection terminals 295 can be accurately aligned with the substrate connection portion 257 more than when the region AR and the connection terminals 295 are distant in the mounting direction X.

As illustrated in FIG. 35, when the attachment 281 is located at the mounted position, the movable contact portion 257*a* of the substrate connection portion 257 comes into contact with the connection terminals 295 by a predetermined contact pressure to be elastically displaced and the connection terminals 295 are electrically connected to the substrate connection portion 257. Thus, the circuit substrate 294 is electrically connected to the control unit 263, and thus information regarding the amount of waste liquid contained in the waste liquid containing unit 310 can be transmitted between the circuit substrate 294 and the control unit 263.

When the attachment 281 is located at the mounted position, the guide surface 296*a* of the one pair of guide portions 296 engages with the engaging surface 258*c* formed in the projection 254 by an elastic restoration force of the movable contact portion 257*a* pressed and elastically displaced by the connection terminals 295. Therefore, the connection terminals 295 are also moved in the direction distant from the substrate connection portion 257 by the elastic restoration force of the movable contact portion 257*a* and the guide surface 296*a* engages with the engaging surface 258*c* so that the movement of the connection terminals 295 is suppressed. As a result, the state in which the connection terminals 295 come into contact with the movable contact portion 257*a* by a predetermined contact pressure is maintained.

Since the connection terminals 295 are disposed in parallel to a plane (which is an imaginary surface indicated by a one-dot chain line in FIG. 35) including one pair of guide surfaces 296*a* to form a plane, contact pressures with the plurality of movable contact portions 257*a* projecting in the thickness direction become uniform.

The center of the connection hole 256 of the discharge portion 255 is located on the plane (which is the imaginary surface indicated by the one-dot chain line in FIG. 35) including two engaging surfaces 258*c*, and the opening center of the waste liquid introduction portion 293 is located on the plane (which is the imaginary surface indicated by the one-dot chain line in FIG. 35) including the two guide surfaces 296*a*. Therefore, when the attachment 281 is moved to the mounted position, the engaging surface 258*c* and the guide surface 296*a* facing each other come into contact with each other by the elastic restoration force of the movable contact portion 257*a* so that the center position of the connection hole 256 and the center position of the waste liquid introduction portion 293 are disposed on the same plane. Thus, since the center position of the connection hole 256 matches the center position of the waste liquid introduction portion 293 in the thickness direction Z, the positions of the waste liquid introduction portion 293 and the discharge portion 255 can be aligned more accurately, and then the discharge portion 255 can be inserted into the waste liquid introduction portion 293 (the end of the discharge tube 285).

With the movement of the attachment 281 to the mounted position, the discharge portion 255 is inserted into the end of the discharge tube 285 via the insertion opening 293*a* so that the discharge portion 255 and the waste liquid containing unit 310 are connected via the attachment 281. Thus, the waste liquid discharged from the discharge portion 255 can be introduced to the waste liquid containing unit 310.

Here, the information regarding the waste liquid discharged from the discharge portion 255 to the attachment 281 is transmitted from the control unit 263 to the circuit substrate 294 to be stored in the memory element included in the circuit substrate 294 whenever maintenance such as suction cleaning is performed. On the other hand, when the control unit 263 reads the information regarding the amount of waste liquid stored in the memory element of the circuit substrate 294 at a predetermined timing and determines that the amount of waste liquid contained in the waste liquid containing unit 310 reaches a given value, the control unit 263 displays, for example, the fact that the amount of waste liquid reaches the given value on the display unit 262 to prompt the user to exchange the waste liquid containing unit 310. Here, the given value refers to, for example, the maximum amount of waste liquid which can be contained by the waste liquid containing unit 310.

As illustrated in FIG. 36, in the attachment 281, the waste liquid introduction portion 293 and the connection terminals 295 are arranged in the width direction Y. Therefore, even when the attachment 281 is mounted so that the thickness direction Z is the gravity direction and the waste liquid leaks from the waste liquid introduction portion 293, the leaking waste liquid is rarely adhered to the connection terminals 295. Therefore, for example, when the attachment 281 is detached from the liquid ejecting apparatus 211 and the attachment 281 is mounted on the liquid ejecting apparatus 211 again, occurrence of a contact failure of the connection terminals 295 and the substrate connection portion 257 caused due to the adhering of the waste liquid to the connection terminals 295 is suppressed.

By connecting the connection terminals 295 to the substrate connection portion 257, the waste liquid is allowed to be discharged from the discharge portion 255 by the control unit 263 and maintenance can be performed to discharge the waste liquid to the cap 242. When the waste liquid is discharged from the liquid ejecting unit 231 to the cap 242 through suction cleaning or flushing, the waste liquid is discharged to the waste liquid containing unit 310 via the connection tube 251, the discharge portion 255, and the discharge tube 285 with the driving of the suction mechanism 244. Thus, in the embodiment, by mounting the attachment 281 including the discharge tube 285 on the mounting unit 252, it is possible to contain the waste liquid discharged from the discharge portion 255 to the large-sized waste liquid containing unit 310 installed as the separate body from the casing unit 212 and the attachment 281.

According to the foregoing embodiment, the following advantages can be obtained.

(1) When the attachment 281 is moved in the mounting direction X to be mounted on the mounting unit 252, the projection 254 is inserted into the connection concave portion 292 of the attachment 281 so that the positions of the connection terminals 295 recessed in the connection concave portion 292 can be substantially aligned with the position of the substrate connection portion 257 recessed in the projection 254. Subsequently, the projection 254 is guided by the pair of guide portions 296 in the connection concave portion 292, so that the positions of the connection terminals 295 are accurately aligned with the substrate connection portion 257. Accordingly, the attachment 281 can be mounted on the mounting unit 252 while the position of the attachment 281 is aligned with the substrate connection portion 257 and the discharge portion 255 of the waste liquid formed in the mounting unit 252.

When the attachment 281 is mounted on the mounting unit 252, the connection terminals 295 are accurately connected to the substrate connection portion 257, so that the waste liquid is allowed to be discharge from the discharge portion 255. As a result, the waste liquid discharged from the discharge portion 255 is discharged to the waste liquid containing unit 310 which is the separate body from the casing unit 212. Accordingly, the more waste liquid can be discharged from the discharge portion 255 to the waste liquid containing unit 310 of which the size is increased by forming the waste liquid containing unit 310 as the separate body from the attachment 281.

(2) One of the pair of guide portions 296 is disposed between the connection terminals 295 and the waste liquid introduction portion 293 in the width direction Y. Therefore, when the positions of the connection terminals 295 are aligned, the position of the waste liquid introduction portion 293 can be aligned.

(3) By protruding the one guide portion 296F on the second wall portion 291*b* forming the waste liquid introduction portion 293 and the connection concave portion 292, the distances between the waste liquid introduction portion 293 and the guide portions 296 are shortened. Thus, the position of the waste liquid introduction portion 293 can be accurately aligned by the guide portions 296.

(4) The opening center of the waste liquid introduction portion 293 is located on the plane including the guide surface 296*a* of the one pair of guide portions 296. Therefore, the guide surface 296*a* guides the projection 254 formed in the mounting unit 252, and thus the position of the waste liquid introduction portion 293 can be aligned in the thickness direction Z intersecting both of the mounting direction X and the width direction Y.

(5) At least some of the connection terminals 295 are disposed to face the region AR between the guide portions 296F and 296S. Therefore, the positions of the connection terminals 295 can be accurately aligned with the substrate connection portion 257 more than when the region AR and the connection terminals 295 are distant from each other in the mounting direction X.

(6) When the attachment 281 is mounted on the mounting unit 252, the guide portions 296 and the projection 254 engage with each other by the elastic restoration force of the movable contact portion 257*a* pressed by the connection terminals 295, so that the state in which the movable contact portion 257*a* comes into contact with the connection terminals 295 by the predetermined contact pressure can be maintained. Thus, for example, even when the attachment 281 is slightly moved due to vibration or the like, the state in which the connection terminals 295 are electrically connected to the substrate connection portion 257 can be maintained.

(7) Since the discharge tube 285 connects the attachment 281 to the waste liquid containing unit 310, the degree of freedom of the disposition of the waste liquid containing unit 310 with respect to the liquid ejecting apparatus 211 can be improved by dragging the discharge tube 285 freely.

Third Embodiment

Hereinafter, a third embodiment of the liquid ejecting apparatus will be described. The liquid ejecting apparatus according to the third embodiment is different from the liquid ejecting apparatus according to the second embodiment mainly in the shape of an attachment and disposition of a waste liquid containing unit. Accordingly, in the following description, the same reference numerals are given to configurations of members common to the members in the second embodiment and the description thereof will be simplified and omitted.

Figure 37:
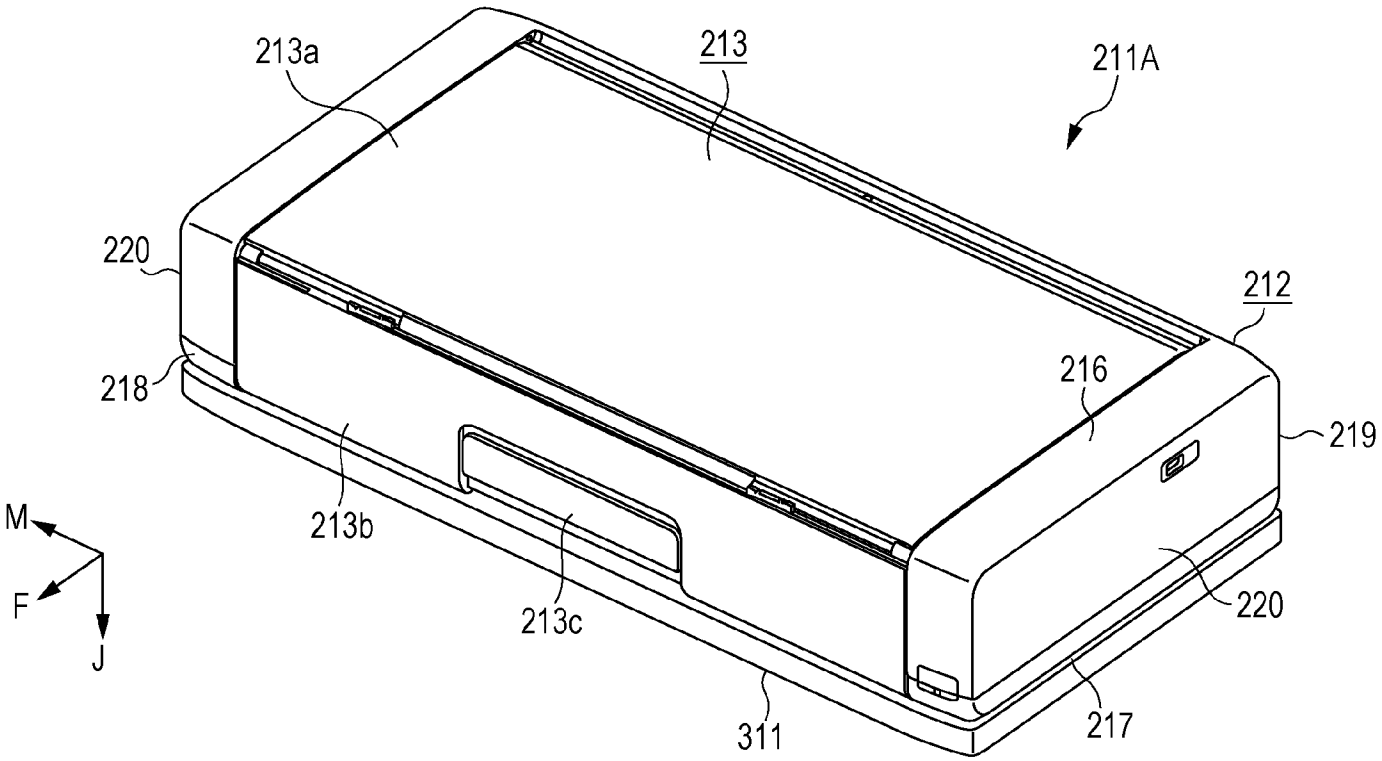
FIG. 37 is a perspective view illustrating a liquid ejecting apparatus according to a third embodiment.

As illustrated in FIG. 37, a liquid ejecting apparatus 211A according to the third embodiment includes a casing unit 212 and a waste liquid containing unit 311 installed vertically more downward than the casing unit 212 (in the ejection direction J). That is, in the third embodiment, the liquid ejecting apparatus 211A is configured so that the casing unit 212 is mounted vertically more upward than the waste liquid containing unit 311.

Figure 38:
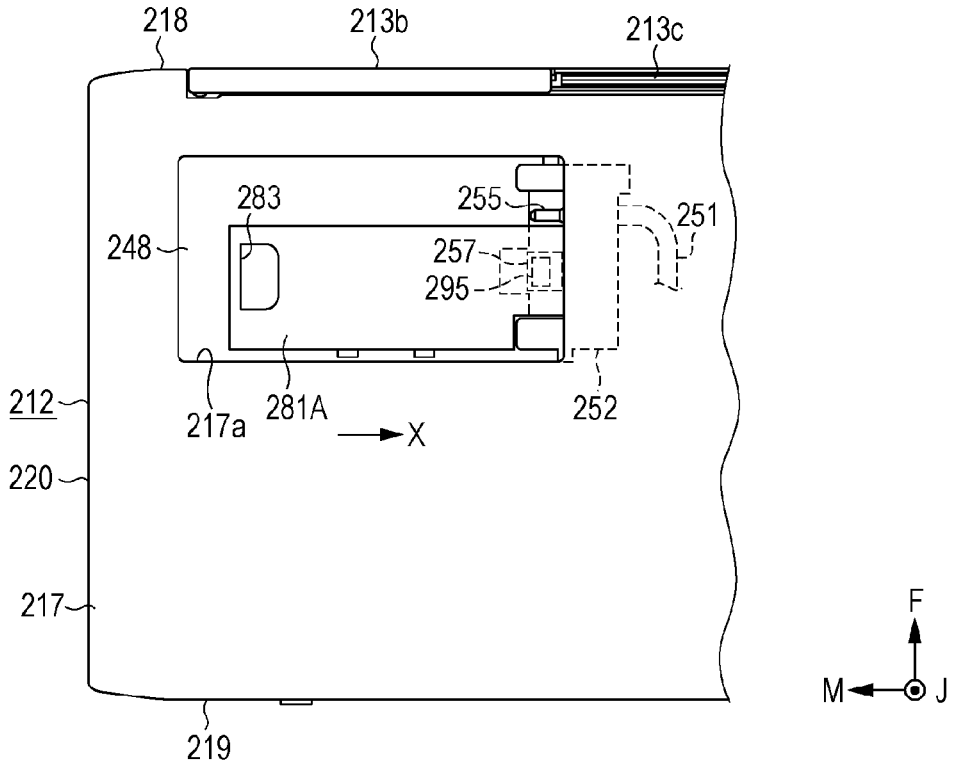
FIG. 38 is a partial bottom view illustrating a casing portion of the liquid ejecting apparatus.

As illustrated in FIG. 38, the mounting opening 217*a* is opened in the bottom surface of the casing unit 212. That is, since the opening/closing lid 247 closing the mounting opening 217*a* is not formed on the bottom wall 217 of the casing unit 212, a partial configuration of the mounting unit 252 or an attachment 281A mounted on the mounting unit 252 is exposed.

Figure 39:
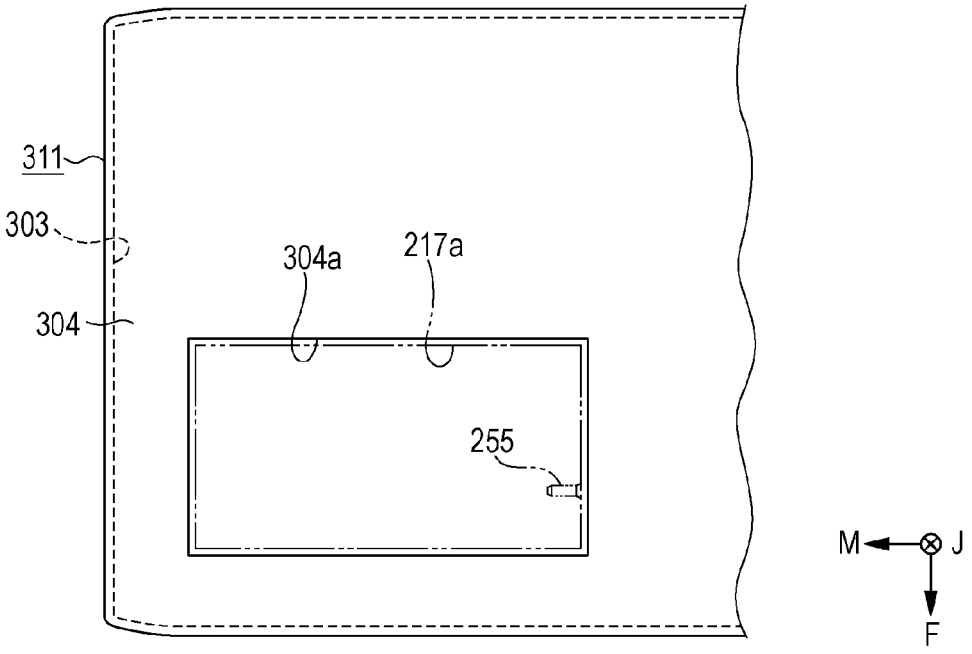
FIG. 39 is a partial top view illustrating the waste liquid container.

As illustrated in FIGS. 37 and 39, the waste liquid containing unit 311 has a substantially rectangular box-like shape of which a length dimension in the movement direction M and the transport direction F is substantially the same as the casing unit 212. As illustrated in FIG. 39, the waste liquid containing unit 311 includes a waste liquid containing chamber 303 which can contain the waste liquid. In a top surface portion 304 of the waste liquid containing unit 311 mutually facing the bottom wall 217 of the casing unit 212, an opening 304*a* greater than the mounting opening 217*a* is formed at a position corresponding to the mounting opening 217*a*. Thus, the waste liquid containing chamber 303 communicates with the outside via the opening 304*a*. In FIG. 39, in order to show a disposition relation between the mounting opening 217*a* and the discharge portion 255 when the casing unit 212 is mounted on the top surface portion 304 of the waste liquid containing unit 311, such a member configuration is indicated by a two-dot chain line.

Figure 40:
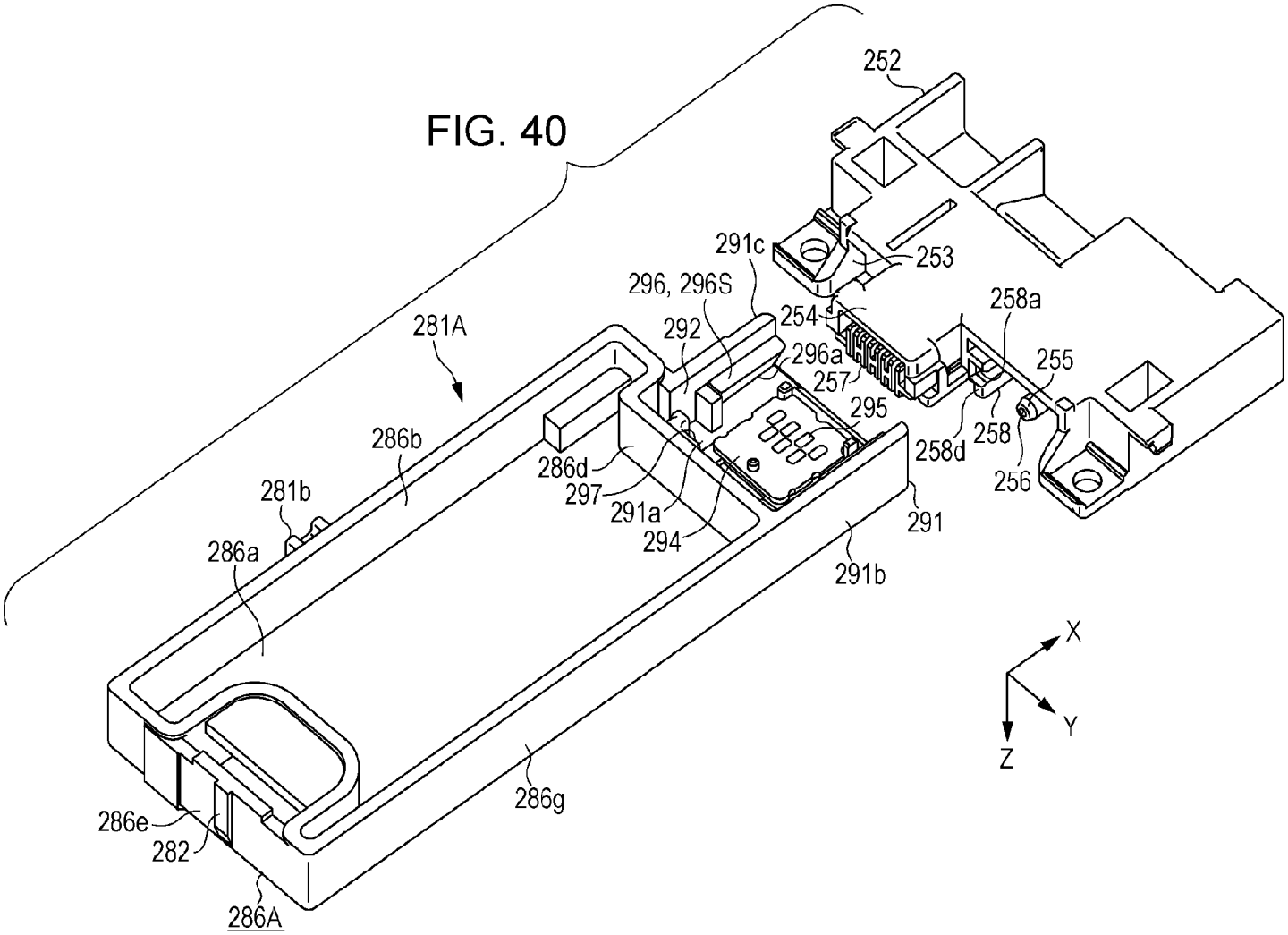
FIG. 40 is a perspective view illustrating a mounting form of the attachment according the third embodiment.

As illustrated in FIG. 40, the attachment 281A according to the third embodiment includes a case member 286A which may not accommodate the discharge tube 285 of the second embodiment. The case member 286A includes a bottom wall portion 286*a* which forms an inner bottom surface extending in the direction intersecting the thickness direction Z, a pair of side wall portions 286*b* and 286*g* which extend in the mounting direction X and the thickness direction Z and intersects the bottom wall portion 286*a*, and a front wall portion 286*d* and a rear wall portion 286*e* which intersect the wall portions 286*a*, 286*b*, and 286*g*.

Here, the side wall portion 286*g* of the case member 286A is integrated with the second wall portion 291*b* forming the connection concave portion 292. Therefore, the case member 286A according to the third embodiment may not accommodate a discharge tube. That is, even when the attachment 281A is mounted on the mounting unit 252, as illustrated in FIG. 38, the discharge portion 255 is exposed.

Next, an operation of the liquid ejecting apparatus 211A related to the mounting unit 252 and the attachment 281A will be described.

As illustrated in FIG. 40, when the attachment 281A is moved toward the mounting unit 252 in the mounting direction X in order to mount the attachment 281A on the mounting unit 252, the convex portion 291 of the attachment 281A is inserted into the connection concave portion 253 of the mounting unit 252 and the projection 254 is inserted into the connection concave portion 292 of the attachment 281A. At this time, as illustrated in FIG. 40, one pair of guide portions 296 formed inside the connection concave portion 292 guides the projection 254 so that the positions of the connection terminals 295 are aligned with the substrate connection portion 257.

By connecting the connection terminals 295 to the substrate connection portion 257, the waste liquid is allowed to be discharged from the discharge portion 255 by the control unit 263 and maintenance can be performed to discharge the waste liquid to the cap 242. When the waste liquid is discharged from the liquid ejecting unit 231 to the cap 242 through suction cleaning or flushing, the waste liquid is discharged from the discharge portion 255 via the connection tube 251 with the driving of the suction mechanism 244.

Here, in the third embodiment, as illustrated in FIG. 39, the opening 304*a* of the waste liquid containing unit 311 is opened vertically more downward than the discharge portion 255. Therefore, the waste liquid discharged from the discharge portion 255 drops (flows downward) to the waste liquid containing unit 311 via the opening 304*a* to be contained in the waste liquid containing chamber 303. Thus, in the embodiment, by mounting the attachment 281A on the mounting unit 252, the waste liquid can be contained in the large-sized waste liquid containing unit 311 installed as the separate body from the casing unit 212 (the mounting unit 252). From this viewpoint, in the third embodiment, an example of a "waste liquid recovery unit" is configured to include the attachment 281A and the waste liquid containing unit 311.

According to the third embodiment, the following advantage can be obtained in addition to the advantages (1), (5), and (6) of the second embodiment.

(8) The attachment 281A and the waste liquid containing unit 311 is installed as the separate bodies without physical connection. Therefore, when the waste liquid may not be contained in the waste liquid containing unit 311, only the waste liquid containing unit 311 may be exchanged. Therefore, since it is not necessary to detach the attachment 281A from the mounting unit 252, it is possible to further reduce the labor related to the exchange of the waste liquid containing unit 311.

The foregoing embodiment may be modified as in the following modification examples.

Figure 41:
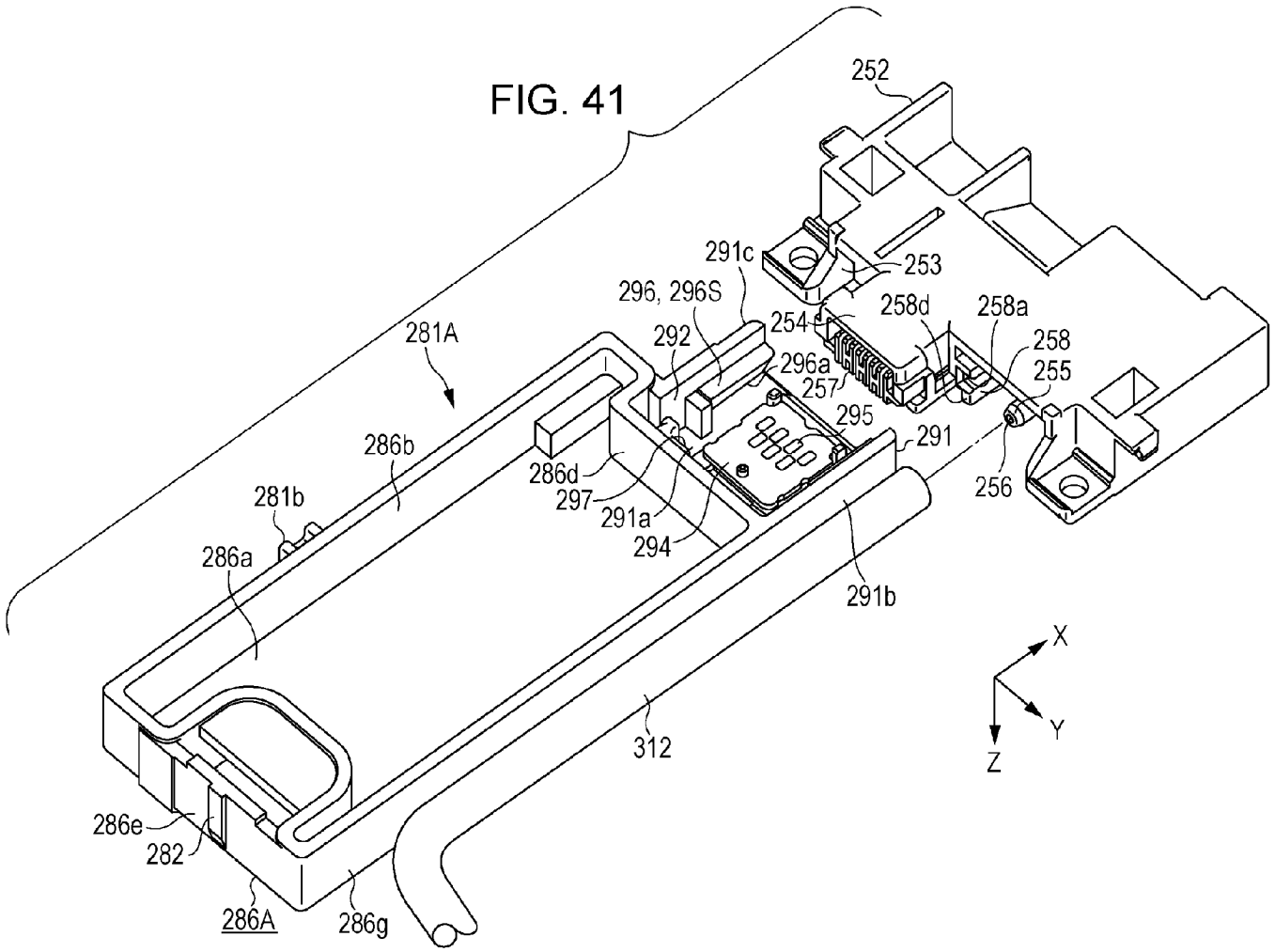
FIG. 41 is a perspective view illustrating a mounting form of the attachment according to a modification example.

As illustrated in FIG. 41, the attachment 281A and the discharge tube 312 may be separately mounted on the mounting unit 252. In this case, the discharge tube 312 preferably connects the discharge portion 255 to the waste liquid containing unit 310 or 311.

The waste liquid containing unit 310 or 311 may be a container of an open system or may be a container of a close system. The waste liquid containing unit 310 or 311 may be a container with a bag shape or may be a container with a dish shape.

The waste liquid containing unit 310 or 311 may be configured to be fixed to be unmovable to the casing unit 212. For example, the waste liquid containing unit 310 or 311 may be fixed to the outside walls 220 of the casing unit 212 by fastening members such as bolts.

The liquid ejecting apparatus 211 may be a liquid ejecting apparatus on which a waste liquid containing cartridge capable of containing the waste liquid is detachably mounted on the mounting unit 252. A liquid waste containing cartridge mounted on the liquid ejecting apparatus 211 may be substituted with and the attachment 281 or 281A may be mounted. Thus, even in the liquid ejecting apparatus in which the waste liquid is discharge to the waste liquid containing cartridge, the waste liquid can be discharged to the waste liquid containing unit 310 or 311 via the attachment 281 or 281A. That is, even in the liquid ejecting apparatus, the more waste liquid can be discharged from the discharge portion 255.

In this case, as the circuit substrates 294 joined to the connection concave portions 292 of the attachments 281 and 281A, circuit substrates joined to the waste liquid containing cartridges may be used or other circuit substrates may be used.

Here, since the same circuit substrates as the circuit substrates joined to the waste liquid containing cartridges are joined to the attachments 281 and 281A to be used, the control unit of the liquid ejecting apparatus may erroneously recognize that the waste liquid containing cartridges are mounted on the mounting units 252 despite the fact that the attachments 281 and 281A are mounted on the mounting units 252.

Then, in this case, even when the waste liquid containing unit 310 or 311 connected to the attachment 281 or 281A can further contain the amount of waste liquid, the user is assumed to be prompted to exchange the waste liquid containing cartridge. Accordingly, in this case, the attachment 281 or 281A may be detached from the mounting unit 252, the circuit substrate joined to the attachment 281 or 281A may be exchanged with circuit substrate on which the information regarding the amount of waste liquid is not written, and the attachment 281 or 281A may be mounted on the mounting unit 252 again. Alternatively, when the attachment 281 or 281A is detached or attached, the information regarding the amount of waste liquid written on the memory element of the circuit substrate joined to the attachment 281 or 281A may be rewritten.

Thus, it is necessary to detach or attach the attachments 281 and 281A periodically. However, since it is not necessary to exchange the waste liquid containing unit 310 or 311 at the time of the detaching or mounting, it is possible to reduce the labor until restoration to the state in which the waste liquid can be discharged again, compared to the case in which the waste liquid containing cartridge containing the waste liquid is attached or detached.

In the second embodiment, the dragging form of the discharge tube 285 at the time of connection from the attachment 281 to the waste liquid containing unit 310 may be changed freely. For example, the discharge tube 285 may be dragged so that the attachment 281 is connected to the waste liquid containing unit 310 from the lower portion of the waste liquid containing unit 310 or the discharge tube 285 may be dragged so that the attachment 281 is connected to the waste liquid containing unit 310 from the upper portion of the waste liquid containing unit 310. By forming a hole or a notch in the casing unit 212, the discharge tube 285 may be inserted through the outside wall 220 of the casing unit 212 to be connected to the waste liquid containing unit 310.

In the third embodiment, a joint formed in a substantial L shape may be mounted on the discharge portion 255 so that the downstream end faces the waste liquid containing unit 311 without scattering of the waste liquid discharged from the discharge portion 255 in the demounting direction. In this case, the opening area of the opening 304*a* of the waste liquid containing unit 311 may be set to be an area corresponding to the cross-sectional area of the joint.

The engaging projection 258 formed in the mounting unit 252 may not have the concave portion and a convex engaging projection and a convex guide portion may engage with each other. Alternatively, the guide portion 296 included in the attachment 281 or 281A may be formed in a concave shape and the convex engaging projection may be inserted into the concave guide portion.

The attachment 281 or 281A may not include the convex portion 291 or the escape notch 281*c*.

In the attachment 281 or 281A, the guide portion 296F may be formed on a wall portion different from the second wall portion 291*b* forming the waste liquid introduction portion 293 and the connection concave portion 292. One pair of guide portions 296F and 296S may be formed to project outward from the convex portion 291 in the width direction Y. For example, in the attachment 281 or 281A, the guide portion 296F may be formed on the fourth wall portion 291*d* forming the waste liquid introduction portion 293 to project outward in the width direction Y. In this case, the guide portion 296S may be formed on the third wall portion 291*c* to project outward in the width direction Y.

In the attachment 281 or 281A, one pair of guide portions 296F and 296S may be formed on the second wall portion 291*b* and the fourth wall portion 291*d* forming the waste liquid introduction portion 293 to project outward in the width direction Y.

The liquid ejected by the liquid ejecting unit 231 is not limited to ink. For example, a liquid material in which particles of a functional material are dispersed or mixed may be used. For example, a liquid material containing a material such as an electrode material or a color material (pixel material) used to manufacture a liquid crystal display, an electroluminescence (EL) display, and a surface light emission display in a disperse or resolved form may be ejected to perform recording.

The medium is not limited to a sheet, but a plastic film, a thin plate, or the like may be used or a fabric used in a textile printing apparatus may be used.

What is claimed is:

1. A waste liquid container detachably mounted on a waste liquid container accommodation device which includes a discharge portion discharging a waste liquid and a substrate connection portion, the waste liquid container comprising:

a containing portion which is able to contain the waste liquid;

a waste liquid introduction portion which is connected to the discharge portion;

a circuit substrate which includes connection terminals electrically connected to the substrate connection portion; and a contact portion which is in contact with the waste liquid container accommodation device by a force which the circuit substrate receives.

2. The waste liquid container according to claim 1, wherein the contact portion is oriented in an opposite direction to the connection terminals.

3. The waste liquid container according to claim 1, wherein the contact portion which is provided at a circuit substrate side from the waste liquid introduction portion.

4. The waste liquid container according to claim 1, wherein the connection terminals are arranged between the waste liquid introduction portion and the contact portion.

5. The waste liquid container according to claim 1, wherein the connection terminals face upward in a state where the waste liquid container is mounted to the waste liquid container accommodation portion.

6. The waste liquid container according to claim 5, wherein the circuit substrate and the waste liquid introduction portion are located so as to be aligned in a width direction intersecting a direction in which the connection terminals face.

7. The waste liquid container according to claim 1, wherein the waste introduction portion opens to a connecting direction in which the waste liquid container is connected to the discharge portion.

8. A liquid ejecting apparatus comprising:

a liquid ejecting unit that is able to eject a liquid; and a waste liquid container accommodation device on which the waste liquid container according to claim 1 is detachably mounted, wherein the waste liquid container accommodation device includes a discharge portion discharging a waste liquid and a substrate connection portion.

9. The liquid ejecting apparatus according to claim 8, wherein the waste liquid container accommodation device which has a waste liquid container accommodation portion for accommodating the waste liquid container and a lid for covering the waste liquid container accommodation portion.

* * * * *